US005223387A

United States Patent [19]

Tsukase et al.

[11] Patent Number: 5,223,387

[45] Date of Patent: Jun. 29, 1993

[54] COLOR PHOTOGRAPHIC LIGHT-SENSITIVE MATERIAL CONTAINING A NAPHTHYL AZO DICYANO HALO PHENYL COMPOUND

[75] Inventors: Masaaki Tsukase; Kozo Sato; Hiroyuki Hirai, all of Kanagawa, Japan

[73] Assignee: Fuji Photo Film Co., Ltd., Kanagawa, Japan

[21] Appl. No.: 940,738

[22] Filed: Sep. 8, 1992

Related U.S. Application Data

[63] Continuation of Ser. No. 759,977, Sep. 17, 1991, abandoned, which is a continuation of Ser. No. 82,245, Aug. 6, 1987, abandoned.

[30] Foreign Application Priority Data

Aug. 6, 1986 [JP] Japan ..... 61-183300

[51] Int. Cl.[5] ..... G03C 1/40; G03C 1/42; G03C 5/26; G03C 5/30

[52] U.S. Cl. ..... 430/562; 430/222; 430/223; 430/563; 534/648; 534/650; 534/872; 534/649; 558/411; 558/419; 562/46

[58] Field of Search ..... 430/562, 222, 223, 563; 534/648, 650, 872, 649

[56] References Cited

U.S. PATENT DOCUMENTS 3,148,062 9/1964 Whitmore et al. ..... 534/856 X 3,932,380 1/1976 Krutar et al. ..... 534/648

4,556,632 12/1985 Sato et al. ..... 534/648

*Primary Examiner*—Floyd D. Higel

*Attorney, Agent, or Firm*—Sughrue, Mion, Zinn, Macpeak & Seas

[57] ABSTRACT

A color light-sensitive material comprising a support provided thereon at least one light-sensitive silver salt layer combined with an image forming compound represented by formula (I)

$$(\text{Dye}-\text{X})_q\text{Y} \qquad \text{(I)}$$

wherein

Dye represents a cyan dye group or a precursor thereof represented by formula (II) defined in the specification;

X represents a chemical bond or a linking group;

Y represents a group which releases Dye corresponding to or countercorresponding to light-sensitive silver salt having an imagewise latent image and makes a difference in diffusibility between the dye thus released and the compound represented by formula (I), provided that Dye and X are linked to each other by A or E in formula (II); and q represents an integer of 1 or 2, provided that when q is 2, the two groups (Dye—X) may be the same or different.

17 Claims, No Drawings

COLOR PHOTOGRAPHIC LIGHT-SENSITIVE MATERIAL CONTAINING A NAPHTHYL AZO DICYANO HALO PHENYL COMPOUND

This is a continuation of application Ser. No. 07/759,977, filed Sep. 17, 1991, now abandoned, which is a continuation of application Ser. No. 07/082,245, filed on Aug. 6, 1987, now abandoned.

FIELD OF THE INVENTION

The present invention relates to a novel cyan azo dye forming compound and, more particularly, to a color photographic light-sensitive material which contains the cyan azo dye forming compound.

BACKGROUND OF THE INVENTION

A color diffusion transfer photographic process has heretofore been well known using an azo dye forming compound which produces an azo dye having a diffusibility different from that of the dye forming compound as a result of development under a basic condition.

Examples of such a dye forming compound for releasing a cyan dye include those described in U.S. Pat. Nos. 3,942,987, 4,013,635, 4,273,708 and 4,268,625.

However, the compounds as described in these references have been found to have the disadvantage that they contain a nitro group in the para-position of the azo group which is subject to reduction during development that will cause discoloration. It has been also found that azo dyes containing a nitro group are generally subject to reduction by light which gives a poor fastness of image to light.

Furthermore, if these dye forming compounds are incorporated in the same layer as a light-sensitive silver halide emulsion, a phenomenon in which the development of silver halide is inhibited is often observed. Nitro groups probably cause such a phenomenon.

Examples of a cyan azo forming compound containing a trifluoromethanesulfonyl group in the prat-position of the azo group are described in Japanese Patent Application (OPI) No. 66227/78 (the term "OPI" as used herein means an "unexamined published application"). However, such compounds are disadvantageous in that the incorporation of fluorine cannot be easily accomplished and their fluorine-containing composition causes pollution. Furthermore, these compounds leave such to be desired in color sharpness and diffusion of released dye. Examples of magenta azo dye forming compounds comprising a diazo component containing a plurality of alkylsulfonyl groups are disclosed in British Patent 1.490,248 and Japanese Patent Application (OPI) No. 40402/80. However, since these compounds have a naphthol 2-position which is unsubstituted or has an electrophilic group introduced, their color hue is in too short a wavelength range. Thus, these compounds cannot be used as cyan dye forming compounds.

Therefore, cyan dye forming compounds have heretofore never been known containing a nitro group or trifluoromethanesulfonyl group in the para-position of the azo group.

Recently, novel cyan azo dye forming compounds obtained by an azo coupling of a diazo component free of nitro groups or a trifluoromethanesulfonyl group with 2-acylamino-1-naphthols have been proposed in U.S. Pat. No. 4,556,632. The dye forming compounds as described in these references are useful as cyan dyes as compared to the prior art compounds. However, these compounds have a shallow hue and thus have an insufficient color reproducibility since these compounds have a cyano group, an alkylsulfonyl group, or an arylsulfonyl group at the 2-position (relating to the azo group) of the phenyl group of the diazo component. Furthermore, since their color is shallow, they need to be used in an excess amount in order to obtain an excellent grey balance.

SUMMARY OF THE INVENTION

It is therefore an object of the present invention to provide a dye forming compound which produces a dye which has a beautiful hue as cyan.

It is another object of the present invention to provide a compound which forms an image having excellent fastness to light.

It is further object of the present invention to provide a dye forming compound which does not inhibit the development of silver halide.

It is further object of the present invention to provide a dye forming compound which is stable during storage and development.

It is further object of the present invention to provide a color photographic light-sensitive material which forms a cyan image excellent in fastness to light and color hue.

These and other objects of the present invention will become more apparent from the following detailed description and examples.

These objects of the present invention are accomplished with a color light-sensitive material comprising a support provided thereon at least one light-sensitive silver salt layer combined with an image forming compound represented by formula (I)

$$(\text{Dye}-\text{X})_q\text{Y} \qquad \text{(I)}$$

wherein

Dye represents a cyan dye group or a precursor thereof represented by formula (II);

X represents a chemical bond or a linking group;

Y represents a group which releases Dye corresponding to or countercorresponding to light-sensitive silver salt having an imagewise latent image and makes a difference in diffusibility between the dye thus released and the compound represented by formula (I), provided that Dye and X are linked to each other by A or E in formula (II); and q represents an integer of 1 or 2, provided that when q is 2, the two groups (Dye-X) may be the same or different

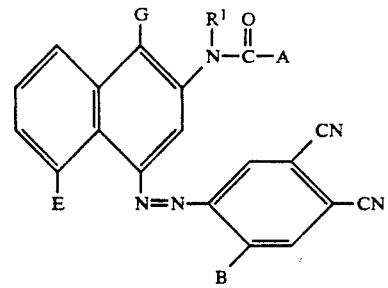

(II)

wherein

A represents a chemical bond, a hydrogen atom, a substituted or unsubstituted alkyl group, a substituted or unsubstituted cycloalkyl group, a substituted or unsubstituted aryl group, a substituted or unsubstituted heterocyclic group, or a group

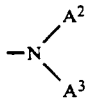

in which $A^2$ and $A^3$ each have the same meaning as A, provided that $A^2$ and $A^3$ may be linked to each other to form a heterocyclic group;

$R^1$ represents a hydrogen atom or a substituted or unsubstituted alkyl group;

B represents a hydrogen atom, a halogen atom, a substituted or unsubstituted alkyl group, a substituted or unsubstituted aryl group, a substituted or unsubstituted heterocyclic group, a substituted or unsubstituted amino group, a substituted or unsubstituted alkoxy group, a substituted or unsubstituted aryloxy group, a substituted or unsubstituted alkylthio group, a substituted or unsubstituted arylthio group, an acylamino group, an acyloxy group, a sulfonylamino group, a hydroxyl group, a carboxyl group, or a substituted or unsubstituted carbamoyl group;

E represents a chemical bond, a hydrogen atom, a substituted or unsubstituted alkyl group, a halogen atom,

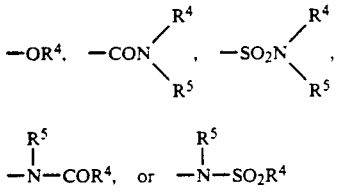

in which $R^4$ and $R^5$ each represents a hydrogen atom, a substituted or unsubstituted alkyl group, or substituted or unsubstituted aryl group, provided that $R^4$ and $R^5$ may form a 5- or 6-membered ring; and G represents a hydroxyl group or a salt thereof, or a group selected from the groups consisting of the groups represented by formulae (T), (U), and (V)

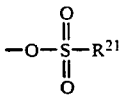

(T)

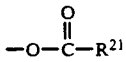

(U)

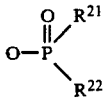

(V)

wherein $R^{21}$ and $R^{22}$ may be the same or different and each represents a substituted or unsubstituted alkyl group, a substituted or unsubstituted cycloalkyl group, a substituted or unsubstituted alkenyl group, a substituted or unsubstituted aralkyl group, a substituted or unsubstituted aryl group, a substituted or unsubstituted heterocyclic group, a substituted or unsubstituted alkoxy group, a substituted or unsubstituted aryloxy group, a substituted or unsubstituted alkylthio group, a substituted or unsubstituted arylthio group, or a substituted or unsubstituted amino group, provided that $R^{12}$ and $R^{22}$ may be linked to each other to form a 5- or 6-membered ring.

DETAILED DESCRIPTION OF THE INVENTION

Preferred examples of substituents which are allowable in the case where the above mentioned substituents represented by A, B and E are further substituted include an alkyl group, an aryl group, $—OR^2$ group, $—SR^2$ group, $—SO_2R^2$ group,

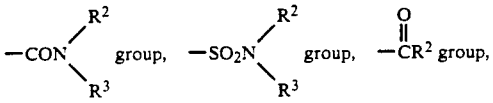

a disubstituted amino group, an acylamino group, a sulfonylamino group, a halogen atom, a cyano group, a sulfo group, a carboxyl group, and an alkyloxycarbonyl group, wherein $R^2$ and $R^3$ each represents a group selected from the group consisting of a hydrogen atom, an alkyl group, and an aryl group, which may be substituted.

The structural feature of the dye portion (formula (II)) of the image forming compound represented by formula (I) is that the dye contains cyano groups in the 4-position and the 5-position of the azo group (if both the ortho-positions of the azo group have hydrogen atoms, the 3-position and the 4-position are used) and does not contain an electrophilic group such as a sulfonyl group and a cyano group in the 2-position of the azo group. By this construction, the dye of the present invention has a hue of a considerably long wavelength.

It is known that an azo dye containing an electrophilic group incorporated in the resonance positions (the 2-position, 4-position and 6-position) of the azo group has a hue of a long wavelength.

However, it has not been known that the construction in which two positions, i.e., the 4-position and 5-position (or the 3-position and 4-position) of the azo group are substituted by an electrophilic group (a cyano group), produces a dye having a hue of a long wavelength than that of a dye having two or more resonance positions (the 2-position, 4-position and 6-position) of the azo group substituted by an electrophilic group. It has been known that the more electron the substituent for the 2-position of the azo group donates, the longer wavelength has the hue of the dye.

This result that the 2-position of the azo group should not contain an electrophilic group and that the two positions, that is, that the 4-position and 5-position (or the 3-position and 4-position) of the azo group should be substituted with an electrophilic cyano group is a new finding or unexpected fact which is not disclosed or suggested in the known references cited previously herein.

It has further been found that the compound of formula (I) of the present invention is excellent in fastness to light as cyan azo dyes disclosed in Japanese Patent Application (OPI) Nos. 93434/85 and 245156/86, and U.S. Pat. No. 4,556,632.

The present invention will be further illustrated with reference to the image forming compound of formula (I).

The linking group represented by X is an $—NR^6—$ group (in which $R^6$ represents a hydrogen atom, an alkyl group or a substituted alkyl group), $—SO_2—$ group, —CO— group, an alkylene group, a substituted alkylene group, a phenylene group, a substituted phenylene group, a naphthylene group, —O— group, —SO— group, or a group formed by combining two or more of these groups. Preferred linking groups are represented by $—NR^6—SO_2—$, $—NR^6—CO—$ or $—R^7—(L)_k—(R^8)_l—$ in which $R^7$ and $R^8$ each represents an alkylene group, a substituted alkylene group, a phenylene group, a substituted phenylene group, a naphthylene group, or a substituted naphthylene group, L represents —O—, —CO—, —SO—, $—SO_2—$, $—SO_2NH—$, $—NHSO_2—$, —CONH—, or —NHCO—, k represents 0 or 1, and l represents 1 when k is 1, or 1 or 0 when k is 0.

Other preferred examples of the linking groups include a group formed by combining $—NR^6—SO_2—$ or $—NR^6—CO—$ with $—R^7—(L)_k—(R^8)_l—$.

Preferred examples of the group represented by $R^6$ include a hydrogen atom, a $C_{1-4}$ lower alkyl group (the term "$C_{1-4}$" herein means "having from 1 to 4 carbon atoms"), and a $C_{1-4}$ substituted alkyl group (substituents are a hydrogen atom, a hydroxyl group, an alkoxy group, a cyano group, and the like). Particularly preferred among these groups is a hydrogen atom. Preferred examples of the group represented by $R^7$ or $R^8$ include a $C_{1-6}$ alkylene group, a $C_{1-8}$ substituted alkylene group (substituents are an alkyl group, an alkoxy group, a hydroxyl group, a halogen atom, a cyano group, etc.), a phenylene group (including ortho-, meta-, and para-phenylene group), a $C_{6-10}$ substituted phenylene group (substituents are an alkyl group, an alkoxy group, a substituted alkoxy group, a halogen atom, a substituted alkyl group, a hydroxyl group, a carboxyl group, a sulfamoyl group, a substituted sulfamoyl group, an alkylsulfonylamino group, a sulfamide group, a substituted sulfamide group, a disubstituted amino group, etc.), a naphthylene group, and a $C_{10-14}$ substituted naphthylene group (the same substituents which can be used for the substituted phenylene group can be used as the substituents for the naphthylene group).

When E and X are linked to each other, A preferably represents a substituted or unsubstituted alkyl group, a substituted or unsubstituted cycloalkyl group, a substituted or unsubstituted aryl group, or a substituted or unsubstituted heterocyclic group.

A preferred example of the alkyl group represented by A is a $C_{1-8}$ straight-chain or branched alkyl group. Specific examples of such an alkyl group include a methyl group, an ethyl group, a n propyl group, a t-butyl group, a n-butyl group, a 2-ethylhexyl group, a 2,2-dimethylpropyl group, and a sec-butyl group. A preferred example of the cycloalkyl group represented by A is a $C_{5-8}$ 5- or 6-membered cycloalkyl group. Specific examples of such a cycloalkyl group include a cyclopentyl group and a cyclohexyl group.

Preferred examples of the substituents for the substituted alkyl or cycloalkyl group include a halogen atom such as Cl and Br, $—OR^2$ group (in which $R^2$ is as defined above and thus represents a $C_{1-8}$ substituted or unsubstituted alkyl group such as a methyl group, an ethyl group, a methoxyethyl group, an ethoxymethyl group, a trichloromethyl group, a cyanomethyl group, a methanesulfonylaminomethyl group, and a sulfamoylmethyl group, and a $C_{6-10}$ substituted or unsubstituted aryl group such as a phenyl group, a tolyl group, a methoxyphenyl group, a chlorophenyl group, a cyanophenyl group, and a methanesulfonylaminophenyl group), a cyano group,

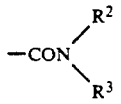

(in which $R^2$ represents a hydrogen atom, a $C_{1-4}$ alkyl group or a $C_{6-10}$ aryl group; and $R^3$ represents a hydrogen atom, a $C_{1-4}$ alkyl group or a $C_{6-10}$ aryl group), $—SO_2R^2$ group (in which $R^2$ preferably represents a $C_{1-8}$ alkyl group or a $C_{6-10}$ aryl group), a carboxy group, a sulfo group, an acylamino group (preferably having 2 to 8 carbon atoms), and a sulfonyl amino group (preferably having 1 to 8 carbon atoms).

A preferred example of the aryl group represented by A is a $C_{6-10}$ aryl group. Specific examples of such an aryl group include a phenyl group, and a naphthyl group. Preferred examples of substituents for the substituted aryl group include a substituted or unsubstituted alkyl group preferably having 1 to 8 carbon atoms, $—OR^2$ group (in which $R^2$ preferably represents a $C_{1-8}$ alkyl group or a substituted alkyl group (preferred examples of the substituent include a $C_{1-5}$ alkoxy group, a halogen atom (Cl, Br, etc.), and a cyano group)), a halogen atom, an acylamino group (preferably having 2 to 8 carbon atoms), a sulfonylamino group (preferably having 1 to 8 carbon atoms), a cyano group, $—SO_2R^2$ group (in which $R^2$ preferably represents a $C_{1-8}$ alkyl group), a hydroxyl group,

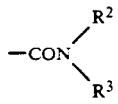

group (in which $R^2$ and/or $R^3$ preferably represents a hydrogen atom or a $C_{1-8}$ alkyl group), a

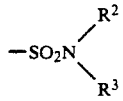

group (in which $R^2$ and/or $R^3$ preferably represents a hydrogen atom or a $C_{1-8}$ alkyl group), a carboxy group, a sulfo group, an alkylcarbonyl group (preferably having 1 to 8 carbon atoms), and a $C_{2-8}$ 2-substituted amino group.

Preferred examples of the heterocyclic residual group represented by A include 5- or 6-membered heterocyclic compounds containing an oxygen atom, a nitrogen atom, or a sulfur atom as hetero atoms. Specific examples of such heterocyclic groups include a pyridyl group, a furyl group, a thienyl group, a pyrrole group, and an indolyl group. Such heterocyclic residual groups may contain substituents described above as examples of the substituents for the substituted aryl group.

In the group

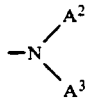

represents by A, $A^2$ and/or $A^3$ preferably represents a hydrogen atom, a $C_{1-8}$ alkyl group, or a $C_{6-10}$ aryl group. Particularly, $A^2$ and $A^3$ both preferably represent an alkyl group. The ring formed by the connection of $A^2$ and $A^3$ is preferably a 6-membered ring. Specific examples of

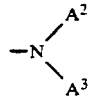

group include a diethylamino group, an anilino group, a piperidino group, and a morpholino group.

In the case where X and E are linked to each other, particularly preferred among the substituents represented by A are an ethyl group, an isopropyl group, a t-butyl group, a cyclohexyl group, a 3-heptyl group, a methoxyethyl group, a phenyl group, a p-methylsulfonylphenyl group, a p-methylsulfonylaminophenyl group, and a p-sulfamoylphenyl group.

Preferred examples of the group represented by $R^1$ include a hydrogen atom, a $C_{1-4}$ lower alkyl group, and a $C_{1-4}$ substituted alkyl group (examples of the substituents include a halogen atom, a hydroxyl group, an alkoxy group, and a cyano group). Particularly preferred among these groups is a hydrogen atom.

B preferably represents a hydrogen atom, a substituted or unsubstituted alkylthio group, a substituted or unsubstituted arylthio group, a substituted or unsubstituted alkyloxy group, a substituted or unsubstituted aryloxy group, or an acylamino group.

Preferred examples of the halogen atom represented by B include F, Cl, and Br.

Preferred examples of the alkyl group represented by B include a $C_{1-4}$ lower alkyl group such as a methyl group, an ethyl group, and an isopropyl group, and a substituted lower alkyl group (preferred examples of the substituents include a halogen atom such as Cl and Br, —$OR^2$ group in which $R^2$ preferably represents a $C_{1-6}$ alkyl group, a cyano group, —$SO_2R^2$ group in which $R^2$ preferably represents a $C_{1-6}$ alkyl group, an acylamino group preferably containing 2 to 6 carbon atoms, a $C_{1-6}$ sulfonylamino group,

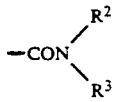

group in which $R^2$ and/or $R^3$ preferably represents a hydrogen atom, a $C_{1-6}$ alkyl group, or a $C_{6-10}$ aryl group, and

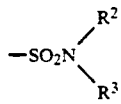

group in which $R^2$ and/or $R^3$ preferably represents a hydrogen atom, a $C_{1-6}$ alkyl group, or a $C_{6-10}$ aryl group.

Preferred examples of the aryl group represented by B include a phenyl group and a naphthyl group which may be substituted. Preferred examples of the substituents for such aryl groups include a $C_{1-6}$ substituted or unsubstituted alkyl group (as the substituents there may be used those described as that for the above substituted lower alkyl group), —$OR^2$ group in which $R^2$ preferably represents a $C_{1-6}$ substituted or unsubstituted alkyl group (examples of the substituents for the unsubstituted alkyl group include a $C_{1-4}$ alkoxy group, a halogen atom such as Cl and Br, a cyano group, —$SO_2R^2$ group in which $R^2$ represents a $C_{1-4}$ alkyl group, and a $C_{2-6}$ 2-substituted amino group), an acylamino group preferably having 2 to 4 carbon atoms, a sulfonylamino group preferably having 1 to 4 carbon atoms, a cyano group, —$SO_2R^2$ group in which $R^2$ preferably represents a $C_{1-4}$ alkyl group

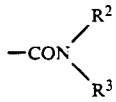

in which $R^2$ and/or $R^3$ preferably represents a hydrogen atom, or a $C_{1-4}$ alkyl group,

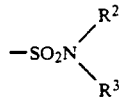

group in which $R^2$ and/or $R^3$ preferably represents a hydrogen atom and a $C_{1-4}$ alkyl group, a 2-substituted amino group preferably substituted by a $C_{1-4}$ alkyl groups, a carboxy group, a sulfo group, and an alkyloxycarbonyl group preferably having 1 to 4 carbon atoms.

Preferred examples of the heterocyclic residual group represented by B include 5- or 6-membered heterocyclic groups containing an oxygen atom, a nitrogen atom or a sulfur atom as hetero atoms. Specific examples of such heterocyclic groups include a pyridyl group, a furyl group, a thienyl group, a pyrrole group, and an indolyl group. Such heterocyclic residual groups may contain substituents described as that of the above substituted aryl group.

The alkyloxy or aryloxy group and the alkylthio or arylthio group represented by B are preferably represented by the following formulae (P) and (Q):

$$-OR^{13} \quad (P)$$

$$-SR^{14} \quad (Q)$$

Preferred examples of the group represented by $R^{13}$ and $R^{14}$ include those for the substituted or unsubstituted alkyl grup and substituted or unsubstituted aryl group described above with reference to the group represented by B.

The substituted or unsubstituted amino group represented by B is represented by formula

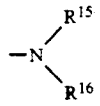

wherein $R^{15}$ and/or $R^{16}$ preferably represents a hydrogen atom, a $C_{1-4}$ substituted or unsubstituted alkyl group, or a $C_{6-10}$ substituted or unsubstituted aryl group, with the proviso that $R^{15}$ and $R^{16}$ may be linked to each other to form a ring. Preferred examples of the substituents for the substituted alkyl group include a halogen atom such as Cl and Br, a cyano group, and a $C_{1-4}$ alkoxy group. Preferred examples of the substituents for the substituted aryl group include a halogen atom such as Cl and Br, a cyano group, a $C_{1-4}$ alkoxy group, $-SO_2R^4$ group in which $R^4$ represents a $C_{1-4}$ alkyl group, and a $C_{2-6}$ 2-substituted amino group. Preferred examples of such substituted or unsubstituted amino groups include a methylamino group, a diethylamino group, an anilino group, and a morpholino group.

The substituted or unsubstituted carbamoyl group represented by B is represented by formula

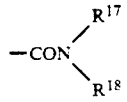

wherein $R^{17}$ and/or $R^{18}$ preferably represents a hydrogen atom, a $C_{1-6}$ alkyl group, or a $C_{6-10}$ aryl group. Specific examples of such carbamoyl groups include an ethylcarbamoyl group, a dimethylcarbamoyl group, and an anilinocarbamoyl group.

The acylamino group represented by B preferably has 2 to 10 carbon atoms. Specific examples of such acylamino groups include an acetylamino, group, a propionylamino group, an isobutylylamino group, and a benzoylamino group. The acyloxy group represented by B preferably has 2 to 6 carbon atoms. Specific examples of such an acyloxy group include an acetyloxy group and a propionyloxy group. The sulfonylamino group represented by B preferably contains a $C_{1-6}$ alkyl group or a $C_{6-10}$ aryl group. Specific examples of such a sulfonylamino group include a methanesulfonylamino group, an ethanesulfonylamino group, and a benzenesulfonylamino group.

Particularly preferred among the substituents represented by B are a hydrogen atom, a halogen atom such as F, Cl and Br, a methylthio group, a methoxyethoxy group, and an acetylamino group.

When A and X are linked to each other, E preferably represents $-NHCO-R^4$ or $-NHSO_2R^4$ in which $R^4$ represents a hydrogen atom, a substituted or unsubstituted alkyl group, or a substituted or unsubstituted aryl group.

The alkyl group represented by E preferably has 1 to 8 carbon atoms. Specific examples of such an alkyl group include a methyl group, an ethyl group, and an isopropyl group. Preferred examples of the substituents for the substituted alkyl group include a halogen atom such as Cl and Br, a cyano group, a $C_{1-5}$ alkoxy group, a sulfonylamino group, an acylamino group, a carbamoyl group, a sulfamoyl group, $-SO_2R^2$ group in which $R^2$ represents a $C_{1-8}$ alkyl group, and a $C_{2-6}$ 2-substituted amino group.

Preferred examples of the halogen atom represented by E include Cl and Br.

In the group $-OR^4$ represented by E, $R^4$ preferably represents a $C_{1-8}$ substituted or unsubstituted alkyl group or a $C_{6-10}$ substituted or unsubstituted aryl group. As the substituents for the substituted alkyl group there may be used those described with reference to the above-mentioned substituted alkyl group. Preferred examples of the substituents for the substituted aryl group include a $C_{1-8}$ alkyl group, a halogen atom such as Cl and Br, a cyano group, a $C_{1-5}$ substituted or unsubstituted alkoxy group, a sulfonylamino group, an acylamino group, a substituted or unsubstituted carbamoyl group, a substituted or unsubstituted sulfamoyl group, $-SO_2R^2$ group in which $R^2$ represents a $C_{1-8}$ alkyl group, and a $C_{2-6}$ 2-substituted amino group.

In the group

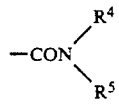

represented by E, $R^4$ and/or $R^5$ preferably represents a hydrogen atom, a $C_{1-8}$ substituted or unsubstituted alkyl group, or a $C_{6-10}$ substituted or unsubstituted aryl group. As the substituents for the substituted alkyl group there may be preferably used those described above with reference to the above-mentioned substituted alkyl group. As the substituents for the substituted aryl group there may be preferably used those described above with reference to the substituted aryl group represented by $-OR^4$.

In the group

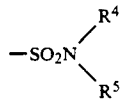

represented by E, $R^4$ and/or $R^5$ preferably represents a hydrogen atom, a $C_{1-8}$ substituted or unsubstituted alkyl group, or a $C_{6-10}$ substituted or unsubstituted aryl group. As the substituents for the substituted alkyl group there may be preferably used those described above with reference to the substituted alkyl group. As the substituents for the substituted aryl group there may be preferably used those described above with reference to the substituted aryl group represented by $-OR^4$. Similarly, in the group

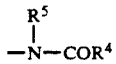

represented by E, $R^4$ and/or $R^5$ preferably represents a hydrogen atom, a $C_{1-8}$ substituted or unsubstituted alkyl group, or a $C_{6-10}$ substituted or unsubstituted aryl group. As the substituents for the substituted alkyl group there may be preferably used those described above with reference to the substituted alkyl group. As the substituents for the substituted aryl group there may be preferably used those described above with reference to the substituted aryl group. Similarly, in the group

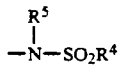

represented by E, $R^4$ and/or $R^5$ preferably represents a hydrogen atom, a $C_{1-8}$ substituted or unsubstituted alkyl group or a $C_{6-10}$ substituted or unsubstituted aryl group. As the substituents for the substituted alkyl group there may be preferably used those described above with reference to the substituted alkyl group. As the substituents for the substituted aryl group there may be preferably used those described above with reference to the substituted aryl group represented by $—OR^4$.

In the case where the group which is bonded to X is A, particularly preferred among the substituents represented by E are $—NHCOCH_3$ group, $—NHSO_2CH_3$ group, $—NHCOC_3H_7$ group, $—NHSO_2C_2H_5$ group,

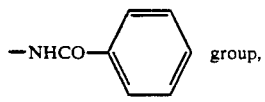

group,

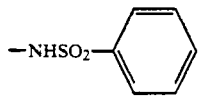

group,

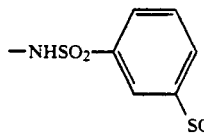

group, and

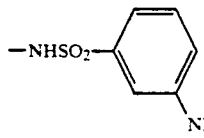

group.

G represents a hydroxyl group or a salt thereof such as alkali metal salt (e.g., $—O^{\ominus}Li^{\oplus}$, and $—O^{\ominus}K^{\oplus}$), photographically inert ammonium salt (e.g., $—^{\ominus}NH_4^{\oplus}$, and $—O^{\ominus}N(C_2H_5)_4^{\oplus}$), or group selected from the groups of formulae (T) or (V):

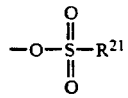

(T)

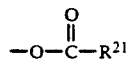

(U)

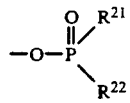

(V)

A preferred example of the alkyl group represented by $R^{21}$ or $R^{22}$ is a $C_{1-18}$ straight-chain or branched alkyl group. Specific examples of such an alkyl group include a methyl group, an ethyl group, a n-propyl group, a n-butyl group, a n-hexyl group, a n-heptyl group, a 2-ethylhexyl group, a n-dodecyl group, and a n-dodecyl group. A preferred example of the cycloalkyl group represented by $R^{21}$ or $R^{22}$ is a $C_{5-10}$ monocyclic or polycyclic 5- or 6-membered cycloalkyl group. Specific examples of such a cycloalkyl group include a cyclopentyl group and a cyclohexyl group. Examples of the substituents for the substituted alkyl group or cycloalkyl group include a halogen atom, an alkoxy group preferably having 1 to 18 carbon atoms, an aryloxy group preferably having 6 to 18 carbon atoms, a cyano group, an alkylthio group preferably having 1 to 18 carbon atoms, an arylthio group preferably having 6 to 8 carbon atoms, an unsubstituted or $C_{2-18}$ disubstituted carbamoyl group, an alkylsulfonyl group preferably having 1 to 18 carbon atoms, an arylsulfonyl group preferably having 6 to 18 carbon atoms, a disubstituted amino group substituted by an alkyl group preferably having 1 to 18 carbon atoms or an aryl group preferably having 6 to 18 carbon atoms, a carboxy group, a sulfo group, an acylamino group preferably having 1 to 18 carbon atoms, and sulfonylamino group.

Examples of the alkenyl group include a vinyl group, an allyl group, a crotyl group, and a styryl group.

Examples of the aralkyl group include a benzyl group and a $\beta$-phenethyl group.

Such an aralkyl group may contain substituents described above with reference to the substituted alkyl group.

A preferred example of the aryl group is a $C_{6-18}$ aryl group. Specific examples of such an aryl group include a phenyl group, a naphthyl group, and an anthryl group. Examples of substituents allowable in such an aryl group include a substituted or unsubstituted alkyl group preferably having 1 to 18 carbon atoms, a substituted or unsubstituted alkoxy group preferably having 1 to 18 carbon atoms, a substituted or unsubstituted aryl group preferably having 6 to 18 carbon atoms, a halogen atom, an acylamino group preferably having 1 to 18 carbon atoms, a sulfonylamino group, a cyano group, a nitro group, an alkylthio group preferably having 1 to 18 carbon atoms, an arylthio group preferably having 6 to 18 carbon atoms, an alkylsulfonyl group preferably having 1 to 18 carbon atoms, an arylsulfonyl group preferably having 6 to 18 carbon atoms, a carbamoyl group, a mono- or disubstituted carbamoyl group preferably having 2 to 18 carbon atoms, a mono- or disubstituted sulfamoyl group preferably having 1 to 18 carbon atoms, a disubstituted amino group substituted by an alkyl group preferably having 1 to 18 carbon atoms or an aryl group preferably having 6 to 18 carbon atoms, a carboxy group, a sulfo group, an alkyloxycarbonyl group preferably containing a $C_{1-18}$ alkyl portion, and an aryloxycarbonyl group preferably containing a $C_{6-18}$ aryl portion.

A preferred example of the heterocyclic residual group is a 5- or 6-membered heterocyclic group containing an oxygen atom, a nitrogen atom, or a sulfur atoms as hetero atoms. Specific examples of such a heterocyclic group include a pyridyl group, a furyl group, a thienyl group, a pyrrole group, and an indolyl group. Such a heterocyclic residual group may contain substituents described above with reference to the substituted aryl group.

Preferred examples of the substituted or unsubstituted alkyl, aryloxy, alkylthio, or arylthio group are represented by the following general formulae (W) and (Z):

$$—OR^{23} \qquad (W)$$

$-SR^{24}$ (Z)

Preferred examples of the group represented by $R^{23}$ or $R^{24}$ include those described above for the substituted or unsubstituted alkyl group or substituted or unsubstituted aryl group with reference to $R^{21}$ and $R^{22}$.

Preferred examples of the substituted amino group include an amino groups substituted by a $C_{1-18}$ alkyl group or a $C_{6-18}$ aryl group.

A more preferred example of the compound of the present invention is the compound wherein in formula (II), $R^1$ is a hydrogen atom and G is a hydroxyl group. A further preferred example of the compound of the present invention is represented by formula (IA) or (IB):

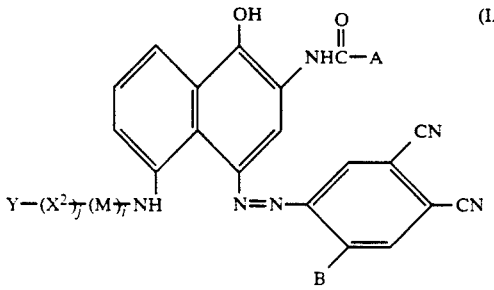

(IA)

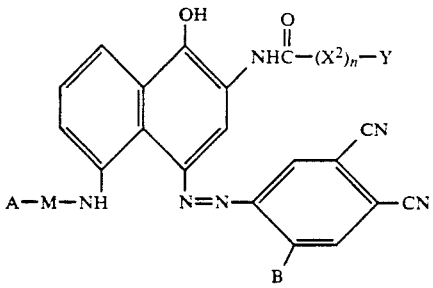

(IB)

wherein M represents $-SO_2-$ group or $-\overset{O}{\overset{\|}{C}}-$ group;

$X^2$ represents an $-R-(L)_k-(R^8)_l-$ group in which $R^7$, L, k, $R^8$ and l are as defined above; i and j each represents 0 or 1; and A, B and Y are as defined in formulae (I) and (II).

In formulae (IA) and (IB), A preferably represents a substituted or unsubstituted alkyl group, a substituted or unsubstituted cycloalkyl group, a substituted or unsubstituted aryl group, or a substituted or unsubstituted heterocyclic group; B preferably represents a hydrogen atom, a halogen atom, a substituted or unsubstituted alkylthio group, a substituted or unsubstituted arylthio group, a substituted or unsubstituted alkyloxy group, a substituted or unsubstituted aryloxy group, or an acylamino group; $R^7$ and $R^8$ each preferably represents an alkylene group, a substituted alkylene group, a phenylene group, or a substituted phenylene group; and L preferably represents $-SO_2NH-$, $-NHSO_2-$, $-CONH-$, or $-NHCO-$.

Y represents a group which release Dye corresponding to or countercorresponding to light-sensitive silver salt having an imagewise latent image and makes a difference in diffusibility between the dye thus released and the compound represented by formula (I). Various examples of such group are known in the art of photographic light-sensitive materials, and described, e.g., in U.S. Pat. No. 4,556,632, etc.

The present invention will be further illustrated with reference to Y, but the present invention should not be construed as being limited thereto.

In one embodiment of the present invention, Y is selected such that the compound of formula (I) of the present invention is a nondiffusible image forming compound producing a diffusible dye which undergoes self cleavage upon oxidation during development.

Useful examples of Y for this type of compound of formula (I) include an N-substituted sulfamoyl group. Specific examples of Y include a group represented by formula (YI):

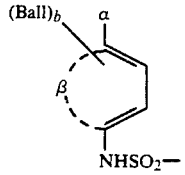

(YI)

wherein $\beta$ represents a nonmetallic atom group required to form a benzene ring to which carbon or hetero rings may be condensed to form a naphthalene ring, a quinoline ring, a 5,6,7,8-tetrahydronaphthalene ring, chroman ring, or the like.

In formula (YI), $\alpha$ represents a group represented by $-OG^{11}$ or $-NHG^{12}$ in which $G^{11}$ represents a hydrogen atom or a group which is hydrolyzed to produce a hydroxyl group, and $G^{12}$ represents a hydrogen atom, a $C_{1-22}$ alkyl group, or a group which renders $-NHG^{12}$ group hydrolyzable. Ball represents a ballast group, and b represents 0, 1 or 2.

Specific examples of this type of Y group are described in Japanese Patent Application (OPI) Nos. 33826/73 and 50736/78.

Another example of this type of Y group is a group represented by formula (YII):

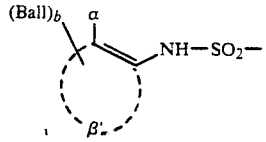

(YII)

wherein Ball, $\alpha$, and b are as defined in formula (YI); and $\beta'$ represents an atomic group required to form a carbon ring such as a benzene ring to which carbon or heterocyclic rings may be condensed to form a naphthalene ring, a quinoline ring, a 5,6,7,8-tetrahydronaphthalene ring, a chroman ring or the like.

Specific examples of this type of Y group are described in Japanese Patent Application (OPI) Nos. 113624/76, 12542/81, 16130/81, 16131/81, 4043/82 and 650/82, and U.S. Pat. No. 4,053,312.

Another example of this type of Y group is a group represented by formula (YIII):

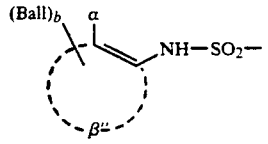

(YIII)

wherein Ball, α and b are as defined in formula (YI); and β'' represents an atomic group required to form a heterocyclic group such as a pyrazole ring and a pyridine ring to which carbon or heterocyclic rings may be condensed. Specific examples of this type of Y group are described in Japanese Patent Application (OPI) No. 104343/76.

A further preferred example of this type of Y group is a group represented by formula (YIV):

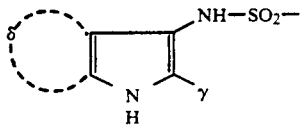

(YIV)

wherein γ preferably represents a hydrogen atom, a substituted or unsubstituted alkyl, aryl or heterocyclic group, or —CO—$G^{21}$ group in which $G^{21}$ represents —$OG^{22}$, —S—$G^{22}$ or

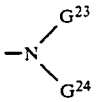

(in which $G^{22}$ represents a hydrogen atom, an alkyl group, a cycloalkyl group or an aryl group; $G^{23}$ has the same meaning as $G^{22}$ or represents an acyl group derived from an aliphatic or aromatic carboxylic or sulfonic acid; and $G^{24}$ represents a hydrogen atom, or a substituted or unsubstituted alkyl group); and δ represents an atomic group required to form a condensed benzene ring.

Specific examples of this type of Y group are described in Japanese Patent Application (OPI) Nos. 104343/76, 46730/78, 130122/79 and 85055/82.

Another example of this type of Y group useful in the compound of formula (I) of the present invention is a group represented by formula (YV):

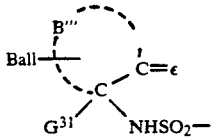

(YV)

wherein Ball is the same as defined in the general formula (YI); ε represents an oxygen atom of =$NG^{32}$ group in which $G^{32}$ represents an amino group which may contain a hydroxyl group or a substituent (examples of the compound represented by $H_2N$—$G^{32}$ include hydroxylamines, hydrazines, semicarbazides, and thiosemicarbazides); and β''' represents an atomic group required to form a 5-, 6- or 7-membered saturated or unsaturated nonaromatic hydrocarbon ring.

In formula (YV), $G^{31}$ represents a hydrogen atom or a halogen atom such as a fluorine atom, a chlorine atom, and a bromine atom. Specific examples of this type of Y group are described in Japanese Patent Application (OPI) Nos. 3819/78 and 48534/79.

Other examples of this type of Y group are described in Japanese Patent Publication Nos. 32129/73 and 39165/73, Japanese Patent Application (OPI) No. 64436/74, and U.S. Pat. No. 3,443,934.

A further example of this type of Y group for the compound of formula (I) of the present invention is represented by formula (YVI):

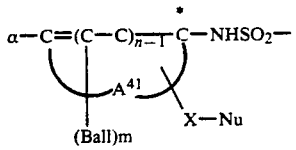

(YVI)

wherein $A^{41}$ represents an atomic group required to form an aromatic ring; Ball represents an organic ballast group on the aromatic ring, and when more than one Ball is present it can be the same or different, and m represents an integer of 1 or 2.

In formula (YVI), X represents a divalent organic group containing 1 to 8 atoms. The nucleophilic group (Nu) and the electrophilic center (carbon atom with * mark) together form a 5- to 12-membered ring. In the general formula (YVI), Nu represents a nucleophilic group, n represents an integer of 1 or 2, and α is as defined in formula (YI). Specific examples of this type of Y group are described in Japanese Patent Application (OPI) No. 20735/82.

In another embodiment of the present invention, Y is selected such that the compound of formula (I) of the present invention is a nondiffusible image forming compound which undergoes self cleavage to release a diffusible dye in the presence of a base, but does not substantially release a dye upon reaction with an oxide form of a developing agent.

An example of Y group useful for this type of compound of formula (I) of the present invention is represented by formula (YVII):

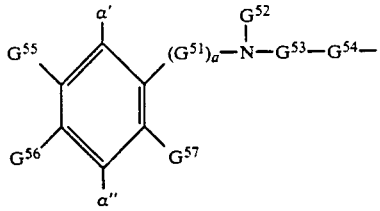

(YVII)

wherein α' represents an oxidizable nucleophilic group such as a hydroxyl group, a primary or secondary amino group, a hydroxyamino group, and a sulfonamide group, or a precursor thereof; α'' represents a dialkylamino group or any one of the groups defined as α'; $G^{51}$ represents a $C_{1-3}$ alkylene group; a represents 0 or 1; $G^{52}$ represents a $C_{1-40}$ substituted or unsubstituted alkyl group or a $C_{6-40}$ substituted or unsubstituted aryl group; $G^{53}$ represents a nucleophilic group such as —CO— and —CS—; and $G^{54}$ represents an oxygen atom, a sulfur atom, a selenium atom, or a nitrogen atom, with the proviso that if $G^{54}$ is a nitrogen atom, it may be substituted by a hydrogen atom, a $C_{1-10}$ substituted or unsubstituted alkyl group, or a $C_{6-20}$ aromatic residual group.

In formula (YVII), $G^{55}$, $G^{56}$ and $G^{57}$ each represents a hydrogen atom, a halogen atom, a carbonyl group, a sulfamoyl group, a sulfonamide group, or a $C_{1-40}$ alkyloxy group, or are as defined in $G^{52}$, with the proviso that $G^{55}$ and $G^{56}$ may together form a 5-, 6- or 7-membered ring.

Alternatively, $G^{56}$ represents

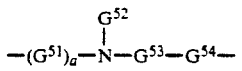

in which at least one of $G^{52}$, $G^{55}$, $G^{56}$ and $G^{57}$ represents a ballast group. Specific examples of this type of Y group are described in Japanese Patent Application (OPI) No. 63618/76.

Further examples of this type of Y group include groups represented by formula (YVIII) or (YIX):

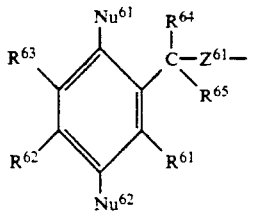

(YVIII)

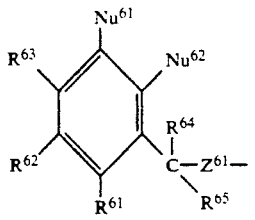

(YIX)

wherein $Nu^{61}$ and $Nu^{62}$ may be the same or different and each represents a nucleophilic group or a precursor thereof; $Z^{61}$ represents a divalent atomic group electronegative to the carbon atoms to which $R^{64}$ and $R^{65}$ are bonded; $R^{61}$, $R^{62}$ and $R^{63}$ each represents a hydrogen atom, a halogen atom, an alkyl group, an alkoxy group, or an acylamino group, or $R^{61}$ and $R^{62}$ together form a condensed ring when $R^{61}$ and $R^{62}$ are present adjacent to each other on the ring, or $R^{62}$ and $R^{63}$ together with the remaining portion of the molecule form a condensed ring; and $R^{64}$ and $R^{65}$ each may be the same or different and represents a hydrogen atom, a hydrocarbon group, or a substituted hydrocarbon group, with the proviso that a ballast group (Ball) having a large enough size to render the compound immobile is present in at least one of the substituents $R^{61}$, $R^{62}$, $R^{63}$, $R^{64}$ and $R^{65}$. Specific examples of this type of Y group are described in Japanese Patent Application (OPI) Nos. 69033/78 and 130927/79.

Further examples of this type of Y group include a group of formula (YX):

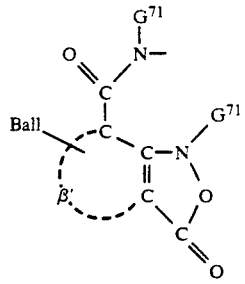

(YX)

wherein Ball and $\beta'$ are as defined in formula (YII); and $G^{71}$ represents a substituted or unsubstituted alkyl group. Specific examples of this type of Y group are described in Japanese Patent Application (OPI) Nos. 111628/74, and 4819/77.

In a further embodiment of the present invention, Y is selected such that the compound of formula (I) of the present invention is a nondiffusible image forming compound which does not release a dye by itself, but releases a dye upon reaction with a reducing agent. In this case, a compound which mediates a redox reaction (so-called an electron donor) is preferably used in combination.

An example of this type of Y group is represented by formula (YXI):

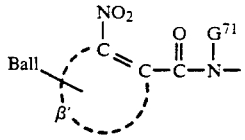

(YXI)

wherein Ball and $\beta'$ are as defined in formula (YII); and $G^{71}$ represents a substituted or unsubstituted alkyl group. Specific examples of this type of Y group are described in Japanese Patent Application (OPI) Nos. 35533/78 and 11082/78.

Further examples of this type of Y group include a group represented by formula (YXII):

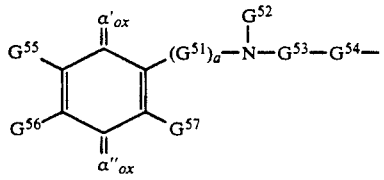

(YXII)

wherein $\alpha'_{ox}$ and $\alpha''_{ox}$ represent a group which produces $\alpha'$ and $\alpha''$ upon reduction, respectively; and $\alpha'$, $\alpha''$, $G^{51}$, $G^{52}$, $G^{53}$, $G^{54}$, $G^{55}$, $G^{56}$, $G^{57}$ and a are as defined in formula (YVII). Specific examples of this type of Y are described in Japanese Patent Application (OPI) No. 110827/78, and U.S. Pat. Nos. 4,356,249 and 4,358,525.

Further examples of this type of Y group include groups represented by formulae (YXIIIA) and (YXIIIB):

(YXIIIA)

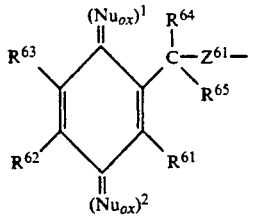

(YXIIIB)

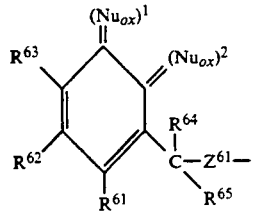

wherein $(Nuox)^1$ and $(Nuox)^2$ each may be the same or different and represent an oxidized nucleophilic group, and the other symbols are as defined in formulae (YVIII) and (YIX). Specific examples of this type of Y group are described in Japanese Patent Application (OPI) Nos. 130927/79 and 164342/81.

Further examples of this type of Y group include a group represented by formula (YXIV):

(YXIV)

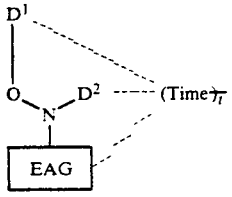

wherein EAG represents a group which receives electrons from a reducing compound; and N and O represent a nitrogen atom and an oxygen atom, respectively. The single bond between N and O undergoes cleavage after EAG receives electrons.

$D^1$ and $D^2$ each represent a chemical bond or substituent other than a hydrogen atom. If $D^1$ or $D^2$ is bonded to $-(Time)_t-$, $D^1$ or $D^2$ is a chemical bond. $D^1$ and $D^2$ may be linked to each other to form a ring.

In formula (YXIV), Time represents a group which releases a dye upon a reaction triggered by the cleavage of the nitrogen-oxygen single bond.

In formula (YXIV), Time represents a group which releases a dye upon a reaction triggered by the cleavage of the nitrogen-oxygen single bond.

In formula (YXIV), t represents an integer of 0 or 1.

In formula (YXIV), the solid line indicates a chemical bond, and at least one of the broken lines is bonded to the respective group.

Specific examples of this type of Y are described in Japanese Patent Application No. 244873/85.

Electron donors which may be used in combination with the compound of formula (I) of the present invention are described in the patent specifications cited with reference to formulae (YXI), (YXII), (YXIIIA), (YXIIIB) and (YXIV).

In a still further embodiment of the present invention, Y is selected such that the compound of formula (I) of the present invention is an LDA (Linked Donor Acceptor) compound. Such a compound is a nondiffusible image forming compound which undergoes a donor acceptor reaction in the presence of a base to release a diffusible dye but does not substantially release a dye upon reaction with an oxide form of a developing agent.

An example of this type of Y group is represented by formula (YXV). Specific examples of this type of Y group are described in Japanese Patent Application (OPI) No. 185333/84.

(YXV)

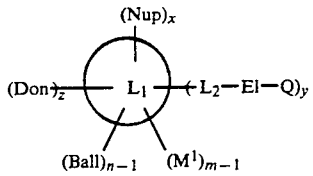

wherein n, x, y and z each represents an integer of 1 or 2; m represents an integer of 1 or more; Don represents an electron donor or a group containing a precursor portion thereof; $L_1$ represents an organic group linking NuP to $-L_2-El-Q$ or Don; Nup represents a precursor or a nucleophilic group; El represents an electrophilic center; Q represents a divalent group; Ball represents a ballast group; $L_2$ represents a linking group; and $M^1$ represents an arbitrary substituent.

In still another embodiment of the present invention, Y is selected such that the compound of the general formula (I) of the present invention is a nondiffusible compound which decomposes to release a dye under a basic condition in the unexposed portion, but does not substantially release a dye when it undergoes cross oxidation with an oxide form of a reducing agent generally used in the photographic system in the exposed portion. An example of Y useful for this type of compound of formula (I) is represented by formula (YXVI).

(YXVI)

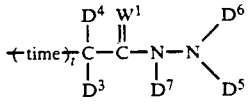

wherein $D^3$ and $D^4$ each represents a hydrogen atom or a substituted or unsubstituted alkyl, cycloalkyl, alkenyl, alkynyl, aralkyl, aryl, or heterocyclic group; $D^5$ represents a substituted or unsubstituted alkyl, cycloalkyl, alkenyl, alkynyl, aralkyl, aryl, heterocyclic, acyl, alkoxycarbonyl, aryloxycarbonyl, a carbamoyl, sulfonyl, or sulfamoyl group; $D^6$ and $D^7$ each represents a hydrogen atom or a substituted or unsubstituted acyl, alkoxycarbonyl, or aryloxycarbonyl group; $W^1$ represents an oxygen atom, a sulfur atom, or an imino group; (time) represents a timing group; and t represents 0 or 1.

In the present invention, preferred examples of the group represented by Y include those represented by formula (YI), (YII), (YXII) or (YXIV).

The ballast group in formulae (YI) to (YXIII) and (YXV) is an organic ballast group which can render the compound of formula (I) nondiffusible. Such a ballast group is preferably a $C_{8-32}$ group hydrophobic groups. Such an organic ballast group is bonded to the compound of the present invention directly or via linking group such as an imino bond, an ether bond, a thioether bond, a carbonamide bond, a sulfonamide bond, a ureido bond, an ester bond, a carbamoyl bond, a sulfamoyl bond, or a combination thereof.

Specific examples of such a ballast group include an alkyl group such as a dodecyl group and an octadecyl group; an alkenyl group such as a dodecenyl group and an octadecenyl group; an alkoxyalkyl group such as a 3-(octyloxy)propyl group and a 3-(2-ethylundecyloxy)-propyl group as described in Japanese Patent Publication No. 27563/64; an alkylaryl group such as a 4-nonylphenyl group and a 2,4-ditert-butylphenyl group; an alkylaryloxyalkyl group such as a 2,4-di-tert-pentylphenoxymethyl group, an α-(2,4-di-tertpentylphenoxy)-propyl group, and a 1-(3-pentadecylphenoxy)ethyl group; an acylamidealkyl group such as the groups described in U.S. Pat. Nos. 3,337,344 and 3,418,129, and 2-(N-butylhexadecaneamide)ethyl group; an alkoxyaryl or aryloxyaryl group such as a 4-(n-octadecyloxy)phenyl group and a 4-(4-n-dodecylphenyloxy)phenyl group; a residual group containing a long-chain aliphatic group such as an alkyl group and an alkenyl group and a water-solubilizing group such as a carboxyl group and a sulfo group (e.g., a 1-carboxymethyl-2-nonanedecenyl group and a 1-sulfoheptadecyl group); an alkyl group substituted by ester groups (e.g., a 1-ethoxycarbonylheptadecyl group, and a 2-(n-dodecyloxycarbonyl)ethyl group); an alkyl group substituted by aryl groups or heterocyclic groups (e.g., a 2-[4-(3-methoxycarbonylunicosamide)phenyl]ethyl group, and a 2-[4-(2-octadecyclsuccinimide)phenyl-]ethyl group); and an aryl group substituted by aryloxyalkoxycarbonyl groups (e.g., 4-[2-(2,4-di-tertpentylphenyloxy)-2-methylpropyloxycarbonyl]phenyl group).

Particularly preferred examples of these organic ballast groups include those bonded to linking groups represented by formulae ($B_1$) to ($B_4$):

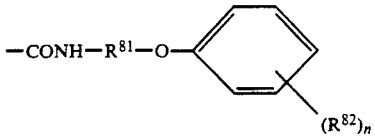

(B1)

$$-CONH-R^{81}-O-R^{83} \quad (B2)$$

$$-O-R^{84} \quad (B3)$$

$$-CONHR^{83} \quad (B4)$$

wherein $R^{81}$ represents a $C_{1-10}$, preferably $C_{1-6}$ alkylene group such as a propylene group and a butylene group; $R^{82}$ represents a hydrogen atom or a $C_{1-10}$, preferably $C_{1-6}$ alkyl group such as a tert-amyl group; n represents an integer of 1 to 5, preferably 1 or 2; $R^{83}$ represents a $C_{4-30}$, preferably $C_{10-20}$ alkyl group such as a dodecyl group, a tetradecyl group, and a hexadecyl group; and $R^{84}$ represents a $C_{8-30}$, preferably $C_{10-20}$ alkyl group such as a hexadecyl group and an octadecyl group or a substituted alkyl group containing 8 or more carbon atoms (the alkyl residual group contains 1 or more carbon atom; examples of the substituents include carbamoyl group).

Specific examples of the compound of formula (I) of the present invention will be shown hereinafter, but the present invention should not be construed as being limited thereto. In the following formulae, Ph represents a phenyl group.

(1)

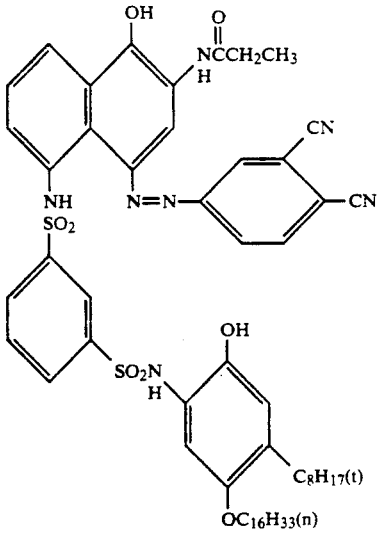

(2)

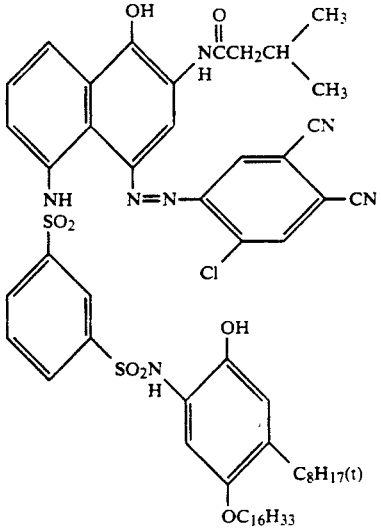

-continued
(3)
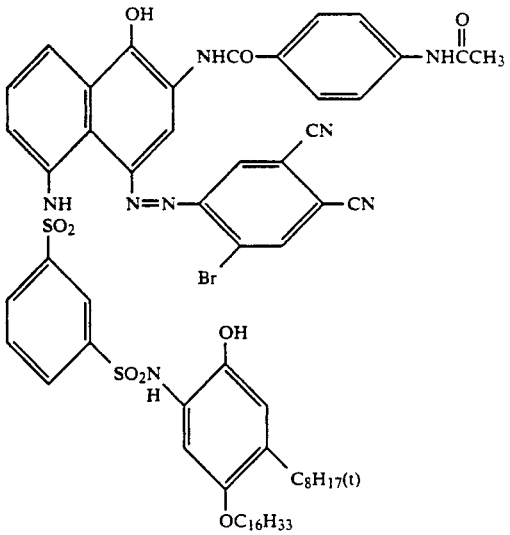
(4)
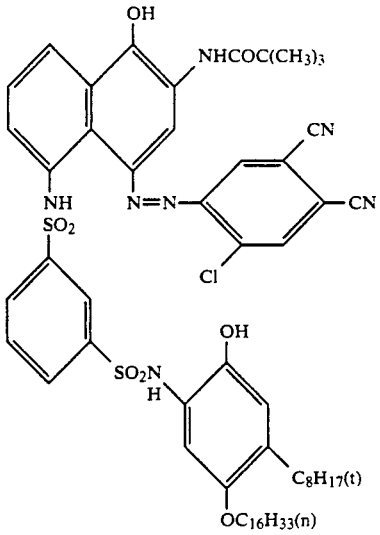
(5)
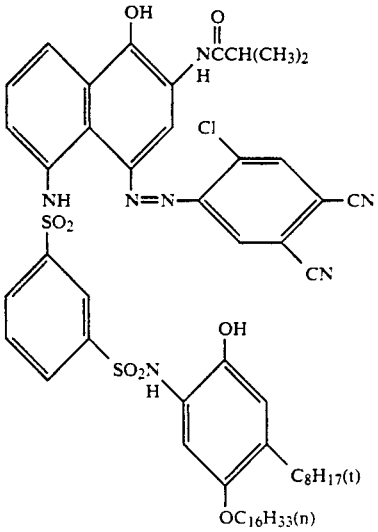
(6)
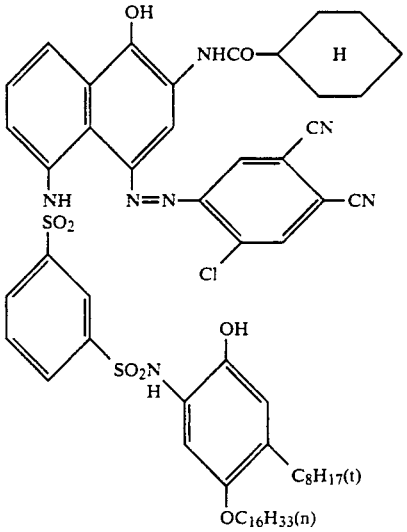
(7)
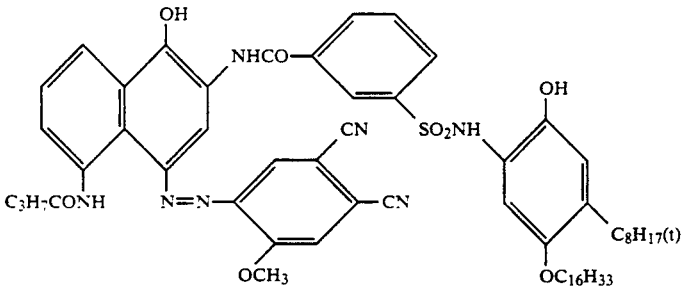
(8)
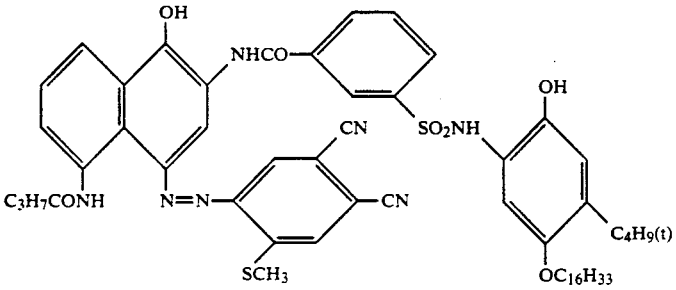

-continued
(9)
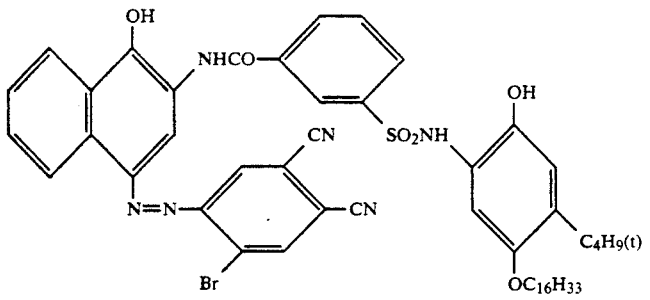
(10)
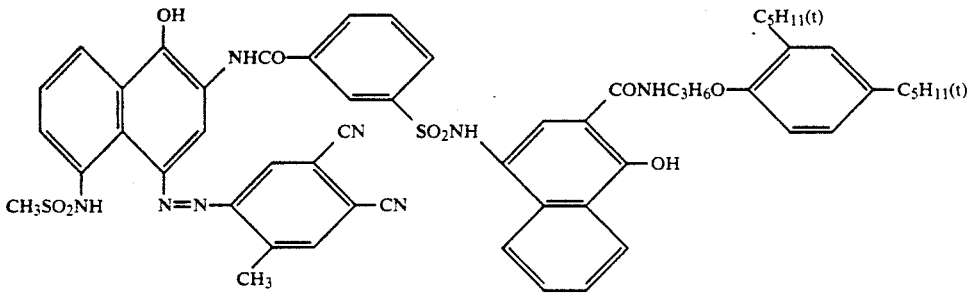
(11)
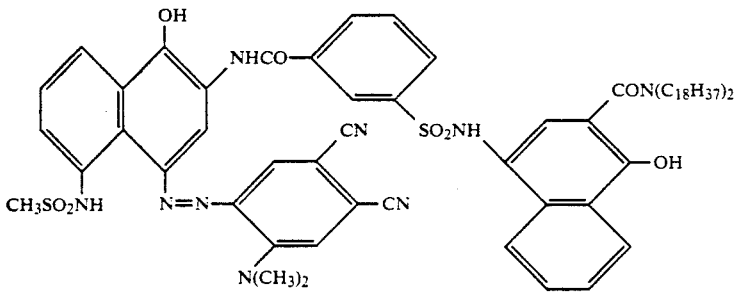
(12)
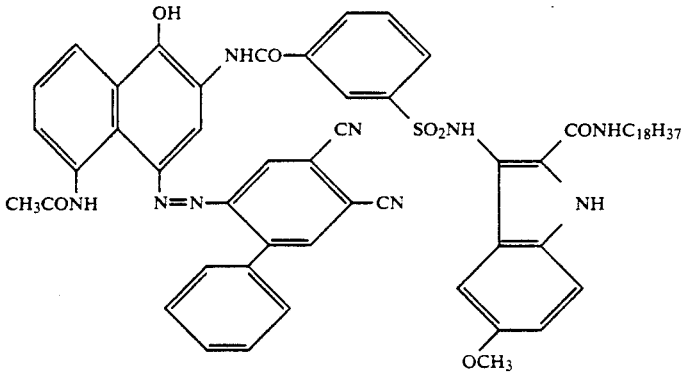
(13)
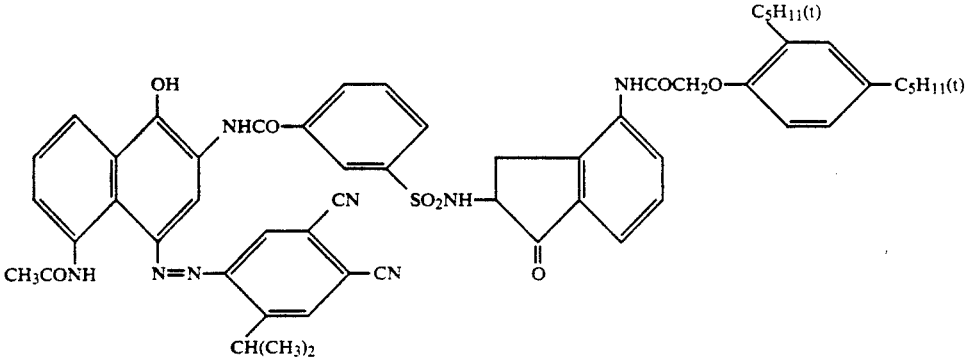

-continued
(14)
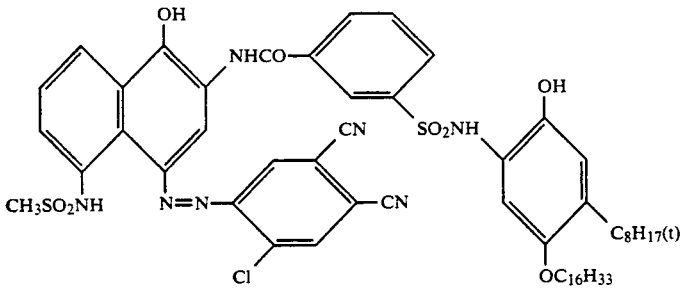
(15)
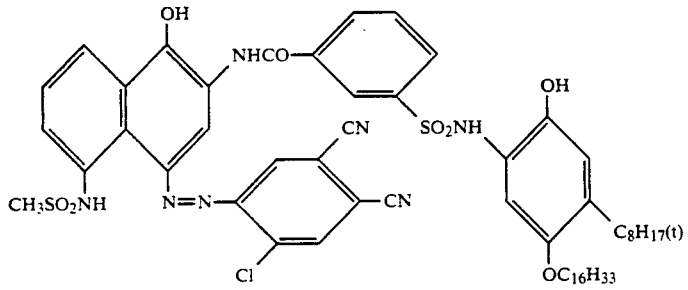
(16)
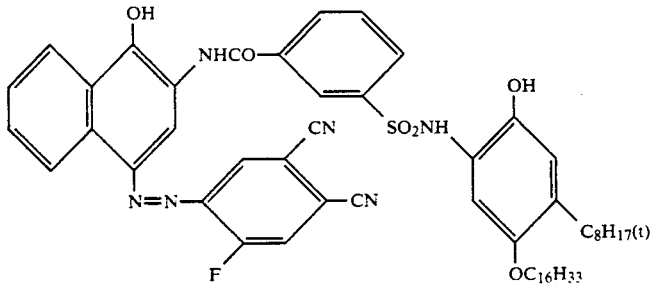
(17)
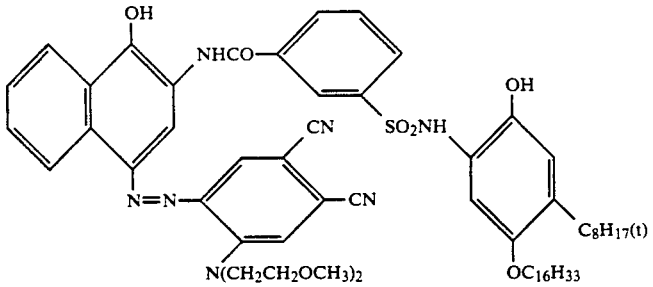
(18)
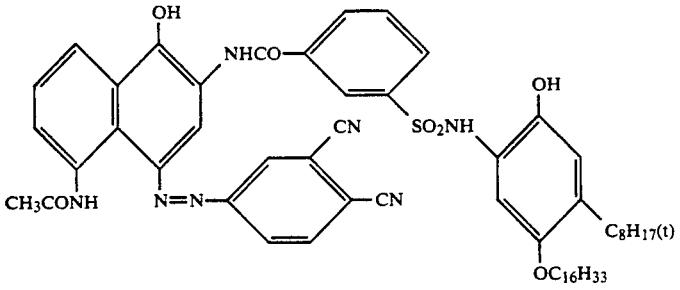

-continued
(19)
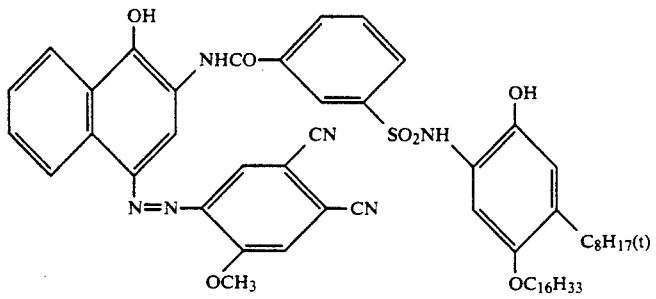
(20)
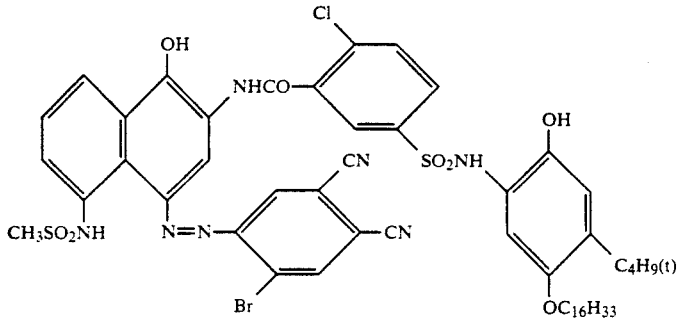
(21)
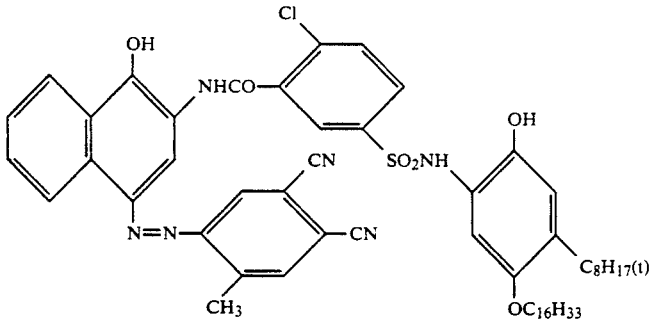
(22)
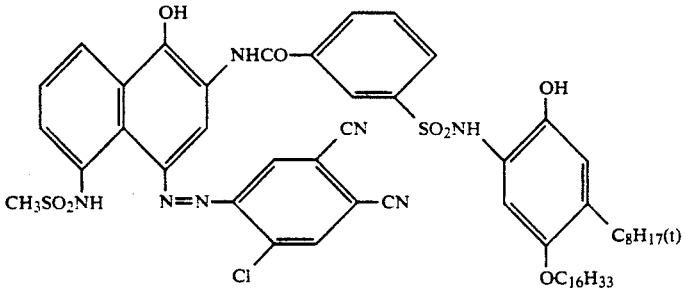

-continued
(23)
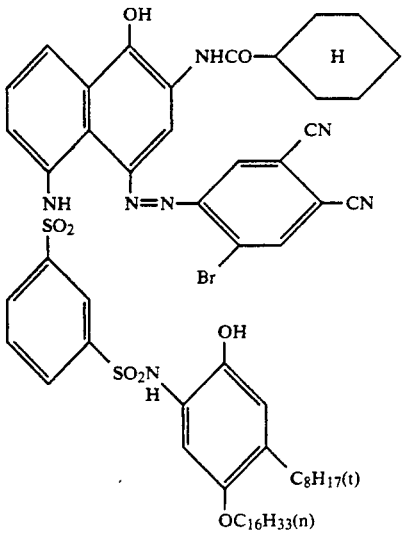
(24)
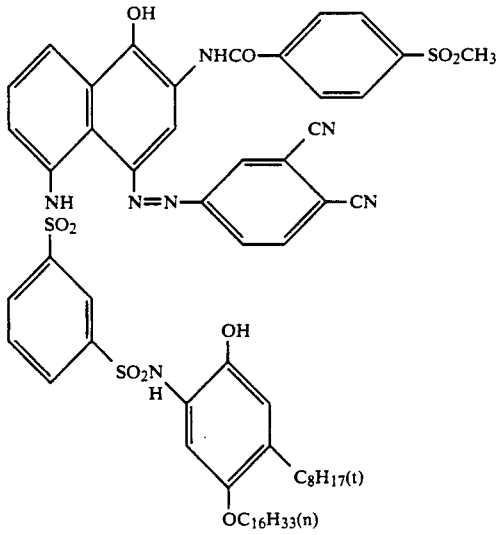
(25)
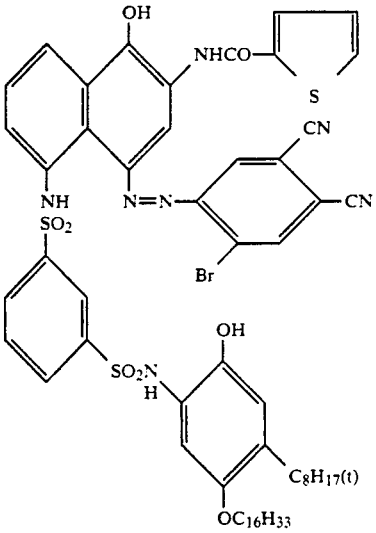
(26)
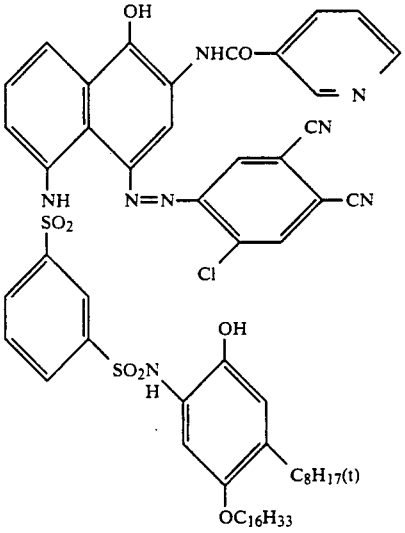
(27)
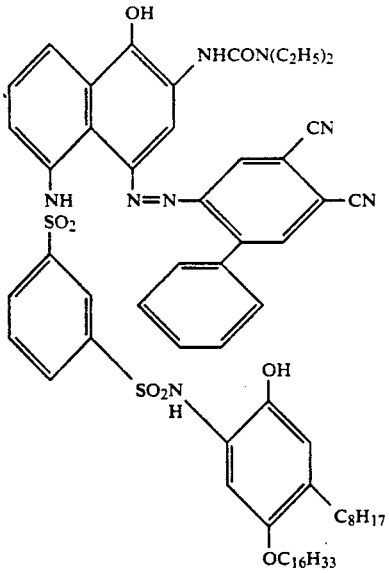
(28)
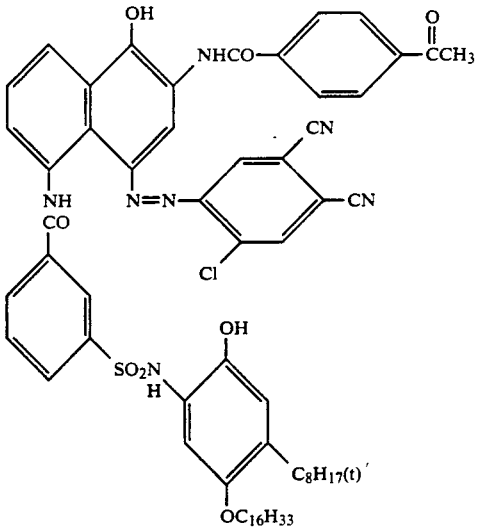

-continued
(29)
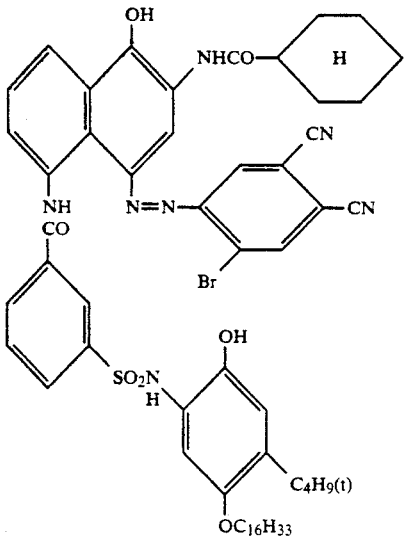
(30)
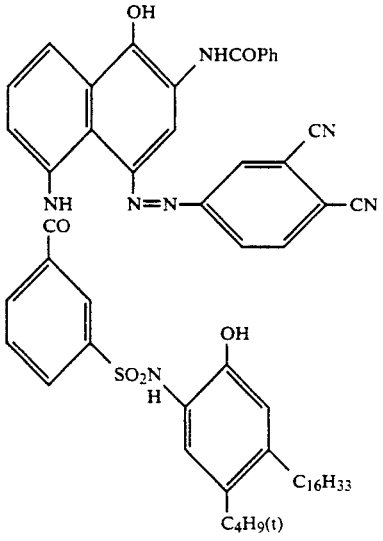
(31)
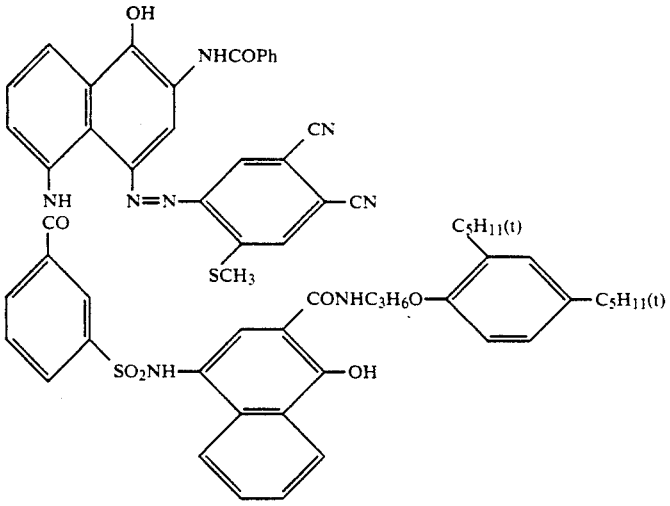
(32)
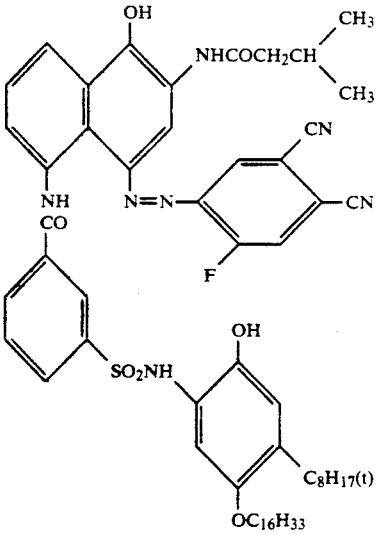
(33)
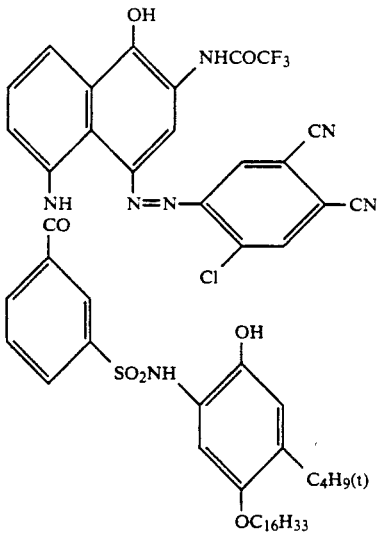

-continued
(34)
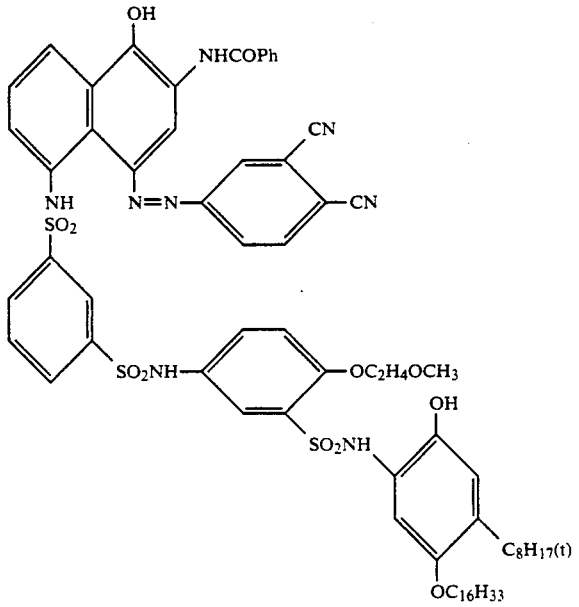
(35)
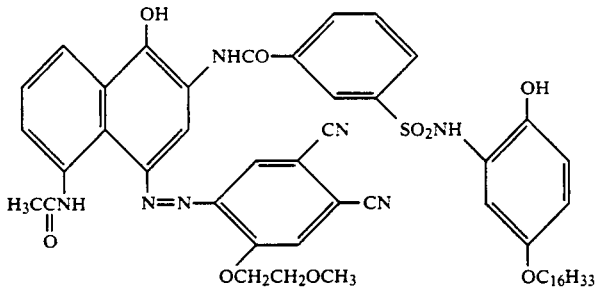
(36)
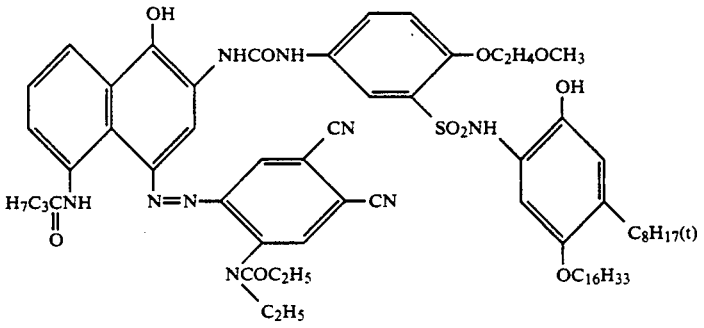

-continued
(37)
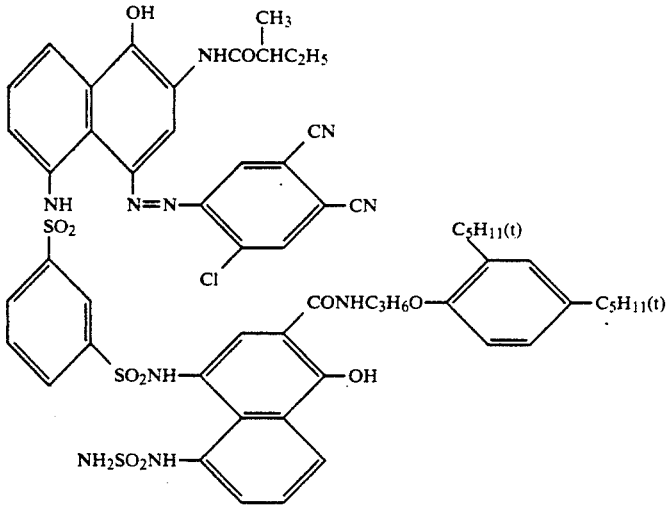
(38)
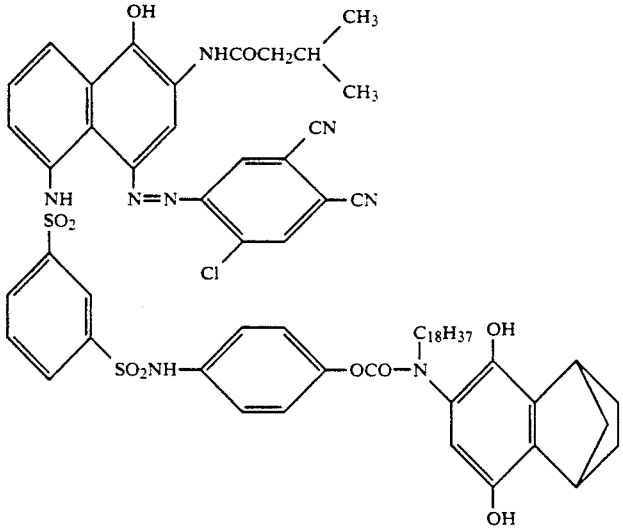
(39)
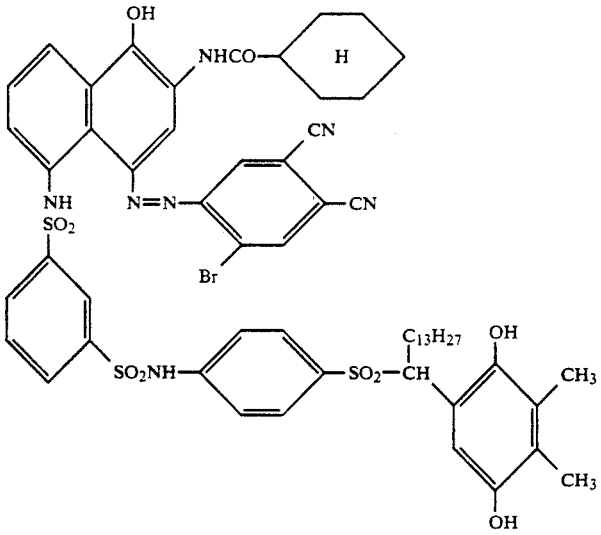

-continued
(40)
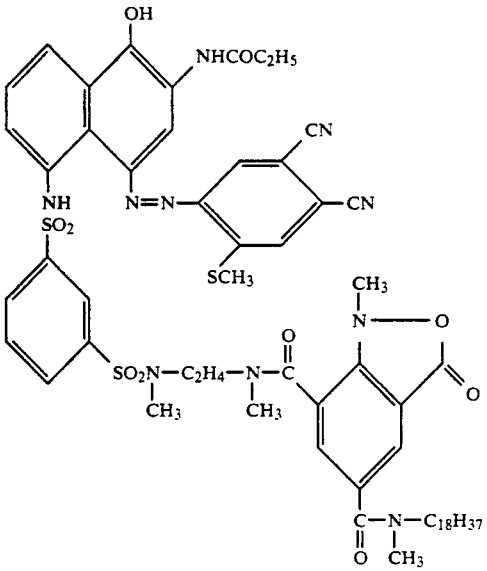
(41)
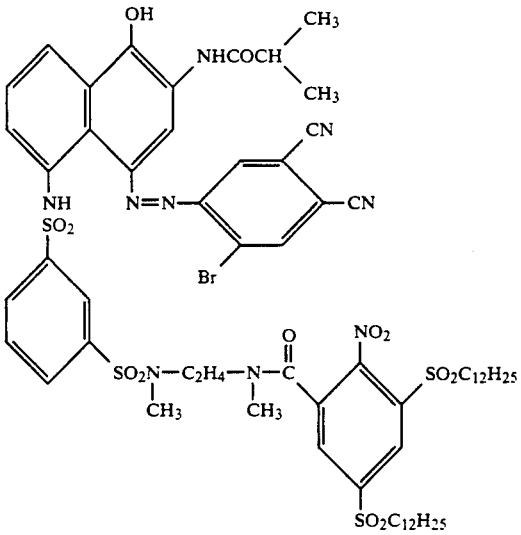
(42)
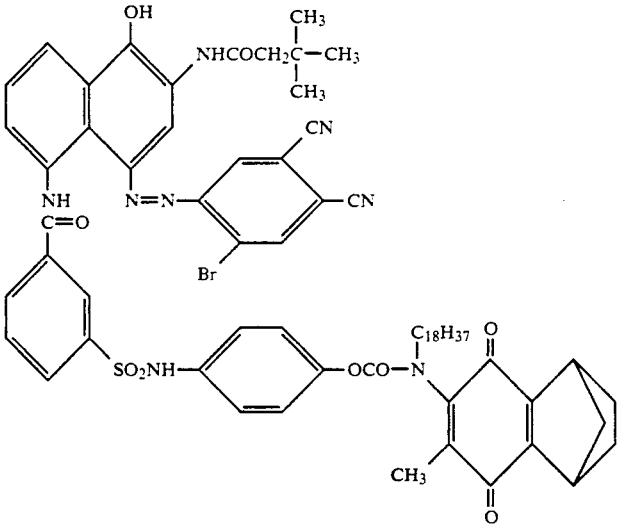
(43)
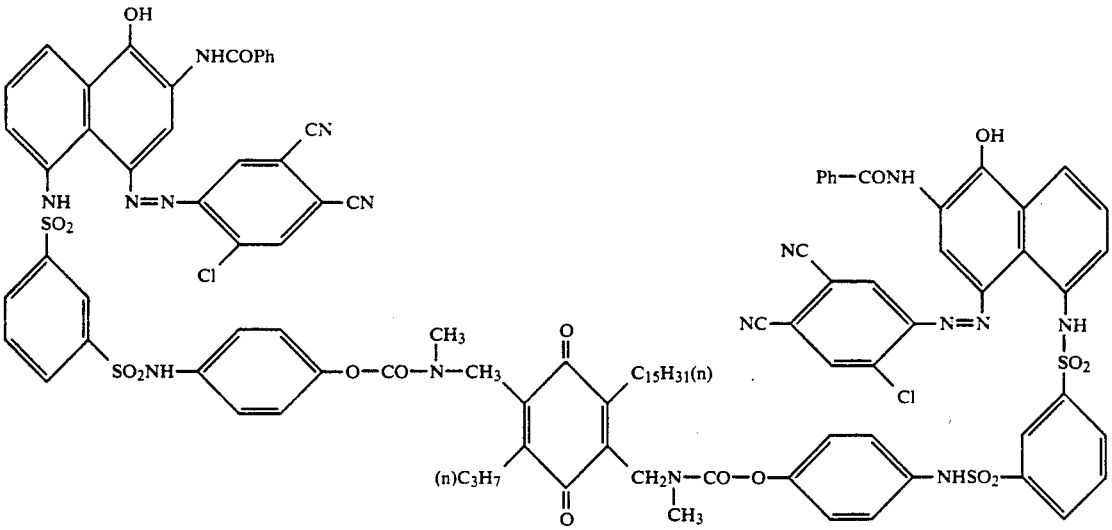

-continued
(44)
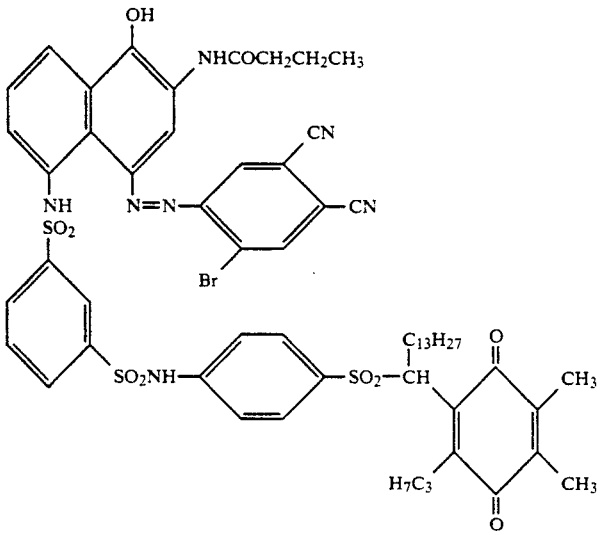
(45)
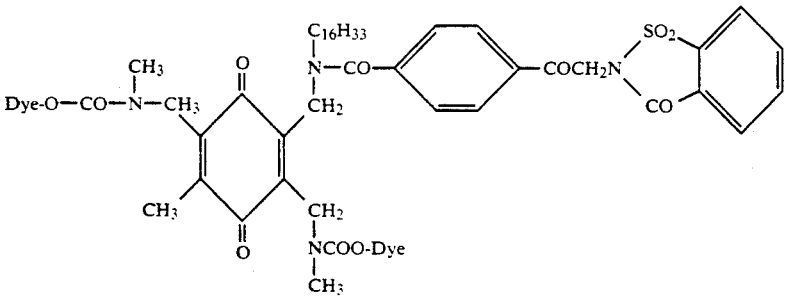
wherein Dye =
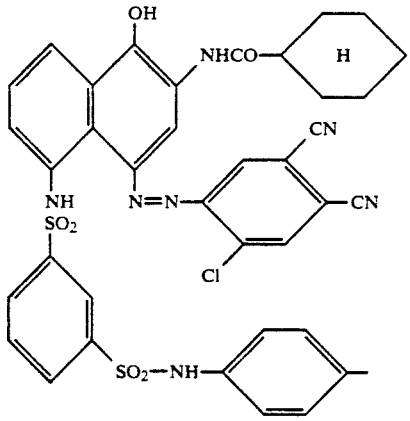

-continued
(46)
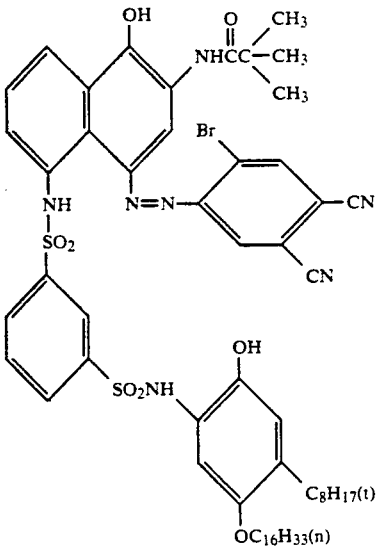
(47)
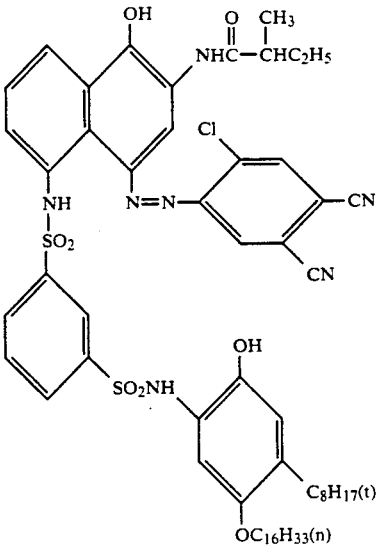
(48)
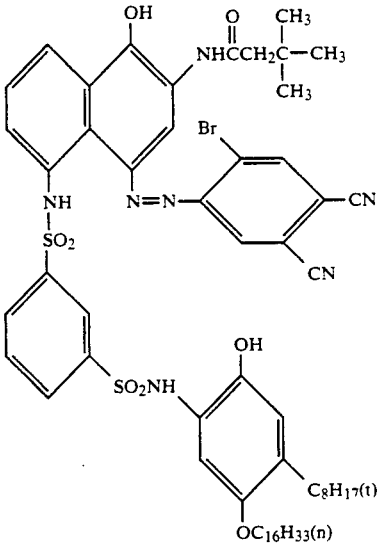
(49)
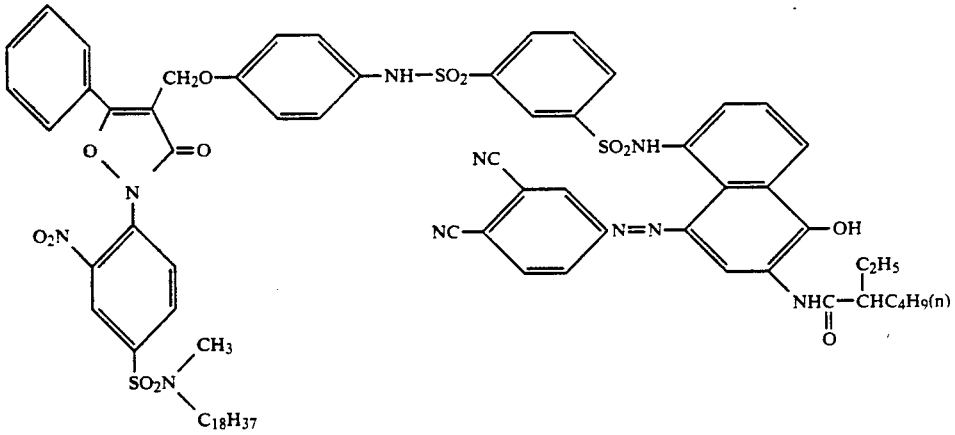

-continued
(50)
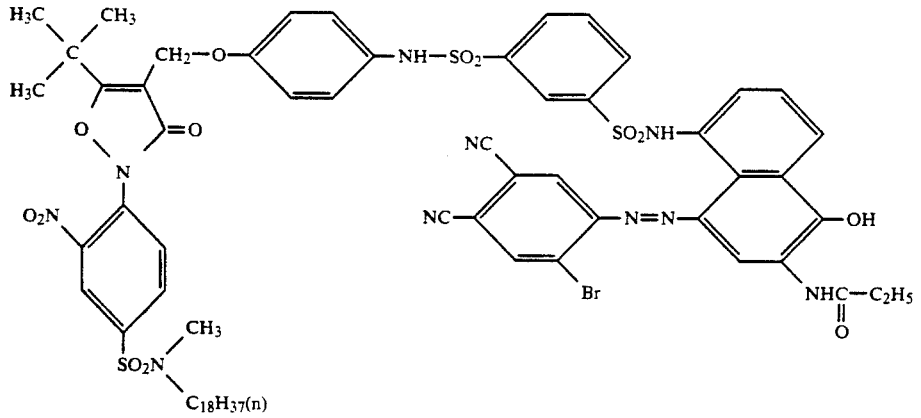
(51)
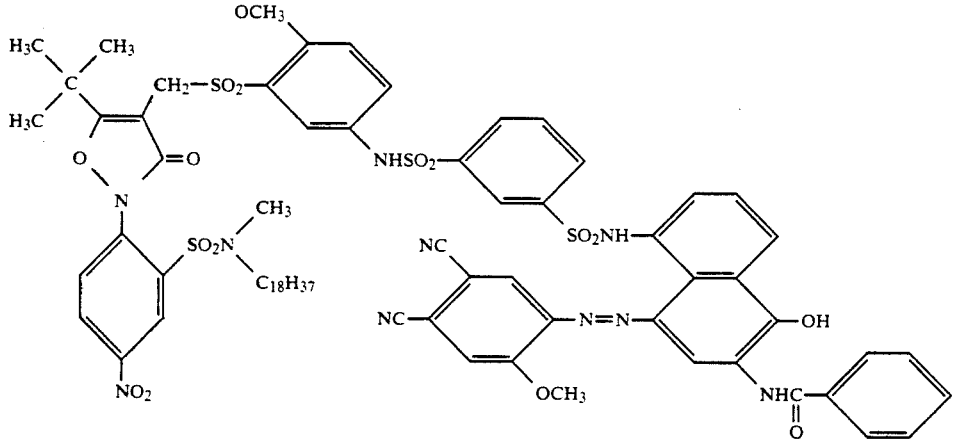
(52)
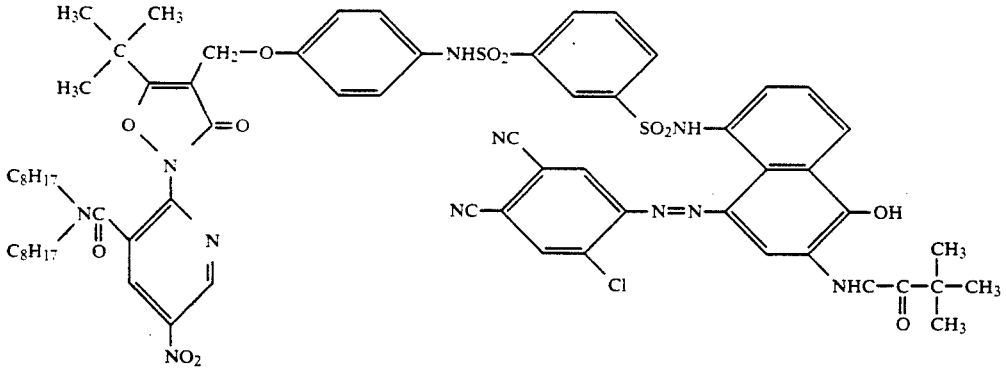
(53)
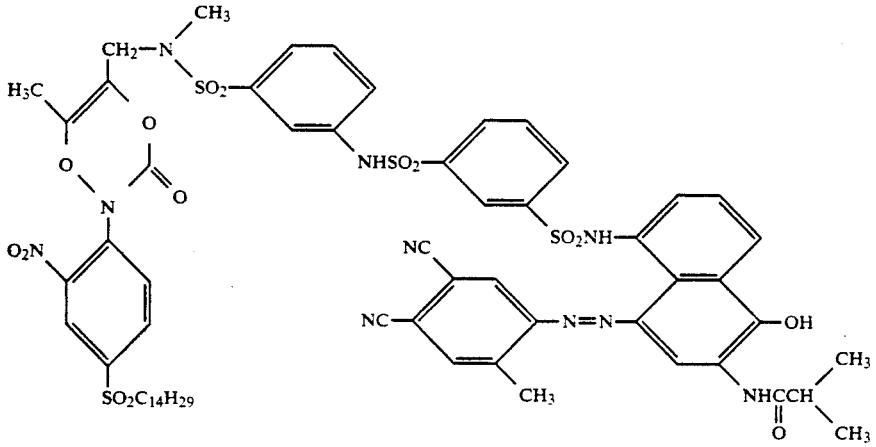

-continued
(54)
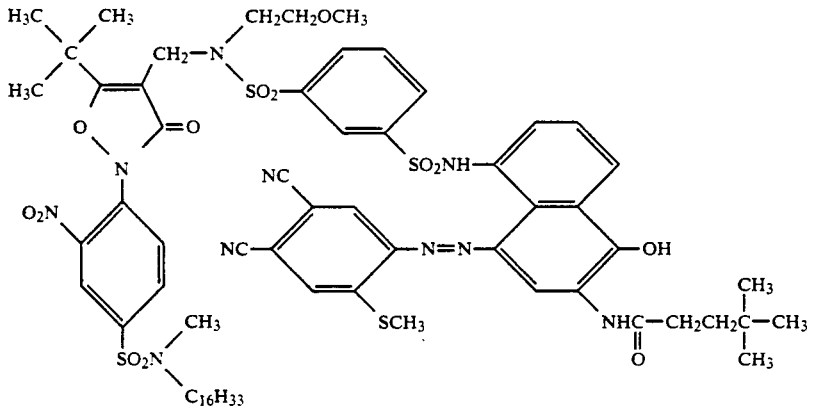
(55)
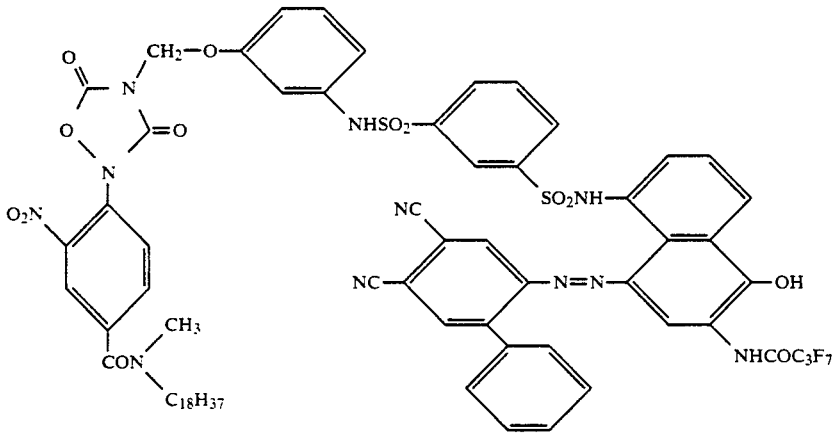
(56)
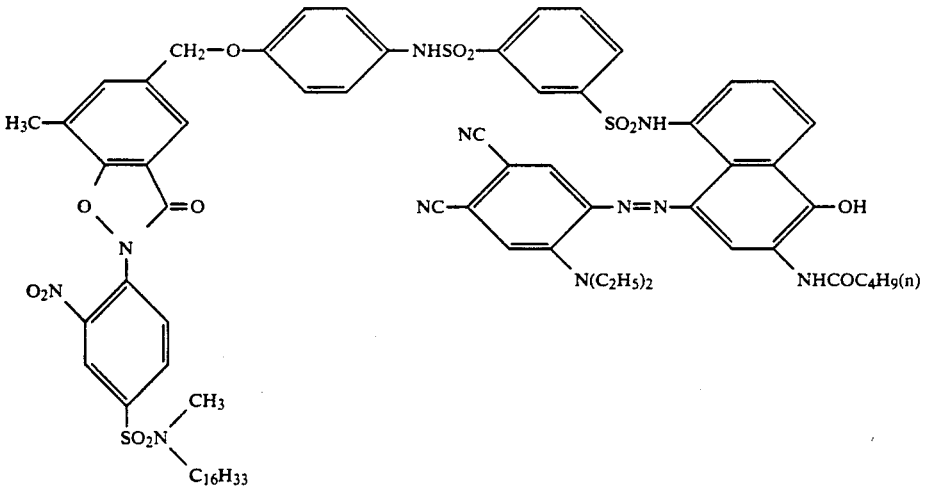

-continued
(57)
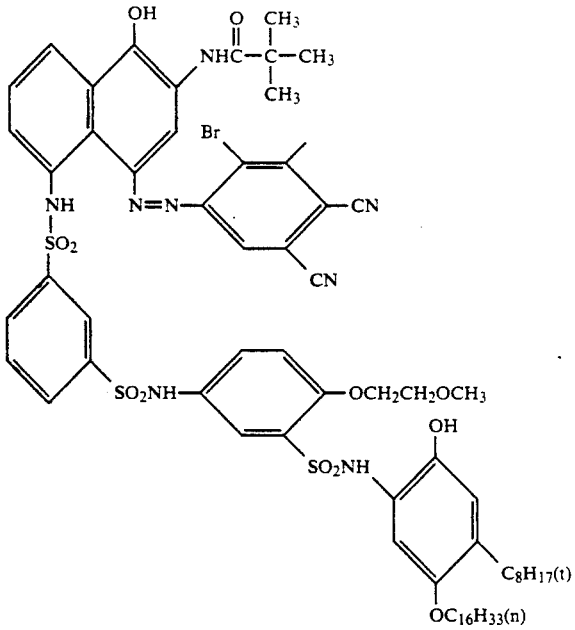
(58)
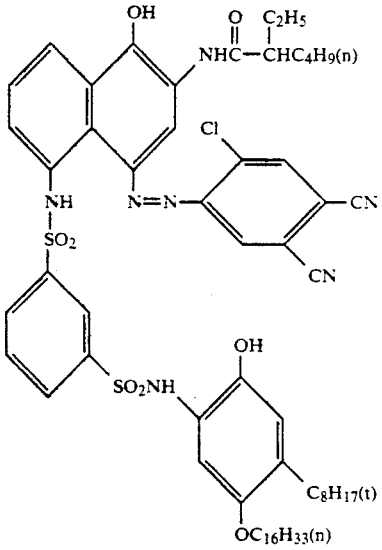
(59)
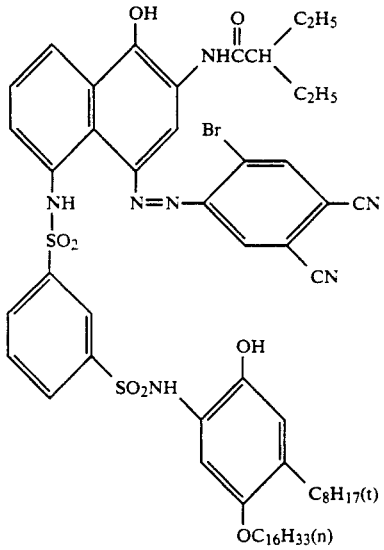
(60)
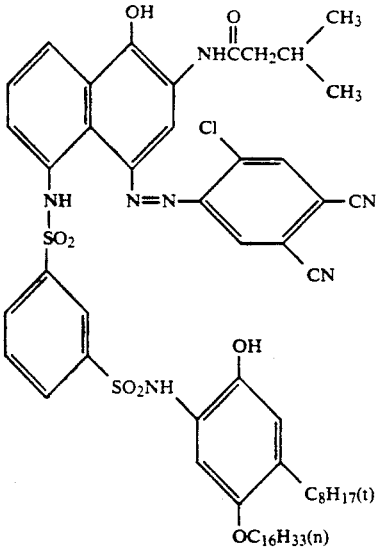
(61)
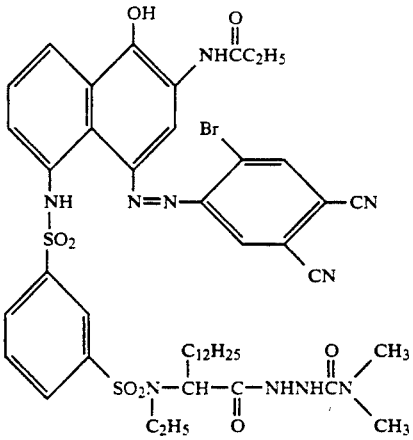

-continued
(62)
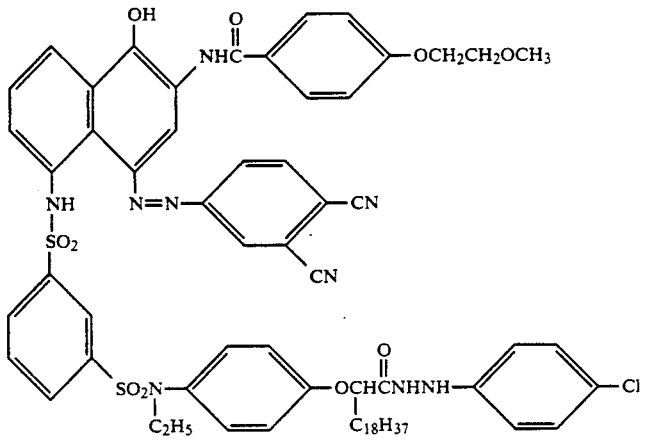
(63)
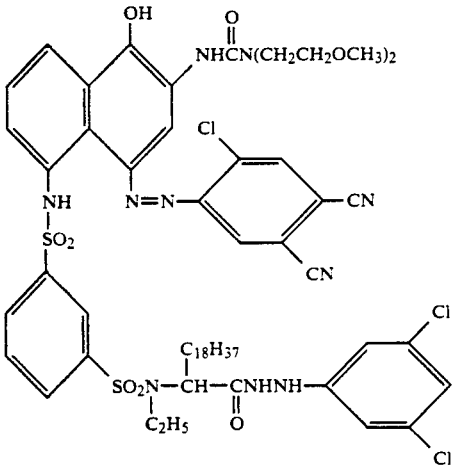
(64)
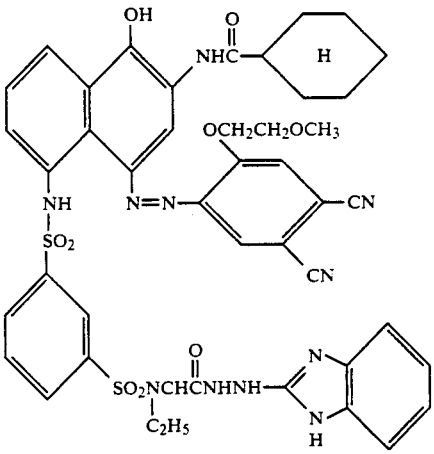
(65)
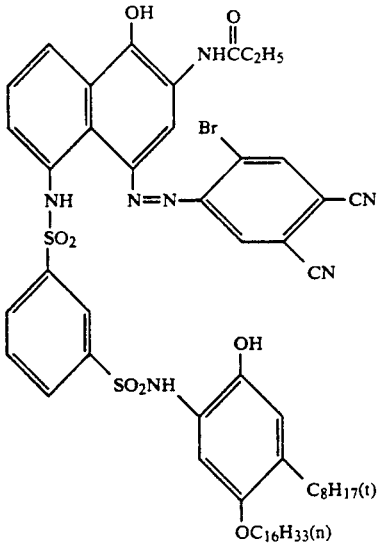
(66)
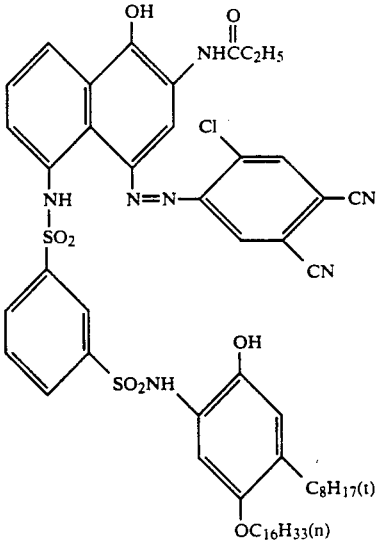

-continued
(67)
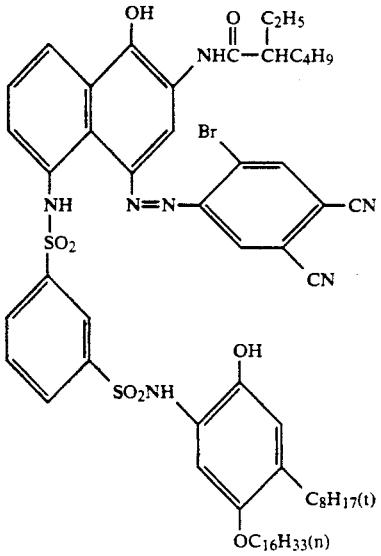
(68)
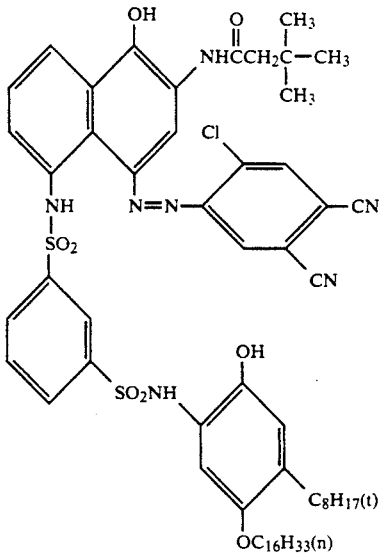
(69)
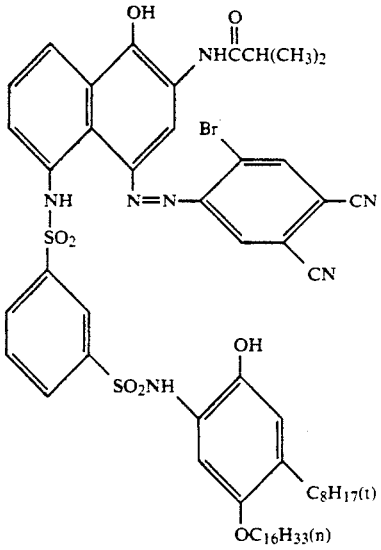
(70)
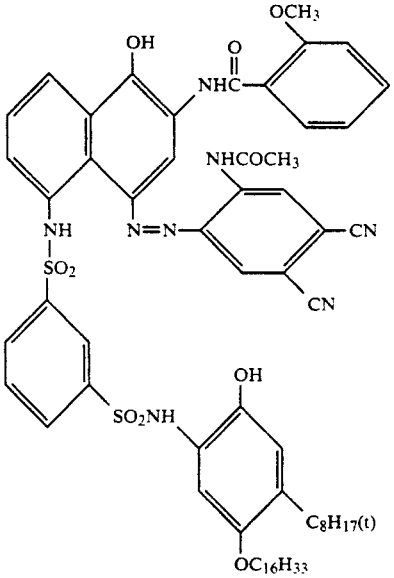
(71)
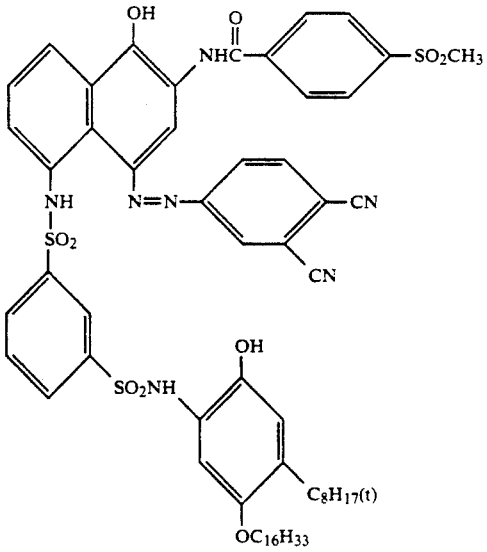

-continued
(72)
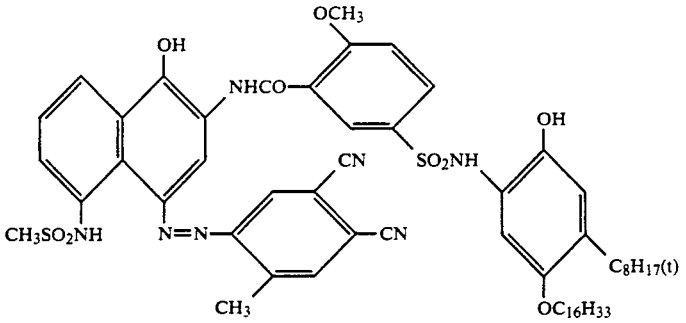
(73)
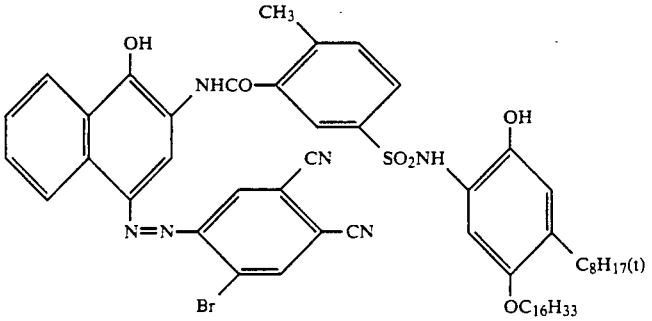
(74)
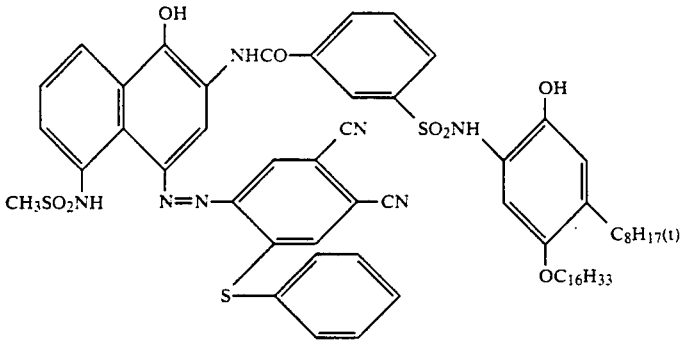
(75)
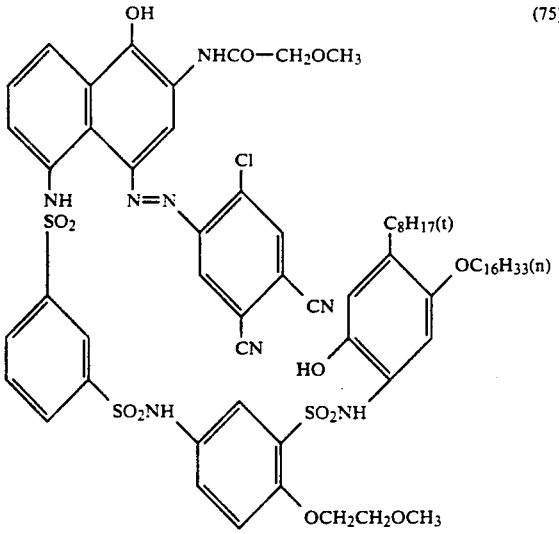
(76)
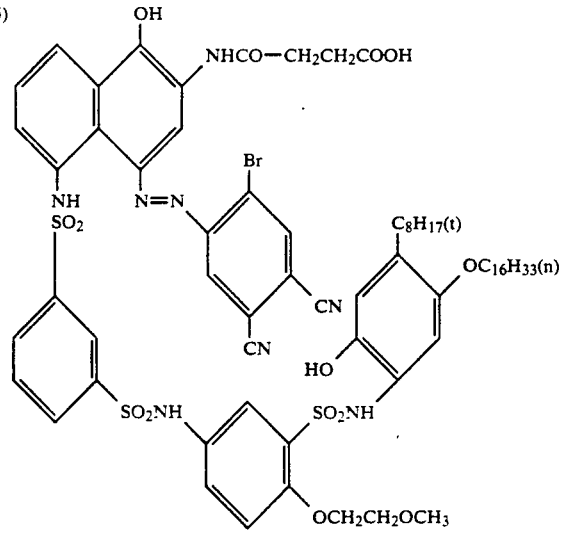

-continued
(77)
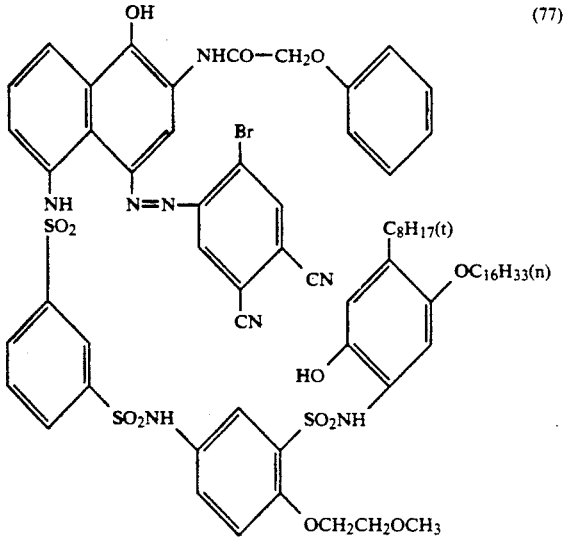
(78)
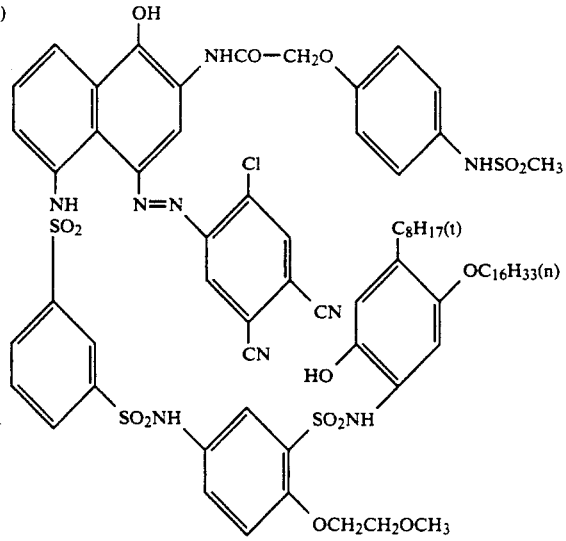
(79)
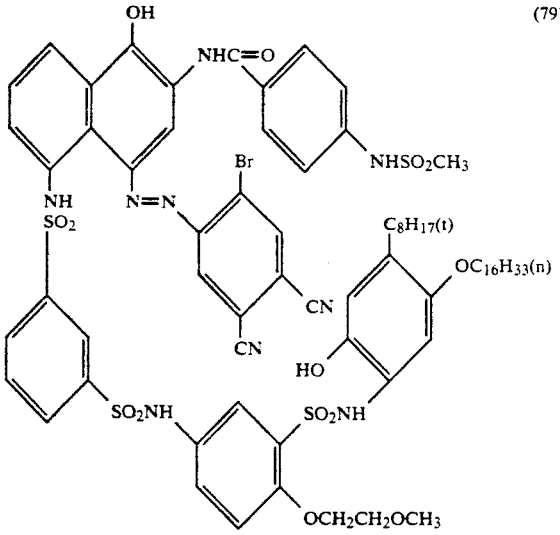
(80)
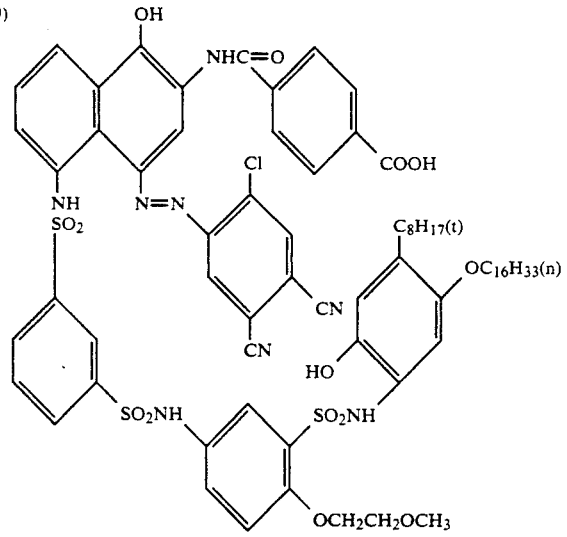
(81)
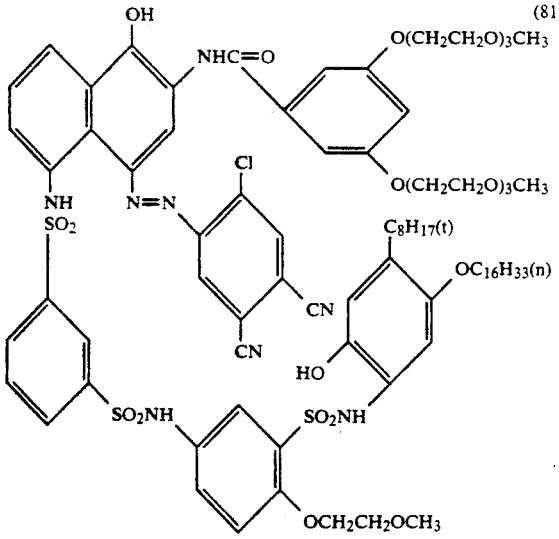
(82)
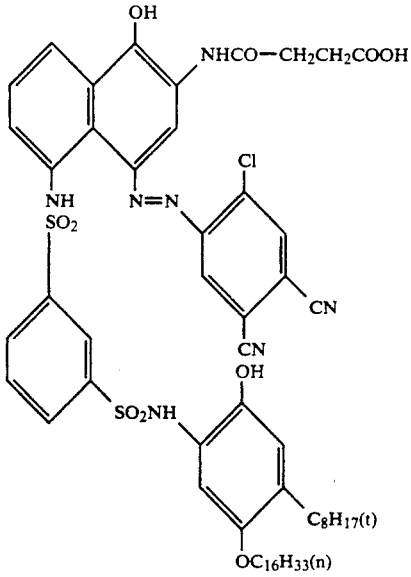

-continued
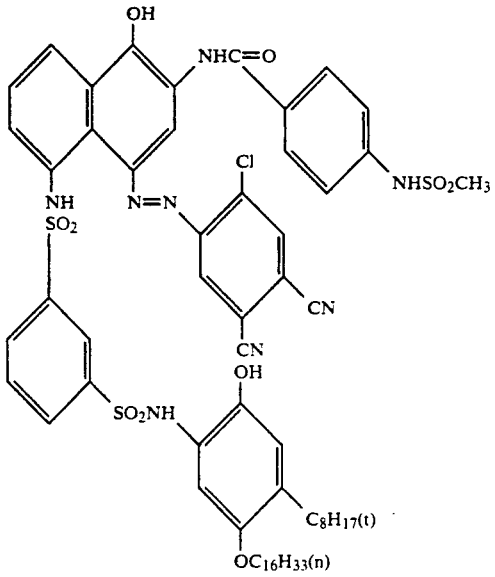
(83)
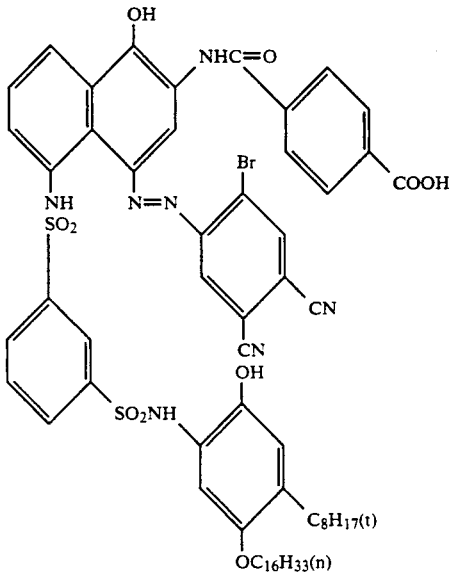
(84)
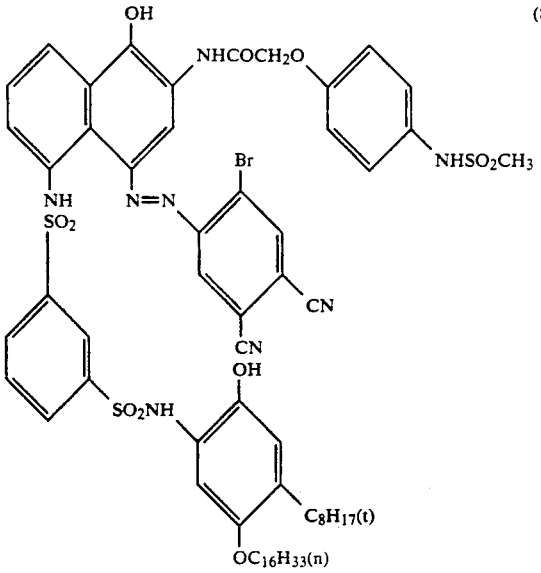
(85)
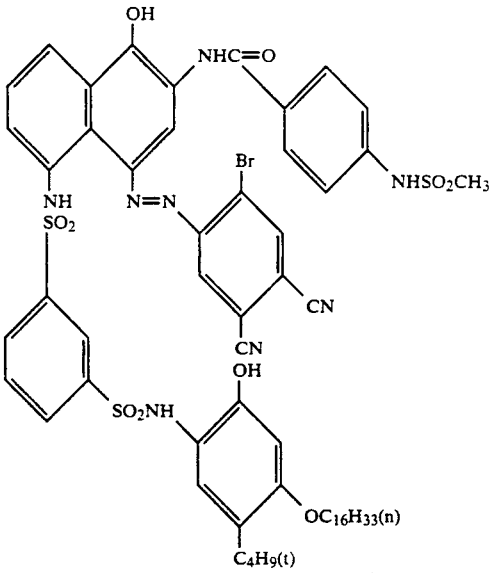
(86)

-continued (87)

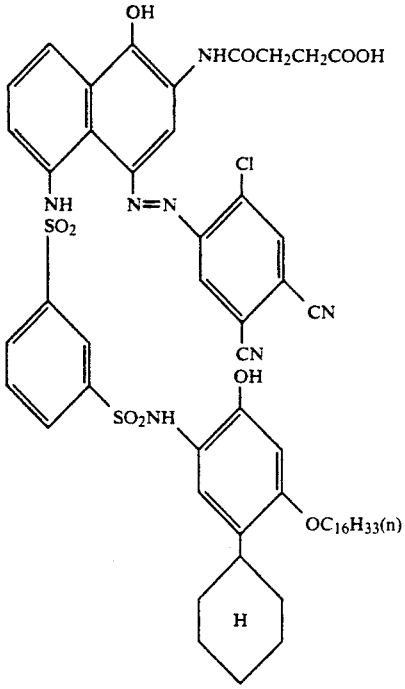

(88)

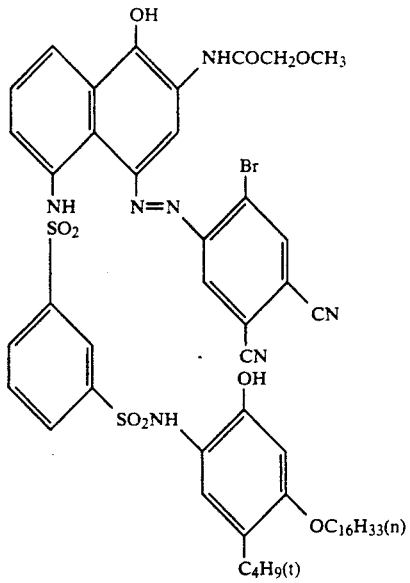

Specific examples of the synthesis of the compounds of the present invention will be described hereinafter. All the compounds of formula (I) can be prepared easily in accordance with the following Synthesis Examples.

Synthesis Example: Synthesis of Compound (1)

Compound (1) was prepared in the following synthesis process:

Process of synthesis of Compound (1)

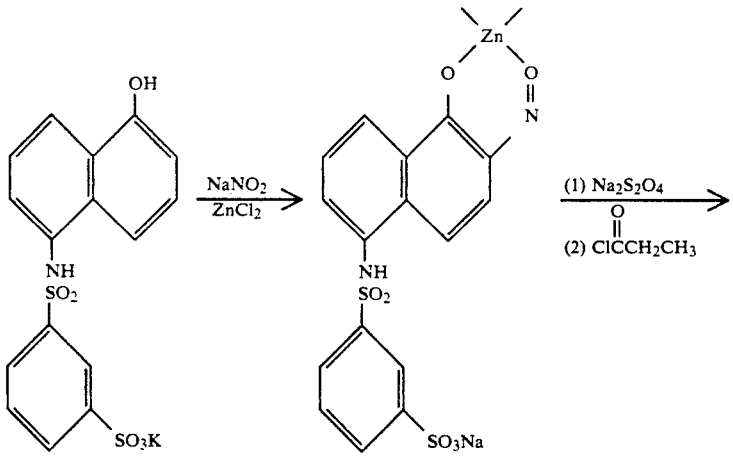

(a)

-continued
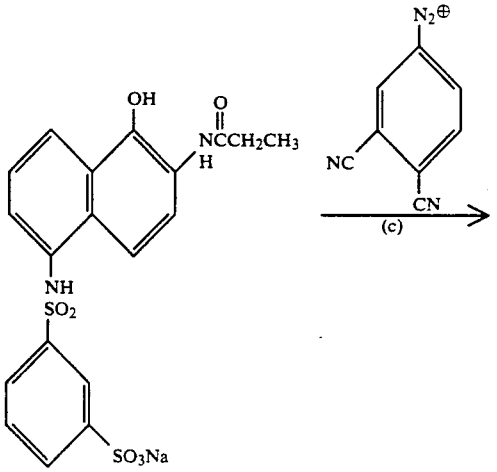
(b)
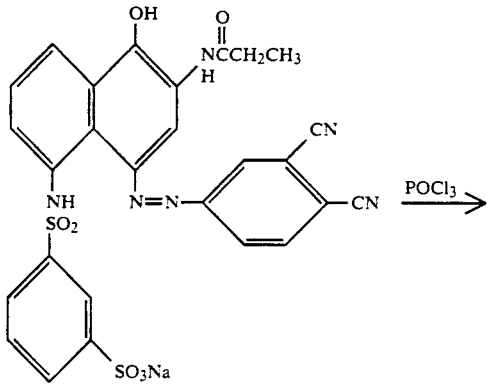
(d)
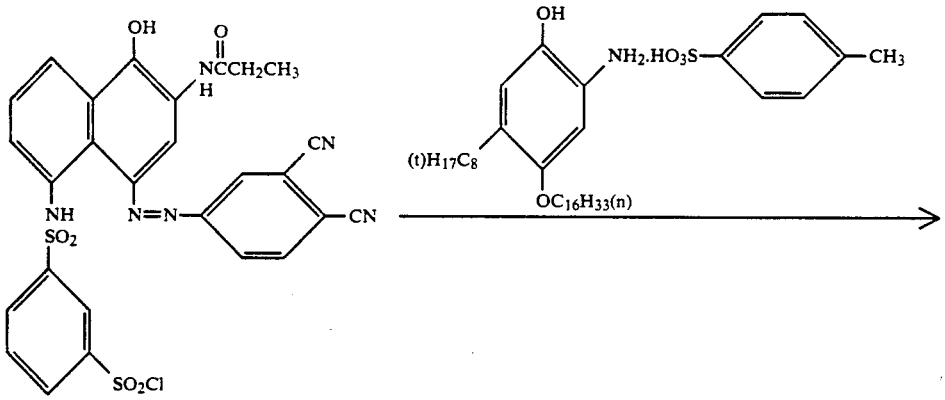
(e)

-continued
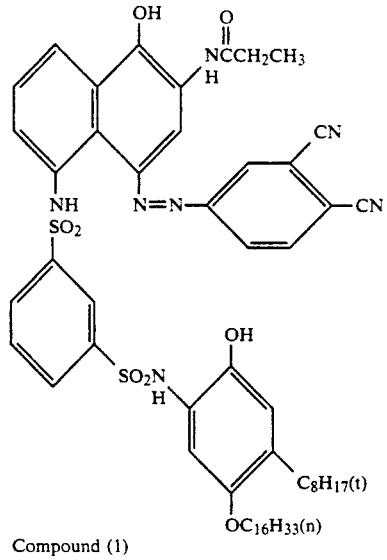
Compound (1)
Synthesis of Intermediates (c) and (f)
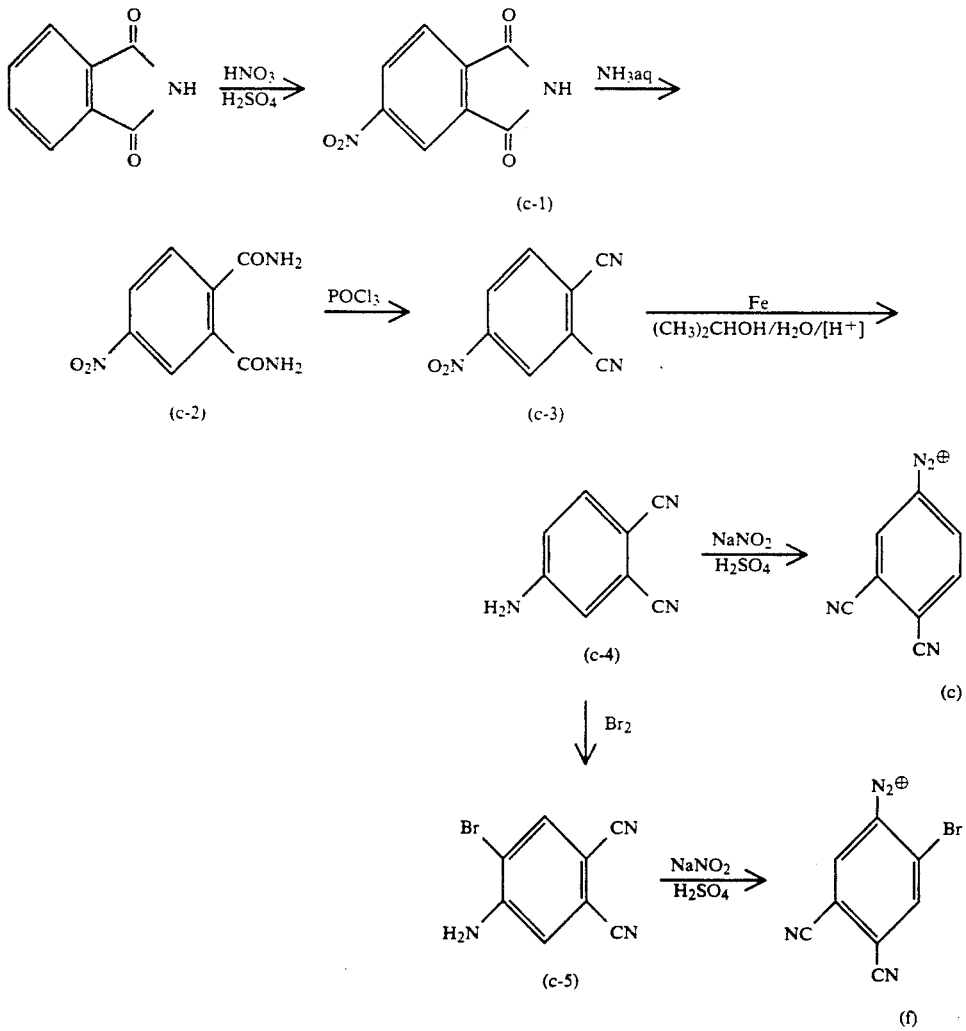
Synthesis of Intermediate (a)
A mixture of 209 g of the potassium salt of 5-(3-sulfophenylsulfonylamino)-1-naphthol, 136 g of zinc chloride, 500 ml of ethanol, and 100 ml of water was heated to a temperature of 50° C. with stirring. A solution in which 39 g of sodium nitrite was dissolved in 100 ml of water was dropwise added to the solution at a temperature of 50° to 60° C. After being heated at a temperature of 60° C. for 3 hours, the admixture was allowed to cool to room temperature. The resulting reddish brown crystal was filtered off, washed with ethanol, and dried to obtain Intermediate (a).

Synthesis of Intermediate (b)

A mixture of 11.6 g of the reddish brown crystal of Intermediate (a), 19 g of sodium hydrosulfite, 200 ml of water, and 200 ml of acetonitrile was heated to a temperature of 60° C. in an atmosphere of nitrogen with stirring for 30 minutes. After being cooled to a temperature of 20° C., 3.3 g of propionyl chloride was added to the solution at a temperature of 15° to 20° C. After being stirred for 30 minutes, the solution was further heated to a temperature of 60° C. for 30 minutes. 3.3 g of sodium hydrogencarbonate was added to the solution. 500 ml of saturated brine was added to the admixture. The admixture was stirred at a temperature of 10° C. for 2 hours. The resulting light brown crystal was filtered off, washed with saturated brine, and dried to obtain Intermediate (b). (Yield: 7.5 g)

Synthesis of Intermediate (c)

Intermediate (c) was prepared in accordance with the following synthesis process which also shows the preparation of an Intermediate (f) which is used in the synthesis of Compound (50) described hereafter.

Synthesis of Intermediate (c-1)

Intermediate (c-1) was prepared from 400 g of phthalimide, 2.8 l of concentrated sulfuric acid, and 474 ml of 94% nitric acid in accordance with the process described in Organic Synthesis (voll. vol. II, page 459). The resulting crystal was filtered off, and washed.

The crystal thus obtained was used undried as Intermediate (c-1) in the next process.

Synthesis of Intermediate (c-2)

1 l of concentrated ammonia water was added to a suspension of Intermediate (c-1) in 1 l of acetonitrile with stirring at room temperature. The reaction admixture was allowed to undergo reaction for 2 hours.

The resulting crystal was filtered off, washed with water, and thoroughly dried to obtain Intermediate (c-2). (Yield: 341 g (60%) from phthalimide)

Synthesis of Intermediate (c-3)

475 ml of phosphorous oxychloride was dropwise added to a suspension of 340 g of Intermediate (c-2) in 1 l of N-dimethylformamide with stirring at a temperature of 10° C. or below. After the dropwise addition was finished, the admixture was stirred at a temperature of 10° C. or below for 1 hour and at room temperature for 3 hours. The reaction solution was poured into 6 l of ice water with stirring. After the admixture was stirred at a temperature of 10° C. or below for 1 hour, the resulting crystal was filtered off, washed with water, and dried to obtain Intermediate (C-3). (Yield: 264 g (94%))

Synthesis of Intermediate (c-4)

A suspension of 300 g of reduced iron, 1 l of isopropanol, 10 g of ammonium chloride, and 200 ml of water was heated under reflux with stirring. 260 g of Intermediate (c-3) was batchwise added to the suspension. After the addition was finished, the reaction mixture was allowed to undergo reaction for 1 hour. The reaction solution was hot filtered through Celite (tradename of Johns Manville Sales Corp.), and washed with 1 l of isopropyl alcohol. The filtrate was poured into 6 l of 60° C. water with stirring. After being stirred for 30 minutes, the admixture was cooled to a temperature of 10° C. or below. The admixture was further stirred for 1 hour. The resulting crystal was filtered off, and washed with water. After being thoroughly dried, the crystal was recrystallized from 500 ml of ethyl acetate to obtain Intermediate (c-4). (Yield: 113 g (53%))

Synthesis of Intermediate (c)

A diazonium salt of Intermediate (c) (=3,4-dicyanoaniline) was prepared from Intermediate (c-4) in accordance with the process described hereinafter. 3.2 g of sodium nitrite was added to 21.3 ml of concentrated sulfuric acid with stirring under cooling with ice. The reaction mixture was allowed to undergo reaction at a temperature of 70° C. for 30 minutes. The reaction solution was cooled with ice. 30 ml of acetic acid and 13 ml of propionic acid were added to the reaction solution while the internal temperature was maintained at 10° C. or below. 5.5 g of Intermediate (c-4) was gradually added to the reaction solution in such a manner that the internal temperature was maintained at not above 5° C. The reaction solution was allowed to undergo reaction at a temperature of 5° C. or below for 3 hours. 1 g of sulfaminic acid was added to the reaction solution to decompose excess sulfurous acid to form a diazo solution of Intermediate (c).

Synthesis of Intermediate (d)

A solution of 20.8 g of Intermediate (b) and 142 ml of methyl cellosolve in 142 ml of water was stirred under cooling with ice. The diazo solution of Intermediate (c) previously obtained was gradually added to the solution containing Intermediate (b) in such a manner that the internal temperature was maintained at 5° C. or below. After the reaction solution was allowed to undergo reaction at a temperature of 5° C. or below for 1 hour, the reaction solution was added to 1 l of saturated brine. The reaction mixture was heated to a temperature of 40° to 50° C. for 1 hour. The resulting crystal was filtered off, and washed with saturated brine. After being thoroughly dried, the crystal was used as Intermediate (d) for the next process. (Yield: 25.3 g)

Synthesis of Intermediate (e)

25 ml of phosphorous oxychloride was dropwise added to a suspension containing 25 g of Intermediate (d), 12 ml of N,N-dimethylacetamide, and 125 ml of acetonitrile with stirring. After being allowed to undergo reaction at a temperature of 60° C. for 3 hours, the reaction solution was cooled with ice to room temperature. The reaction solution was poured into 1,000 ml of ice water. The reaction solution was stirred at a temperature of 10° C. or below for 1 hour. The resulting crystal was filtered off, washed with water, and air-dried to obtain Intermediate (e). (Yield: 16 g).

Synthesis of Compound (1)

A suspension containing 22.4 g of 2-amino-4-hexadecyloxy-5-t-octylphenol p-toluenesulfonate, 112 ml of N,N-dimethylacetamide, and 13.8 ml of α-picoline was maintained at a temperature of 5° C. or below with stirring in a stream of nitrogen. 20 g of Intermediate (e) was gradually added to the suspension. The suspension was heated to a temperature of 70° C. for 1 hour and then stirred for 2 hours. 160 ml of acetone and 146 ml of methanol were added to the reaction solution. 100 ml of water was then dropwise added to the reaction solution at a temperature of 50° to 60° C. Upon cooling with water 1 hour later, an oily matter was deposited.

The reaction solution was further stirred for 2 hours. As a result, crystallization took place. The resulting crystal was filtered off, and washed thoroughly with 200 ml of methanol. The crystal thus obtained was hot-dissolved in a mixed solvent for 30 ml of acetonitrile, 150 ml of ethanol, and 50 ml of chloroform. The solution was subjected to filtering through a filter paper. The filtrate was cooled to room temperature. 30 ml of acetic acid was poured into the filtrate with stirring. After 3 hours passed, the resulting crystal was filtered off, washed with 100 ml of acetonitrile, and recrystallized from a mixed solvent of 400 ml of ethanol, 100 ml of acetonitrile, and 500 ml of n-hexane to obtain Compound (1). (Yield: 15 g (45%); m.p. 216°-217° C.; $\lambda_{max}^{DMF}$: 626.6 nm; $\epsilon_{max}^{DMF}$: $9.7\times10^{-4}$)

Synthesis Example 2: Synthesis of Compound (50)

Compound (50) was prepared in the following process in which Intermediate (l) and (p) are prepared and then reacted to form Compound (50). In the preparation of Intermediate (p), Intermediate (f) is used. Intermediate (f) is prepared from Intermediate (c-5), which is prepared from Intermediate (c-4) whose preparation was shown above.

Process of Synthesis of Compound (50)

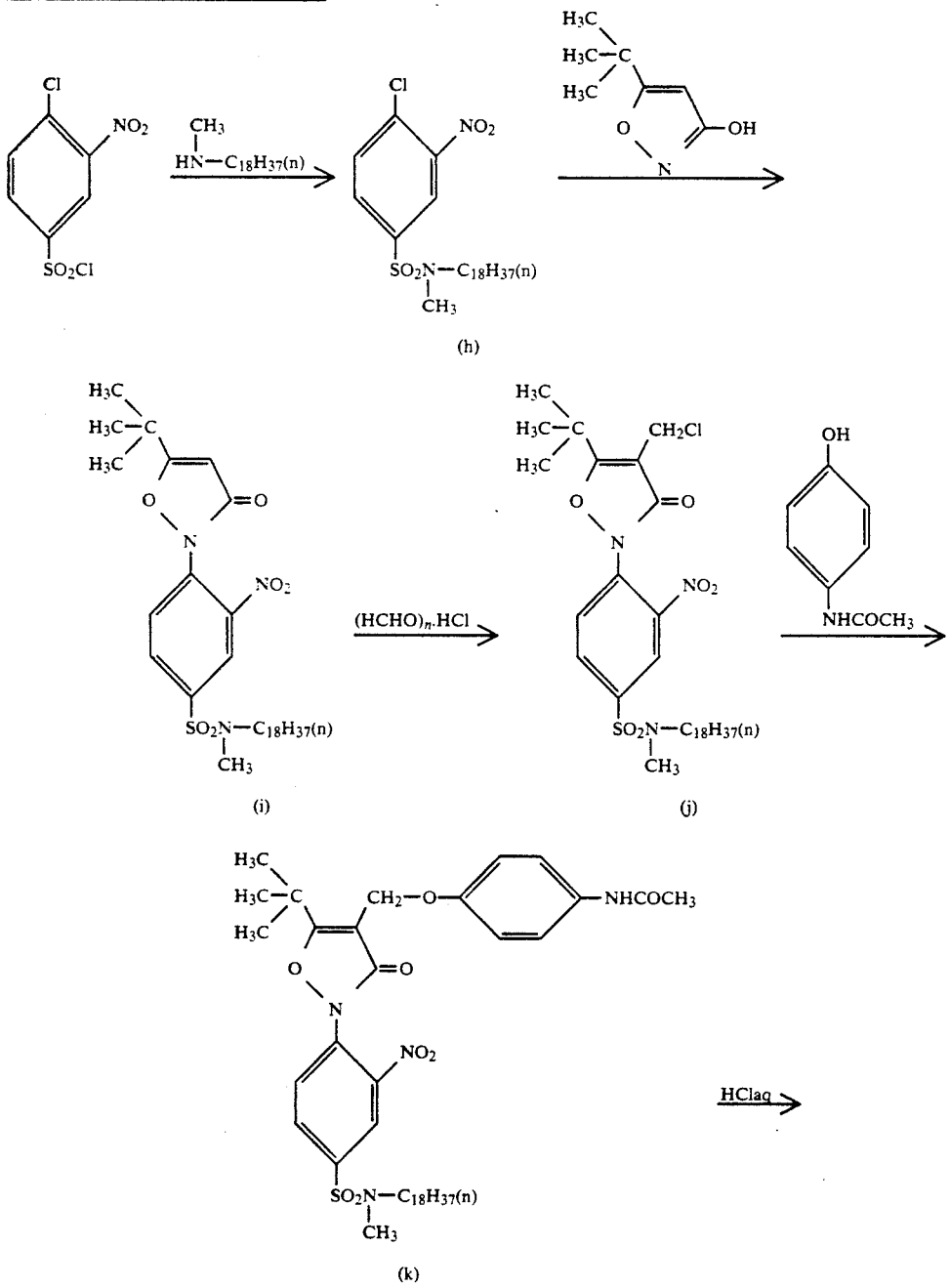

-continued
Process of Synthesis of Compound (50)
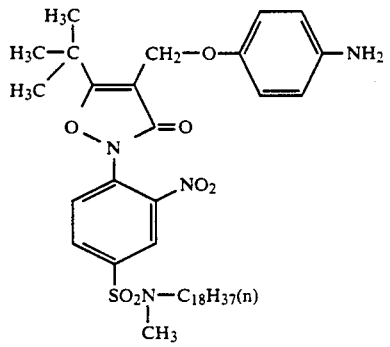
(l)
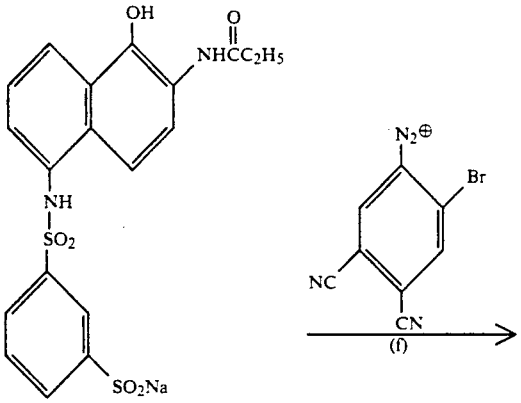
(f)
(b)
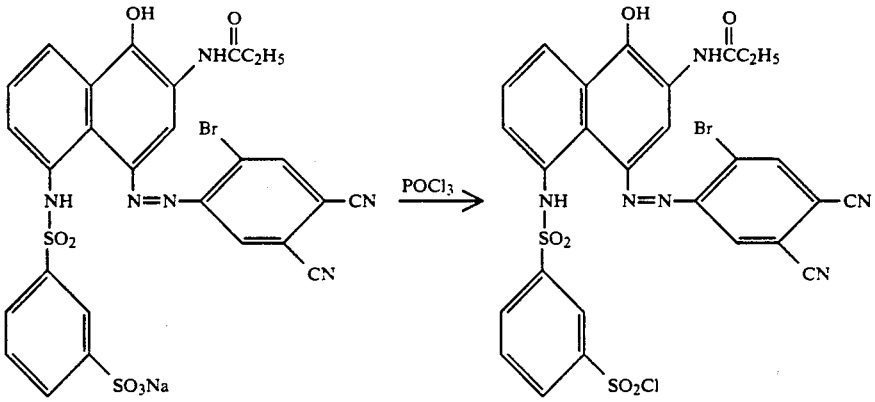
(o) (p)

-continued

Process of Synthesis of Compound (50)

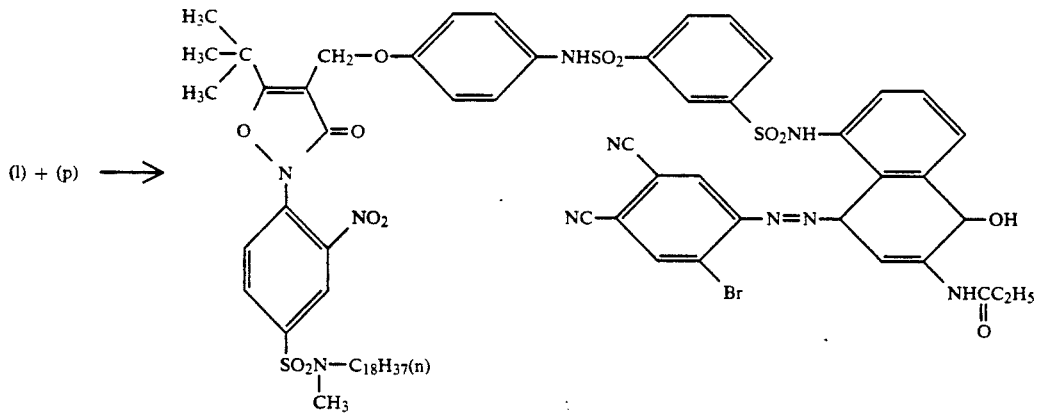

Compound (50)

Synthesis of Intermediate (c-5)

10 ml of bromine was dropwise added to a suspension of 28 g of Intermediate (c-4) in 300 ml of acetic acid with stirring at a temperature of 10° C. or below. The reaction mixture was allowed to undergo reaction at the same temperature for 1 hour. 300 ml of water was added to the reaction mixture. The resulting crystal was filtered off, and washed with water. After being thoroughly dried, the crystal was recrystallized from 100 ml of ethyl acetate to obtain Intermediate (c-5). (Yield: 11 g (50%)).

Synthesis of Intermediate (f)

Intermediate (f) (a diazonium salt of 2-bromo-4,5-dicyanoaniline) was prepared from Intermediate (c-5) previously obtained in accordance with the process described hereinafter. 9 g of sodium nitrite was added to 60 ml of concentrated sulfuric acid with stirring under cooling with ice. The reaction solution was then allowed to undergo reaction at a temperature of 70° C. for 30 minutes. The reaction solution was then cooled with ice. 84 ml of acetic acid and 36 ml of propionic acid were added to the reaction solution while the internal temperature was maintained at 10° C. or below. 24.2 g of Intermediate (c-5) was gradually added to the reaction solution in such a manner that the internal temperature was maintained at not above 5° C. The reaction solution was allowed to undergo reaction at a temperature of 5° C. or below for 3 hours. 1 g of sulfaminic acid was added to the reaction solution to decompose excess sulfurous acid and obtain a diazo solution of Intermediate (f).

Synthesis of Intermediate ($\bar{o}$)

A solution of 45 g of Intermediate (b) and 410 ml of methyl cellosolve in 410 ml of water was stirred under cooling with ice. The diazo solution of Intermediate (f) was gradually added to the solution of Intermediate (b) in such a manner that the internal temperature was maintained at not above 5° C. After being allowed to undergo reaction at a temperature of 5° C. or below for 1 hour, the reaction solution was added to 3 l of saturated brine. The reaction solution was heated to a temperature of 40° to 50° C. for 1 hour. The resulting crystal was filtered off, and washed with saturated brine. After being thoroughly dried to obtain Intermediate ($\bar{o}$), the crystal was used for the next process. (Yield: 100 g)

Synthesis of Intermediate (p)

100 ml of phosphorous oxychloride was dropwise added to a suspension containing 100 g of Intermediate ($\bar{o}$), 40 ml of N,N-dimethylacetamide, and 500 ml of acetonitrile with stirring. After being allowed to undergo reaction at a temperature of 60° C. for 3 hours, the reaction solution was cooled to room temperature with water. The reaction solution was then poured into 2 l of ice water. The reaction solution was stirred at a temperature of 10° C. or below for 1 hour. The resulting crystal was filtered off, washed with water, and air-dried to obtain Intermediate (p). (Yield: 28 g)

Synthesis of Intermediate (h): (Synthesis of 4-chloro-3-nitro-N-methyl-N-octadecylbenzenesulfonamide 100 g of 4-chloro-3-nitrobenzenesulfonyl chloride was dissolved in 300 ml of chloroform. The solution was cooled to a temperature of 0° C. A solution of 84.3 g of methyloctadecylamine in chloroform was dropwise added to the solution. 39.5 g of triethylamine was dropwise added to the mixture while it was maintained at a temperature of 0° to 10° C. After the dropwise addition was finished, the reaction solution was allowed to undergo reaction for 1 hour. Chloroform was removed from the reaction solution. 500 ml of methanol was added to the reaction solution. The admixture was heated so that the reaction solution was dissovled in methanol. The solution was allowed to cool so that crystallization took place. The resulting crystal was filtered off under reduced pressure, and dried to obtain Intermediate (h). (Yield: 109 g (71.2%); m.p. 86°-87° C.)

Synthesis of Intermediate (i): Synthesis of 5-t-butyl-2-(4-N-methyl-N-octadecylsulfamoyl-2-nitrophenyl)-3-iso-oxazolone 600 g of 4-chloro-3-nitro-N-methyl-N-octadecylbenzenesulfonamide, 202 g of 5-t-butyl-3hydroxyisooxazole (see page 75 of Japanese Patent Application No. 244873/85), 200 g of potassium carbonate, and 1.8 l of dimethylsulfoxide was mixed. The reaction mixture was allowed to undergo reaction at a temperature of 65° C. for 6 hours. The reaction solution was poured into ice water. The resulting crystal was filtered off under reduced pressure, washed with water, and dried to obtain Intermediate (i). (Yield: 709 g (98.0%); m.p. 68°-69° C.)

Synthesis of Intermediate (j): Synthesis of 5-t-butyl-4-chloromethyl-2-(4-N-methyl-N-octadecylsulfamoyl-2-nitrophenyl)-3-isooxazolone 650 g of Intermediate (i) (isooxazolone), 200 g of zinc chloride, 200 g of paraformaldehyde, and 3 l of acetic acid were mixed. The reaction mixture was then heated under reflux while hydrogen chloride gas was bubbled thereinto for 10 hours. After being cooled, the reaction solution was poured into water. The resulting crystal crystal was withdrawn and recrystallized from a mixture of acetonitrile and methanol (1:4) to obtain Intermediate (j)). (Yield: 579 g (82.4%); m.p. 55°-56° C.)

Synthesis of Intermediate (k): Synthesis of 5-t-butyl-4-(4-acetylaminophenoxymethyl)-2-(4-N-methyl-N-octadecylsulfamoyl-2-nitrophenyl)-3-isooxazolone 134 g of Intermediate (j) (chloromethylisooxazole), 34 g of potassium carbonate, 2 g of sodium iodide, 32 g of 4-acetylaminophenol, and 800 ml of acetone were mixed. The reaction mixture was heated under reflux with vigorous stirring for 7 hours. After the reaction was finished, the reaction solution was cooled. After the resulting inorganic substances were filtered out under reduced pressure, the solvent was removed under reduced pressure. Methanol was added to the residue so that crystallization took place to obtain Intermediate (h). (Yield: 127.1 g (80.8%))

Synthesis of Intermediate (l): Synthesis of 5-t-butyl-4-(4-aminophenoxymethyl)-2-(4-N-methyl-N-octadecylsulfamoyl-2-nitrophenyl)-3-isooxazolone 500 g of Intermediate (k) (acetylaminophenoxymethylisooxazoles) was added to 2 ( of ethanol. 1 l of 6 N hydrochloric acid was added to the mixture. The reaction mixture was heated under reduced pressure for 8 hours. After being cooled, the reaction solution was neutralized with sodium hydrogencarbonate. The reaction solution was extracted with ethyl acetate. The organic layer was concentrated and crystallized from a mixture of methanol and acetonitrile (10:1) to obtain Intermediate (l). (Yield: 445 g (94.2%); m.p. 71°-72° C.)

Synthesis of Compound (50)

21 g of Intermediate (l) (amino compound) was dissolved in 120 ml of dimethylacetamide. 2.8 g of pyridine was added to the solution. 20 g of Intermediate (p) was added to the mixture. The reaction mixture was then allowed to undergo reaction at room temperature for 2 hours. When methanol was gradually added to the reaction solution, crystallization took place. This process was repeated. The desired compound was crystallized from a dimethylacetamidemethanol mixture to obtain Compound (50). (Yield: 28.0 g (69.7%); m.p. 108°-112° C.; $\lambda_{max}^{DMF}$: 626.2 nm; $\epsilon_{max}^{DMF}$: $9.29\times10^{31}$ 4)

The amount of the image forming compound (dye forming compound) of formula (I) of the present invention to be used in the light-sensitive silver salt layer in the present invention may have a wide range, but normally amounts of from about 0.01 to about 4 mol per mol of silver can be used. More preferably the image forming compound of the present invention is used in an amount of from 0.05 to 2 mol per mol of silver.

In the present invention, at least one light-sensitive silver salt layer is combined with the image forming compound. This means that the image forming compound is added to the light-sensitive silver salt layer and/or a hydrophilic layer adjacent to the light-sensitive silver salt layer.

The incorporation of the above mentioned image forming compound of formula (I) and hydrophobic additives such as the hereafter described image formation accelerators in the layers in the light-sensitive element can be accomplished by any suitable method such as described in U.S. Pat. No. 2,322,027. In this case, a high boiling organic solvent as described in Japanese Patent Application (OPI) Nos. 83154/84, 178451/84, 178452/84, 178453/84, 178454/84, 78455/84 and 178457/84 can be used in combination with a low boiling organic solvent having a boiling point of 50° to 60° C.

The amount of such high boiling organic solvent to be used is normally 10 g or less, preferably 5 g of less per 1 g of dye forming compound.

Alternatively, a dispersion process using a polymer as described in Japanese Patent Publication No. 39853/76, and Japanese Patent Application (OPI) No. 599423/76 may be used.

If the compound is substantially insoluble in water, it can be finely dispersed in a binder.

If a hydrophobic material is dispersed in a hydrophilic colloid, various surface active agents can be used. For example, surface active agents as described in Japanese Patent Application (OPI) No. 157636/84 can be used.

The dye forming compound of formula (I) of the present invention can be used in a light-sensitive element for the color diffusion transfer process which is developed with a processing solution at room temperature, as well as in a heat-developable light-sensitive element which can be developed by heating.

The silver halide which can be used in the above mentioned light-sensitive element may be silver chloride, silver bromide, silver chlorobromide, silver chloroiodide, or silver chloroiodobromide.

Specifically, any suitable silver halide emulsion as described in U.S. Pat. No. 4,500,626, Research Disclosure, No. 17029 (June, 1978, pp. 9 to 10), and Japanese Patent Application (OPI) No. 107240/86 can be used.

The silver halide emulsion to be used in the present invention may be of the surface latent image type in which a latent image is formed mainly on the surface of particles, or the internal latent image type in which a latent image is formed mainly inside the particles. Alternatively, the silver halide emulsion may be a so-called core-shell emulsion in which the inner portion and the surface portion of the particles have different phases. Furthermore, a direct reversal emulsion comprising a combination of an internal latent image type emulsion, a nucleating agent and/or a light fogging agent can be used.

The silver halide emulsion may be used unripened, but is normally subjected to chemical sensitization before use. The emulsion for the ordinary type light-sensitive material can be subjected to known sulfur sensitization process, reduction sensitization process, and noble metal sensitization process, singly or in combination. These chemical sensitization processes can be effected in the presence of a nitrogen-containing heterocyclic compound as described in Japanese Patent Application (OPI) Nos. 126526/83 and 215644/83.

The coated amount of the light-sensitive silver halide is from 1 mg to 10 g/m$^2$ in terms of silver.

The silver halide to be used in the present invention may be subjected to spectral sensitization with a methine dye or the like. Examples of such a dye include cyanine dye, melocyanine dye, a composite cyanine dye, a composite melocyanine dye, a holopolar cyanine dye, hemicyanine dye, styryl dye, and hemioxonol dye.

Specific examples of these dyes include sensitizing dyes as described in Japanese Patent Application (OPI) Nos. 180550/84 and 140335/85, and Research Disclosure, No. 17029 (June 1978, pp. 12 to 13), and heat-decolorable sensitizing dyes as described in Japanese Patent Application (OPI) Nos. 111239/85 and 32446/87.

In the light-sensitive material of the present invention, yellow and magenta image forming compounds having the group Y, i.e., the substrate with the same functions as that of the compound of formula (I) or a known cyan dye forming compound may be used in combination with the compound of formula (I).

As a suitable dye forming compound which may be used in combination with the compound of formula (I) of the present invention, there can be used in a coupler which can react with a developing agent. In the process of using this coupler, the oxidation-reduction reaction of a silver salt with a developing agent produces an oxide form of the developing agent which will then react with the coupler to form a dye. Such a process is described in the prior art literature. This coupler may be a four-equivalent coupler or a two-equivalent coupler. A two-equivalent coupler containing nondiffusible groups as elimination groups which releases a diffusible dye upon reaction with oxidized form of a developing agent is preferably used. Specific examples of such a developing agent and such a coupler are described in detail in "The Theory of the Photographic Process" (T. H. James, 4th edition, pp. 291 to 334 and 354 to 361), and Japanese Patent Application (OPI) Nos. 123533/83, 149046/83, 149047/83, 111148/84, 124399/84, 174835/84, 231539/84, 231540/84, 2950/85, 2951/85, 14242/85, 23474/85 and 66249/85.

Other examples of a suitable dye forming compound which may be used in combination with the dye forming compound of formula (I) of the present invention include a dye-silver compound obtained by combining an organic silver salt with a dye. Specific examples of such a dye-silver compound are described in Research Disclosure, No. 16966 (May 1978, pp. 54 to 58).

A further example of a suitable dye forming compound which may be used in combination with the dye forming compound of formula (I) of the present invention is an azo dye for use in the heat developable silver dye bleach. Specific examples of such an azo dye and bleach process are described in U.S. Pat. No. 4,235,957, and Research Disclosure, No. 14433 (April 1976, pp. 30 to 32). Leuco dyes as described in U.S. Pat. Nos. 3,985,565 and 4,022,617 may be used as the present dye donor matter.

Another example of a suitable dye forming compound which may be used in combination with the dye forming compound (I) of the present invention is a compound which imagewise releases or diffuses a diffusible dye.

This type of a compound can be represented by formula (LI):

$$(\text{Dye}'-\text{X}')_n-\text{Y}' \qquad \text{(LI)}$$

wherein Dye' represents a dye of formula (II), a known dye group, a dye group whose hue has been temporarily shifted to a short wavelength range, or a dye precursor; X' represents a chemical bond or a linking group; Y' represents a group which makes a difference in diffusibility between the compounds represented by $(\text{Dye}'-\text{X}')_n-\text{Y}'$ in correspondence or countercorrespondence to a light-sensitive silver salt having an imagewise latent image or releases Dye' to make a difference in diffusibility between Dye' thus released and $(\text{Dye}'-\text{X}')_n-\text{Y}'$; and n represents an integer of 1 or 2, with the proviso that if n is 2, two (Dye'—X') groups may be the same or different, and that Dye' and X' may not necessarily be connected to each other by A or E in formula (II).

Specific examples of the dye forming compound represented by formula (LI) which can be used in the present invention include a color developing agent comprising a linkage of a hydroquinone developing agent and a dye component as described, e.g., in U.S. Pat. Nos. 3,134,764, 3,362,819, 3,597,200, 3,544,545 and 3,482,972. Furthermore, a dye forming compound which undergoes an intramolecular nucleophilic substitution reaction to release a diffusible dye is described in Japanese Patent Application (OPI) No. 63618/76. A dye forming compound which undergoes an intramolecular rewinding reaction to release a diffusible dye is described in Japanese Patent Application (OPI) No. 111628/74. In these systems, a diffusible dye is released or dispersed in the undeveloped portion, while it is neither released nor dispersed in the developed portion.

In another proposed system, a dye releasing compound in the form of an oxide which is not capable of releasing is allowed to be present with a reducing agent or its precursor. Such a dye releasing compound is reduced by the reducing agent which has left unoxidized after development to release a diffusible dye. Specific examples of a dye forming compound which is used in such a system are described in Japanese Patent Application (OPI) Nos. 110827/78, 130927/79, 164342/81 and 35533/78.

Examples of a dye forming compound which releases a diffusible dye in the developed portion include a dye forming compound which releases a diffusible dye upon reaction of a coupler containing the diffusible dye as an elimination group with an oxide form of a developing agent, as described in British Patents 1,330,524 and 3,443,940, and Japanese Patent Publication No. 39165/73.

Systems using color developing agents often suffer from a serious problems of contamination of image by products of oxidation decomposition of the developing agent. In order to solve this problem, a dye releasing compound which requires no developing agent and has a reducing power itself has been proposed. Typical examples of such a dye releasing compound include dye forming compounds as described in U.S. Pat. Nos. 3,928,312, 4,053,312, 4,055,428, 4,336,322, 3,725,062, 3,728,113, 3,443,939 and 4,500,626, Japanese Patent Application (OPI) Nos. 65839/84, 69839/84, 3819/78, 104343/76, 116537/83 and 179840/82, and Research Disclosure, No. 17465.

If the color light-sensitive material of the present invention is applied to the system which comprises forming an image by diffusion transfer of a dye, a light-sensitive element and an image receiving element or dye fixing element are essential. Typical forms of such a construction are roughly classified into a form in which the light-sensitive element and the dye fixing element are separately coated on two supports, and a form in which the two elements are coated on the same support.

The relationship between the light-sensitive element and the dye fixing element, between the light-sensitive element and the support, and between the light-sensitive element and the white reflecting layer as described in Japanese Patent Application (OPI) No. 147244/86 and U.S. Pat. No. 4,500,626 can be applied to the present invention.

A typical form of the film unit in which the light-sensitive element and the image receiving element or dye fixing element are provided on the same support is a form in which a light-sensitive element and an image receiving element are laminated on a transparent support so that it is not necessary to peel the light-sensitive element off the image receiving element after the completion of image transfer. More particularly, the image receiving element comprises at least one mordant layer, and a preferred embodiment of the light-sensitive element comprises a combination of a blue-sensitive emulsion layer, a green-sensitive emulsion layer, and a red-sensitive emulsion layer; a combination of a green-sensitive emulsion layer, a red-sensitive emulsion layer, and an infrared ray-sensitive element layer; or a combination of a blue-sensitive emulsion layer, a red-sensitive emulsion layer, and an infrared ray-sensitive emulsion layer, each containing a combination of a yellow dye forming compound, a magenta dye forming compound, and a cyan dye forming compound (the term "infrared ray-sensitive emulsion layer" as used herein means an emulsion layer having a light-sensitivity to light of a wavelength of 700 nm or greater, particularly 740 nm or greater). Each of these light-sensitive emulsion layers may be optionally divided into two or more layers. A white reflecting layer containing a solid pigment such as titanium oxide is provided interposed between the mordant layer and the light-sensitive layer or dye forming compound-containing layer so that the transfer image can be viewed through the transparent support. A light screen layer may be provided interposed between the white reflecting layer and the light-sensitive layer so that the development can be accomplished in the light. Furthermore, a peel layer may be optionally provided in a proper position so that the light-sensitive element can be entirely or partially peeled off the image receiving element. Such an embodiment is described in Japanese Patent Application (OPI) No. 67840/81, and Canadian Patent 674,082.

In another form of the construction which does not require peeling, the above mentioned light-sensitive element is coated on a transparent support. A white reflecting layer is coated on the light-sensitive layer. Furthermore, an image receiving layer is laminated on the white reflecting layer. A form of the construction in which an image receiving element, a white reflecting element, a peel layer, and a light-sensitive element are laminated on the same support so that the light-sensitive element can be intentionally peeled off the image receiving element is described in U.S. Pat. No. 3,730,718.

On the other hand, typical forms of the construction in which a light-sensitive element and an image receiving element are separately coated on two supports are roughly classified into two forms, i.e., peel type and peelless type. More particularly, a preferred form of the peel type film unit comprises at least one image receiving layer provided on one surface of a support and a light reflecting layer provided on the opposite side of the support. The light-sensitive element is provided on a support having a light screen layer. The light-sensitive layer side of the support and the mordant layer side are not opposed to each other before the exposure is finished. After the exposure is finished (e.g., during the development), the light-sensitive layer side is turned over and superposed on the image receiving layer side. Once a transfer image is completed on the mordant layer, the light-sensitive element is rapidly peeled off the image-receiving element.

A preferred form of the peelless film unit comprises at least one mordant layer provided on a transparent support. The light-sensitive element is provided on a transparent support or a support having a light screen layer. The light-sensitive layer side and the mordant layer side are superposed on each other facing each other.

These forms can be applied to both the color diffusion transfer process and the heat development process. Particularly, if these forms are applied to the former process, these forms of the construction may comprise pressure-rupturable containers (processing element) containing an alkaline processing solution. More particularly, in the peelless film unit comprising a lamination of an image receiving element and a light-sensitive element provided on a support, this processing element is preferably provided interposed between the light-sensitive element and a cover sheet superposed thereon. In the form of construction in which a light-sensitive element and an image receiving element are separately provided on two supports, the processing element is preferably put between the light-sensitive element and the image receiving element not later than the development. The processing element preferably contains a light screen (carbon black, dye which is subject to color change due to pH change, etc.) and/or a white pigment (titanium oxide) depending on the form of the film unit. In the film unit for use in the color diffusion transfer process, a neutralization timing mechanism comprising a combination of a neutralizing layer and a neutralization timing layer is preferably incorporated in the cover sheet, the image receiving element, or the light-sensitive element.

A preferred example of the mordant which may be used in the above mentioned image receiving element or the dye fixing element described hereinafter is a polymer mordant. The term "polymer mordant" as used herein means a polymer containing tertiary amino groups, a polymer containing nitrogen-containing heterocyclic portions, a polymer containing quaternary cationic groups thereof, or the like.

Specific examples of such a polymer mordant are described in Japanese Patent Application (OPI) No. 147244/86 and U.S. Pat. No. 4,500,626.

If the present invention is applied to a heat developable light-sensitive material, an organic metal salt can be used as an oxidizing agent in combination with a silver halide. In this case, it is necessary that the light-sensitive silver halide and the organic metal salt be in close proximity to each other.

Particularly preferred among these organic metal salts is an organic silver salt.

Examples of organic compounds which can be used to form such an organic silver salt oxidizing agent include compounds as described in Japanese Patent Application (OPI) No. 107240 and U.S. Pat. No. 4,500,626. Other useful examples of such organic compounds include silver salts of carboxylic acids containing alkyl groups such as silver phenylpropiolate as described in Japanese Patent Application (OPI) No. 113235/85 and U.S. Pat. No. 4,603,103 and acetylene silver as described in Japanese Patent Application (OPI) No. 249044/86. These organic silver salts may be used in combination.

These organic silver salts can be used in an amount of 0.01 to 10 mol, preferably 0.01 to 1 mol per mol of light-sensitive silver halide. The sum of the coated amount of the light-sensitive silver halide and the organic silver halide is preferably 50 mg/m$^2$ to 10 g/m$^2$ in terms of silver.

The incorporation of the above described dye forming compounds which are used in combination with the dye forming compound (I) of the present invention and hydrophobic additives such as image formation accelerators hereinafter described in the layers in the light-sensitive element can be accomplished by any suitable method as described in U.S. Pat. No. 2,322,027. In this process, a high boiling organic solvent as described in Japanese Patent Application (OPI) Nos. 83154/84, 178451/84, 178452/84, 178453/84, 178454/84, 178455/84 and 178457/84 can be optionally used in combination with a low boiling organic solvent having a boiling point of 50° to 160° C.

The amount of such boiling solvent to be used is 10 g or less, preferably 5 g or less per 1 g of the dye forming compound which is to be used in combination with the dye forming compound (I) of the present invention.

A dispersion process using a polymer as described in Japanese Patent Publication No. 39853/76 and Japanese Patent Application (OPI) No. 59943/76 may be used.

If a compound which is substantially insoluble in water is used, it can be finely dispersed and contained in a binder instead of being processed as described above.

If a hydrophobic material is dispersed in a hydrophilic colloid, various surface active agents can be used. For example, surface active agents as described in Japanese Patent Application (OPI) No. 157636/84 can be used.

In the present invention, it is preferred that a reducing material be contained in the light-sensitive element. Examples of such a reducing material include compounds commonly known as reducing agents and the above described dye forming compounds having a reducing power. Other useful examples of such a reducing material include a reducing agent precursor which does not have a reducing power itself but exhibit a reducing power when acted on by a nucleophilic reagent or heat during the development.

Examples of reducing agents which may be used in the present invention include reducing agents as described in U.S. Pat. No. 4,500,626 and 4,483,914, and Japanese Patent Application (OPI) Nos. 140335/85, 128438/85, 128436/85, 128439/85 and 128437/85. Reducing agent precursors as described in Japanese Patent Application (OPI) Nos. 138736/81 and 40245/82, and U.S. Pat. No. 4,330,617 can be used.

Combinations of various reducing agents as described in U.S. Pat. No. 3,039,869 can be used.

In the present invention, the added amount of the reducing agent is preferably 0.01 to 20 mol, particularly 0.1 to 10 mol per mol of silver.

In the present invention, the light-sensitive element may contain a compound which serves to activate the development as well as to stabilize the image. Specific examples of such a compound useful in the present invention are described in U.S. Pat. No. 4,500,626.

In the present invention, various fog inhibitors or photographic stabilizers can be used. Examples of such fog inhibitors or photographic stabilizers include azoles and azaindenes as described in Research Disclosure (December 1978, pp. 24 to 25), carboxylic acids and phosphoric acids containing nitrogen as described in Japanese Patent Application (OPI) No. 168442/84, mercapto compounds and metal salts thereof as described in Japanese Patent Application (OPI) No. 11163/84, and acetylene compounds.

In the present invention, the light-sensitive element may optionally comprise a toning agent. Specific examples of useful toning agents include compounds as described in Japanese Patent Application (OPI) No. 147244/86.

In order to obtain a wide range of colors in the chromaticity diagram by using the subtractive primaries, i.e., yellow, magenta and cyan, a light-sensitive element comprising at least three silver halide emulsion layers having a light-sensitivity in different spectral regions may be used. Examples of such a light-sensitive element include a combination of a blue-sensitive layer, a green-sensitive layer, and a red-sensitive layer, and a combination of a green-sensitive layer, a red-sensitive layer, and an infrared ray-sensitive layer. Each of these light-sensitive layers may comprise two or more layers.

The present light-sensitive element may optionally contain various additives known as those for heat developable light-sensitive elements or layers other than light-sensitive layers, such as a protective layer, an intermediate layer, an antistatic layer, an antihalation layer, a peel layer for facilitating peeling of the light-sensitive element off the dye fixing element, and a matting layer. Examples of such additives include plasticizers, matting agents, sharpness improving dyes, antihalation dyes, surface active agents, fluorescent brightening agents, non-slip agents, oxidation inhibitors, and discoloration inhibitors as described in Research Disclosure (June 1978, pp. 9 to 15) and Japanese Patent Application (OPI) No. 88256/86.

Particularly, the protective layer generally contains an organic or inorganic matting agent to inhibit adhesion. The protective layer also may contain a mordant or ultraviolet absorber. The protective layer and the intermediate layer each may consist of two or more layers.

The intermediate layer may contain a reducing agent for inhibiting discoloration or color stain, an ultraviolet absorber, or a white pigment such as titanium oxide. In order to improve the sensitivity, such a white pigment may be incorporated in an emulsion layer as well as in the intermediate layer.

The dye fixing element may optionally comprise an auxiliary layer such as a protective layer, a peel layer, and an anticurl layer. Particularly preferably a protective layer is provided. One or more of these auxiliary layers may contain a hydrophilic heat solvent, a plasticizer, a discoloration inhibitor, an ultraviolet absorber, a lubricant, a matting agent, an oxidation inhibitor, a dispersed vinyl compound for improving dimensional stability, a surface active agent, a fluorescent brightening agent, or the like. Particularly, in the system in which the heat development and the dye transfer are effected at the same time in the presence of a small amount of water, the dye fixing element preferably contains a base and/or a base precursor described hereinafter to improve the stability of the light-sensitive element. Specific examples of these additives are described in Japanese Patent Application (OPI) No. 88256/86.

In the present invention, the light-sensitive element and/or dye fixing element may contain an image formation accelerator. Such an image formation accelerator serves to accelerate the redox reaction of a silver salt oxidizing agent with a reducing agent, the production of a dye from a dye forming compound or the decomposition of the dye, the release of a diffusible dye, or the migration of a dye from the light-sensitive material layer to the dye fixing layer. From the physicochemical standpoint of view, such image formation accelerators are classified into the following categories: a base or base precursor, a nucleophilic compound, a high boiling organic solvent (oil), a heat solvent, a surface active agent, a compound which mutually acts on silver or silver ion, or the like. However, these materials generally have composite functions and thus have a combination of the above described acceleration effects. Such image formation accelerators are described in detail in Japanese Patent Application (OPI) No. 93451/86.

There have been proposed some other methods for generating a base. Any compounds used in these methods are useful as base precursors. Examples of such methods include a method which comprises mixing a difficulty soluble metallic compound with a compound capable of complexing with metal ions constituting the metallic compound (complex forming compound) to produce a base, and a method as described in Japanese Patent Application (OPI) No. 232451/86 which comprises electrolysis to produce a base.

The former method is particularly effective. Examples of the difficultly soluble metallic compound include carbonates, hydroxides, and oxides of zinc, aluminum, calcium, and barium. Examples of the complex forming compounds are described in detail in *Critical Stability Constants* (edited by A. E. Martell and R. M. Smith, Vol. 4 and Vol. 5, Plenum Press). Specific examples of such complex forming compounds include salts of aminocarboxylic acids, iminodiacetic acids, pyridylcarboxylic acids, aminophosphoric acids, carboxylic acids, monocarboxylic acid, dicarboxylic acids, tricarboxylic acids, and tetracarboxylic acids, and compounds containing substituents such as phosphono, hydroxy, oxo, ester, amide, alkoxy, mercapto, alkylthio, and phosphino groups, hydroxams, polyacrylates, and polyphosphoric acids with alkali metals, guanidines, amidines, or quaternary ammonium salts.

The difficultly soluble metallic compound and the complex forming compound are preferably incorporated separately in the light-sensitive element and the dye fixing element.

The light-sensitive element and/or dye fixing element may comprise various development stopping agents in order to obtain a constant image regardless of any fluctuation in development temperature and time.

The term "development stopping agent" as used herein means a compound which rapidly neutralizes or reacts with a base after a proper development so that the base concentration in the film is decreased to stop development or a compound which mutually acts on silver or silver salts to inhibit development. Specific examples of such a development stopping agent include acid precursors which release an acid upon heating, electrophilic compounds which undergo substitution reaction with a coexisting base upon heating, nitrogen-containing heterocyclic compounds, mercapto compounds, and precursors thereof (e.g., compounds as described in Japanese Patent Application (OPI) Nos. 108837/85, 192939/85, 230133/85 and 230134/85).

Other useful examples of such a development stopping agent include compounds which release a mercapto compound upon heating, such as compounds as described in Japanese Patent Application (OPI) Nos. 67851/86, 147244/87, 124941/86, 185743/86, 182039/86, 185744/86, 184539/86, 188540/86 and 53632/86.

As binders for the light-sensitive element and/or the dye fixing element there may be used hydrophilic binders. Typical examples of such hydrophilic binders include transparent or translucent hydrophilic binders. Specific examples of such binders include proteins such as gelatin, and gelatin derivatives, natural substances such as cellulose derivatives, polysaccharides, e.g., starch, gum arabic, etc., and synthetic polymeric substance such as water-soluble polyvinyl compounds, e.g., polyvinyl pyrrolidone, acrylamide polymers, etc. Other useful examples of suitable binders include a dispersed vinyl compound which is used in the form of a latex to improve the dimensional stability of a photographic material. These binders may be used singly or in combination.

In the present invention, the coated amount of the binder is 20 g or less, preferably 10 g or less, particularly 7 g or less per 1 $m^2$.

The amount of the high boiling organic solvent dispersed in the binder with a hydrophobic compound such as a dye forming compound is preferably 1 cc or less, more preferably 0.5 cc or less, particularly preferably 0.3 cc or less per 1 g of binder.

The constituent layer (e.g., photographic emulsion layer and dye fixing layer) of the light-sensitive element and/or dye fixing element may contain an inorganic or organic hardener.

Specific examples of such hardener include those described in Japanese Patent Application (OPI) Nos. 147244/86 and 157636/84. These hardeners may be used singly or in combination.

In order to accelerate the migration of a dye, a hydrophilic heat solvent which is solid at normal temperature but melts at an elevated temperature may be incorporated in the light-sensitive element or the dye fixing element. Such a hydrophilic heat solvent may be incorporated in either or both of the light-sensitive element and the dye fixing element. The layers in which the hydrophilic heat solvent is incorporated include an emulsion layer, an intermediate layer, a protective layer, and a dye fixing layer. Particularly preferred among these layers are a dye fixing layer and/or layers adjacent thereto. Examples of the hydrophilic heat solvent include ureas, pyridines, amides, sulfonamides, imides, alcohols, oxims, and other heterocyclic compounds. In order to accelerate the dye migration, a high boiling organic solvent may be incorporated in the light-sensitive element and/or the dye fixing element.

As the support for the light-sensitive element and/or the dye fixing element there can be used a material which can withstand the processing temperature. As such a support material there can be commonly used glass, paper, polymer film, metal, and analogous materials. Besides these materials, those described as support materials in Japanese Patent Application (OPI) No. 147244/86 may be used.

The light-sensitive element and/or the dye fixing element may be in the form of an element having an electrically conductive heating element layer as a heating means for heat development or diffusion transfer of dye.

The transparent or translucent heating element to be used in this construction can be prepared as a resistive heating element by any suitable known method. Such a resistive heating element can be prepared from a thin film of a semiconductive inorganic material or from an organic thin film comprising finely divided particles of electrically conductive material dispersed in a binder. Examples of materials which can be used in these preparation methods include those described in Japanese Patent Application (OPI) No. 29835/86.

In the present invention, the coating of the heat developable light-sensitive layer, the protective layer, the intermediate layer, the undercoat layer, the back layer, the dye fixing layer, and other layers can be accomplished by any suitable method, such as described in U.S. Pat. No. 4,500,626.

Examples of light source which can be used for imagewise exposure to record an image on the light-sensitive element include light sources of radiation such as visible light. In general, there can be used a light source for use in an ordinary color print process, such as a tungsten lamp, a mercury lamp, an iodine lamp, a laser source, a CRT source, a light emitting diode (LED), and light sources as described in Japanese Patent Application (OPI) No. 147244/86 and U.S. Pat. No. 4,500,626.

In the image forming process comprising a heating step to which the present invention can be applied, the step of heat development and the step of dye transfer can be effected separately or at the same time. These steps may be successive in that the development is followed by the transfer.

For example, the following two image formation processes can be used.

(1) A light-sensitive element is imagewise exposed to light. After the light-sensitive element is heated, a dye fixing element is superposed on the light-sensitive element. The light-sensitive element is heated, as necessary, so that a mobile dye is transferred to the dye fixing element.

(2) A light-sensitive element is imagewise exposed to light. A dye fixing element is superposed on the light-sensitive element. The light-sensitive element is heated.

These methods can be effected in the substantial absence of water or in the presence of a slight amount of water.

The heat development can be accomplished at a temperature of about 50° C. to about 250° C, preferably about 80° C. to about 180° C. If the heating is effected in the presence of a slight amount of water, the upper limit of the heating temperature is below the boiling point of water. If the transfer step is effected after the heat development is finished, the heating temperature at the transfer step may be in the range of room temperature to the temperature at the heat development step, particularly in the range of 50° C. to a temperature of about 10° C. below the temperature at the heat development step.

In a preferred image formation process used in the present invention, heating is effected after imagewise exposure or at the same time with imagewise exposure in the presence of a slight amount of water and a base and/or base precursor, and a diffusible dye produced in the portions in correspondence or countercorrespondence to the silver image is moved to the dye fixing layer at the same time with the development. By this method, the production or release of a diffusible dye can progress extremely rapidly. This facilitates the migration of the diffusible dye to the dye fixing layer. Thus, a high density color image can be provided in a short period of time.

The amount of water to be used in this system may be as small as at least 0.1 time, preferably 0.1 or more time the total coated weight of the light-sensitive element and th dye fixing element to the weight of the solvent in a volume equivalent to the maximum swollen volume of the coat film (particularly, less than the value obtained by subtracting the weight of the coat film from the weight of the solvent in a volume equivalent to the maximum swollen volume of the coat film).

Since the film is unstable when swollen, it can show local stain under some conditions. In order to avoid such a problem, the amount of water to be used is preferably less than the volume equivalent to the maximum swollen volume of the coat film of light-sensitive element and dye fixing element. Particularly, it is preferably 1 to 50 g, particularly 2 to 35 g, more particularly 3 to 25 g per 1 $m^2$ of the total area of the light-sensitive element and dye fixing element.

The base and/or base precursor used in this system can also be incorporated in the light-sensitive element or the dye fixing element. The base and/or base precursor may also be used in the form of an aqueous solution.

In the above described embodiment, the image forming system preferably contains as base precursors a basic metal compound which is difficultly soluble in water and a compound which can undergo a complex forming reaction with metal ions constituting the metal compound and water as medium so that these two compounds react with each other upon heating to raise the pH value of the system. The term "image forming system" as used herein means a region in which an image forming reaction takes place. Specific examples of such a system include a layer which belongs to both the light-sensitive element and the dye fixing element. If two or more layers are present, any of these layers can be such a system.

The difficultly soluble metal compound and the complex forming compound at least need to be incorporated in separate layers in order to prevent themselves from reacting with each other before the development. For example, in the so-called monosheet comprising a light-sensitive element and a dye fixing element provided on the same support, the two elements are preferably incorporated in separate layers with one or more layers interposed therebetween. A preferred form of such a construction is such that the difficultly soluble metal compound and the complex forming compound are incorporated in layers which are separately provided on two supports. For example, the difficultly soluble metal compound is incorporated in a light-sensitive element while the complex forming compound is incorporated in a dye fixing element provided on a support different from that for the light-sensitive element. The complex forming compound may be dissolved in the water which is to be present therewith. The difficultly soluble metal compound is preferably incorporated in the form of a fine dispersion prepared in the method as described in Japanese Patent Application (OPI) Nos. 174830/81 and 102733/78. The average size of the finely divided particles is preferably 50 μm or less, particularly 5 μm or less. The difficultly soluble metal compound may be incorporated in any of the light-sensitive layer, intermediate layer, and protective layer of the light-sensitive element. Alternatively, the difficultly soluble metal compound may be separately incorporated in two or more layers.

The amount of the difficultly soluble metal compound or the complex forming compound to be incorporated in the layer provided on the support depends on the type of the compound, particle size of the difficultly soluble metal compound, and the reaction rate of complex formation. It is preferably in the range of 50% by weight or less, particularly 0.01 to 40% by weight based on the weight of the coat film. If the complex forming compound is dissolved in water before being supplied, the concentration thereof is preferably 0.005 to 5 mol, particularly 0.05 to 2 mol per 1 l. In the present invention, the molar proportion of the content of the complex forming compound in the reaction system to that of the difficultly soluble compound is preferably 1/100 to 100, particularly 1/10 to 20.

Examples of the process for imparting water to the light-sensitive layer or the dye fixing layer are described in Japanese Patent Application (OPI) No. 147244/86.

Examples of heating means for use in the development step and/or transfer step include a heating plate, a flatiron, and a heating roller as described in Japanese Patent Application (OPI) No. 147244/86. A layer of an electrically-conductive material such as graphite, carbon black, and metal may be provided superposed on the light-sensitive element and/or dye fixing element so that the light-sensitive element and/or dye fixing element can be directly heated by passing an electric current through the electrically conductive layer.

As the pressure conditions and the pressure application process for laminating the light-sensitive element with the dye fixing element there may be employed those described in Japanese Patent Application (OPI) No. 147244/86.

The processing of the photographic element can be accomplished by any suitable heat developing apparatus. Preferred examples of such suitable heat developing apparatus include those described in Japanese Patent Application (OPI) Nos. 75247/84, 177547/84, 181353/84 and 18951/85, and Japanese Utility Model Application (OPI) No. 2594/87.

EXPERIMENT EXAMPLE

The cyan dyes of formula (I) of the present invention and known cyan dyes were measured for maximum absorption wavelength ($\lambda_{max}$). The ($\lambda_{max}$) value was obtained when these dyes were mordanted with a quaternary ammonium salt polymer (the polymer was methylpolyacrylate-co-N,N,N-trimethyl-N-vinylbenzylammonium chloride (proportion of methyl acrylate to vinylbenzyl ammonium chloride is 1:1)). The synthesis of these dyes were effected by an ordinary azo coupling process, The dyes of formula (I) and the known cyan dyes used in this experiment are represented by the following formula and the substituents are shown in the following table.

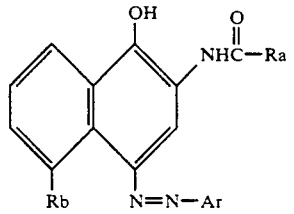

| Dye | Ra | Rb | Ar | λmax (nm) | Remarks |
|---|---|---|---|---|---|
| A | $-C_2H_5$ | 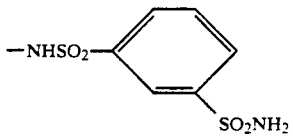 | 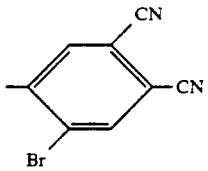 | 644 | Present Invention |
| B | 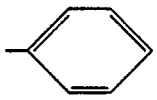 | $-NHSO_2CH_3$ | 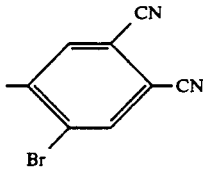 | 649 | Present Invention |
| C | $-C_2H_5$ | 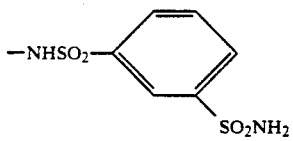 | 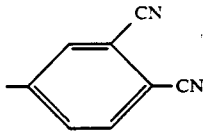 | 640 | Present Invention |

-continued

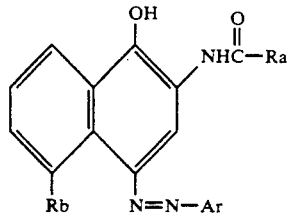

| Dye | Ra | Rb | Ar | λmax (nm) | Remarks |
|---|---|---|---|---|---|
| D | $-C_2H_5$ | $-NHSO_2-$ 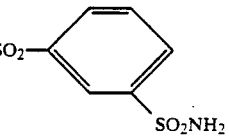 | 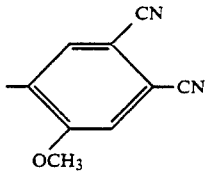 | 647 | Present Invention |
| E | 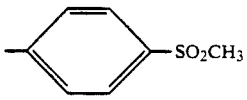 | $-NHSO_2-$ 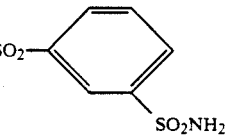 | 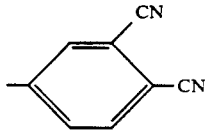 | 645 | Present Invention |
| F | $-C_2H_5$ | $-NHSO_2-$ 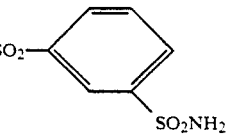 | 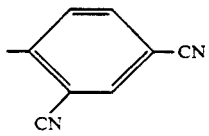 | 632 | Comparative |
| G | $-CH_3$ | $-NHSO_2CH_3$ | 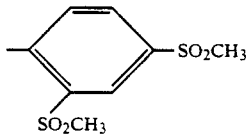 | 627 | Comparative |
| H | $-C_2H_5$ | $-NHSO_2CH_3$ | 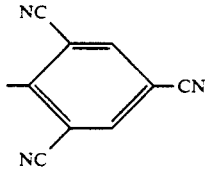 | 620 | Comparative |
| I | $-C_2H_5$ | H | 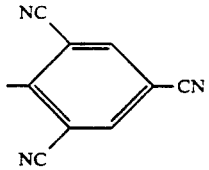 | 622 | Comparative |

The above results show that the dyes of the present invention have the maximum absorption at a longer wavelength range than the known dyes.

The present invention will be further illustrated in the following examples but the present invention should not be construed as being limited thereto.

EXAMPLE 1

A benzotriazole silver emulsion was prepared in the following manner.

28 g of gelatin and 13.2 g of benzotriazole were dissovled in 3,000 ml of water. The solution was stirred while it was maintained at a temperature of 40° C. A solution of 17 g of silver nitrate in 100 ml of water was added to the solution in two minutes.

The pH value of the benzotriazole silver emulsion was properly adjusted so that sedimentation took place to remove excess salts therefrom. The pH value of the emulsion was then adjusted to 6.30 to obtain 400 g of a benzotriazole silver emulsion.

A silver halide emulsion was then prepared in the following manner.

600 ml of an aqueous solution of sodium chloride and potassium bromide and an aqueous solution of silver nitrate (solution of 0.59 ml of silver nitrate in 600 ml of water) were added to an aqueous solution of gelatin (solution of 20 g of gelatin and 3 g of sodium chloride in 1,000 ml of water, maintained at a temperature of 75° C.) at the same time at a constant flow rate in 40 minutes while the latter was vigorously stirred. As a result, a monodisperse emulsion of particulate cubic silver chlorobromide (bromide content: 80 mol %) having an average particle size of 0.35 μm was prepared.

The emulsion was then washed with water and desalted. 5 mg of sodium thiosulfate and 20 mg of 4-hydroxy-6-methyl-1,3,3a,7-tetrazaindene were added to the emulsion so that the emulsion was chemically sensitized. As a result, the emulsion was obtained in a yield of 600 g.

A gelatin dispersion of a cyan dye forming compound was prepared in the following manner.

5 g of a comparative cyan dye forming compound (Comparative Compound (A)) and 5 g of triisononyl phosphate were measured out and mixed with 20 ml of ethyl acetate. The admixture was heated to a temperature of about 70° C. so that a uniform solution was obtained. The solution was then mixed with 100 g of a 10% solution of lime-processed gelatin and 60 ml of a 2.5% aqueous solution of sodium dodecylbenzenesulfonate as a surface active agent with stirring. The mixture was subjected to dispersion at 10,000 RPM by means of a homogenizer for 10 minutes. The dispersion thus obtained was referred to as "dispersion of a cyan dye forming compound".

A light-sensitive coating material was prepared in the following manner.

| | |
|---|---|
| a) Benzotriazole silver emulsion | 10 g |
| b) Light-sensitive silver chlorobromide emulsion | 15 g |
| c) Dispersion of cyan dye forming compound | 25 g |
| d) 5% aqueous solution to the following compound | 5 ml |

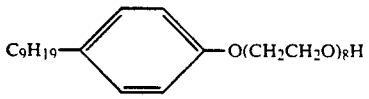

| | |
|---|---|
| e) 10% methanol solution of benzenesulfonamide | 5 ml |
| f) 7% solution of guanidine p-chlorophenylsulfonylacetate in 50% aqueous solution of ethanol | 15 ml |

The above components a) to f) were mixed. A thickener and water were added to the admixture to make 100 ml. The solution was then coated onto a 180 μm thick polyethyleneterephthalate film in a 50 μm thick wet film.

A coating composition for a protective layer was then prepared in the following manner.

| | |
|---|---|
| h) 10% gelatin solution | 400 g |
| i) 7% solution of guanidine p-chlorophenylsulfonylacetate in 50% aqueous solution of ethanol | 240 ml |
| j) 4% film hardener solution of the structural formula: $CH_2{=}CHSO_2CH_2CONH(CH_2)_2NHCOCH_2SO_2CH{=}CH_2$ | 50 ml |

The above components h) to j) were mixed. A thickener and water were added to the admixture to make 1,000 ml. The coating composition thus obtained was then coated onto the surface of the film coated with the light-sensitive coating composition to a thickness of 30 μm.

The light-sensitive material thus obtained was referred to as "Light-sensitive material 101".

Light-sensitive materials 102 to 105 were prepared in the same manner as in Light-sensitive material 101, except that as the cyan dye forming compound there were used Comparative compound (B) or the compounds (5), (19) and (37) of the present invention instead of Comparative compound (A).

Comparative Compound (A)

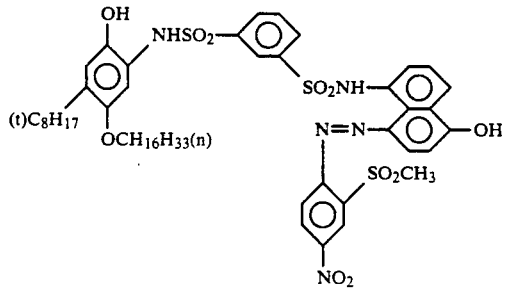

Comparative Compound (B)

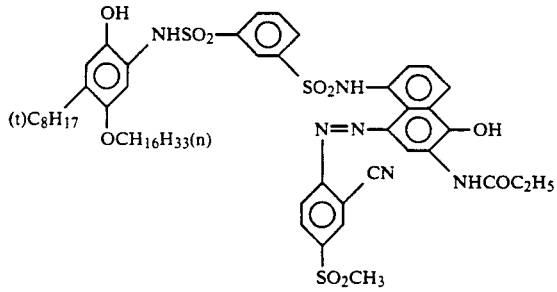

These light-sensitive materials were dried and imagewise exposed to light of 5,000 lux from a tungsten lamp. These light-sensitive materials thus exposed were then uniformly heated for 20 seconds over a heat block which had been heated to a temperature of 150° C.

A dye fixing material was prepared in the following manner.

63 g of gelatin and 130 g of a mordant of the following structural formula were dissolved in 1,300 ml of water. The coating solution thus obtained was then coated on a polyethylene-laminated paper support in a 45 μm thick wet film. The coat film was then dried.

Mordant

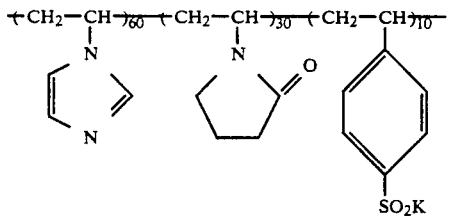

A solution of 35 g of gelatin and 1.05 g of 1,2-bis(vinylsulfonylacetamideethane) in 800 ml of water was coated onto the above coat film in a 17 μm thick wet film. The coat film was dried to prepare a dye fixing material.

Water was supplied to the coated side of the dye fixing material in an amount of 15 ml per 1 $m^2$. The light-sensitive material thus exposed and heated was superposed on the dye fixing material in such a manner that the coated sides thereof face each other.

The lamination was then heated for 6 seconds over a heat block which had been heated to a temperature of 80° C. The dye fixing material was peeled off the light-sensitive material to obtain a cyan image on the fixing material.

These light-sensitive materials were then measured by a Macbeth reflection densitometer (RD 519) for the density of cyan image.

The results are shown in Table 1.

Table 1 also shows the results of the maximum absorption wavelength ($\lambda_{max}$) and the change of density of the portion whose initial density was 1.0 after two weeks of irradiation with a xenon light of 80,000 lux.

TABLE 1

| Light-sensitive material No. | Maximum Density | Minimum Density | $\lambda_{max}$ | Density after 2 weeks of Xe light irradiation |
|---|---|---|---|---|
| 101 (comparative) | 2.15 | 0.20 | 643 nm | 0.41 |
| 102 (comparative) | 1.60 | 0.16 | 625 nm | 0.75 |
| 103 (present invention) | 2.10 | 0.19 | 640 nm | 0.73 |
| 104 (present invention) | 2.05 | 0.19 | 652 nm | 0.70 |
| 105 (present invention) | 2.26 | 0.25 | 641 nm | 0.74 |

Table 1 shows that the cyan dye forming compounds of the present invention exhibit high densities and low fogs and provide an image having an excellent fastness to light.

The compounds (1), (9), (10), (11), (12), (27), (8), (31), (74), (70) and (36) of the present invention showed similar results.

EXAMPLE 2

A color light-sensitive material 201 having a multilayer structure shown in Table 2 was prepared. The incorporation of yellow dye forming compounds, magenta dye forming compounds, and cyan dye forming compounds as dispersions was effected by the same method described in Example 1.

A light-sensitive material 202 was then prepared in the same manner as in the light-sensitive material 201 except that the cyan dye forming compound used in the light-sensitive material 201 was replaced by the compound (2) of the present invention.

TABLE 1

| | coated amount |
|---|---|
| 6th Layer | |
| Gelatin | 800 mg/m$^2$ |
| Film hardener *5 | 16 mg/m$^2$ |
| Zinc hydroxide | 300 mg/m$^2$ |
| 5th Layer: Blue-sensitive emulsion layer | |
| Silver iodobromide emulsion (iodide: 5 mol %) | 400 mg/m$^2$ in terms of silver |
| Benzotriazole silver emulsion | 60 mg/m$^2$ in terms of silver |
| Film hardener *5 | 16 mg/m$^2$ |
| Yellow dye forming compound (7) | 400 mg/m$^2$ |
| Gelatin | 1,100 mg/m$^2$ |
| High boiling solvent *4 | 400 mg/m$^2$ |
| Surface active agent *2 | 100 mg/m$^2$ |
| 4th Layer: Intermediate layer | |
| Gelatin | 900 mg/m$^2$ |
| Film hardener *5 | 18 mg/m$^2$ |
| Zinc hydroxide | 300 mg/m$^2$ |
| 3rd Layer: Green-sensitive emulsion layer | |
| Silver chlorobromide emulsion (bromide: 80 mol %) | 300 mg/m$^2$ in terms of silver |
| Benzotriazole silver emulsion | 50 mg/m$^2$ in terms of silver |
| Film hardener *5 | 18 mg/m$^2$ |
| Magenta dye forming compound | 400 mg/m$^2$ |
| Gelatin | 1,100 mg/m$^2$ |
| High boiling solvent *4 | 400 mg/m$^2$ |
| Surface active agent *2 | 100 mg/m$^2$ |
| 2nd Layer: Intermediate layer | |
| Gelatin | 800 mg/m$^2$ |
| Film hardener *5 | 16 mg/m$^2$ |
| Zinc hydroxide | 300 mg/m$^2$ |
| 1st Layer: Red-sensitive emulsion layer | |
| Silver chlorobromide emulsion (bromide: 80 mol %) | 300 mg/m$^2$ in terms of silver |
| Benzotriazole silver emulsion | 50 mg/m$^2$ in terms of silver |
| Sensitizing dye *3 | $8 \times 10^{-7}$ mo/m$^2$ |
| Cyan dye forming compound | 300 mg/m$^2$ |
| Gelatin | 820 mg/m$^2$ |
| Support | |

TABLE 1-continued

*1: Polyethylene terephthalate

*2:

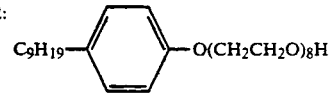

*3:

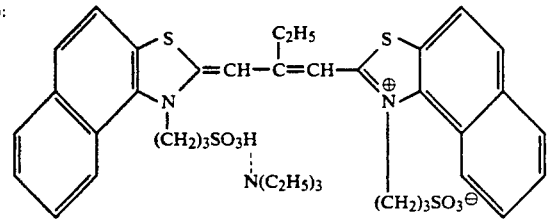

*4: $(isoC_9H_{19}O)_3P{=}O$
*5: 1,2-bis(vinylsulfonylacetamide)ethane
Yellow dye forming compound

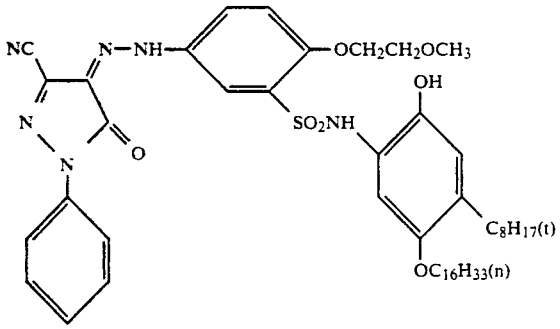

Magenta dye forming compound

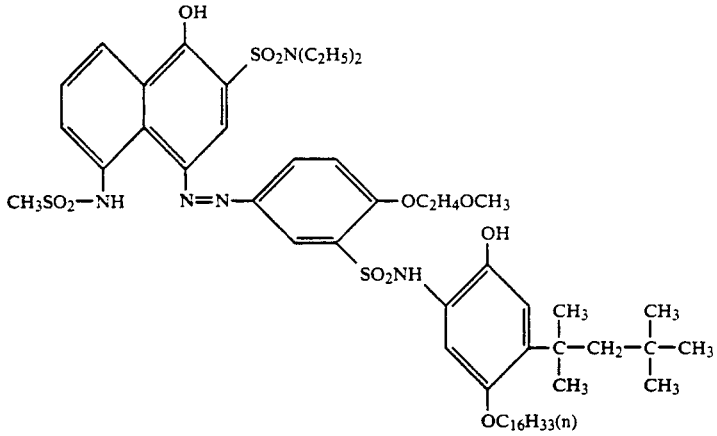

Cyan dye forming compound:
Comparative compound (A) of Example 1

As the dye fixing material there was used that shown in Table 3.

TABLE 3

| | coated amount |
|---|---|
| 2nd Layer: | |
| Gelatin | 0.7 g/m$^2$ |
| 1-2-bis(vinylsulfonyl acetamide)ethane | 0.06 g/m$^2$ |
| 1st Layer: | |
| Gelatin | 1.4 g/m$^2$ |
| Mordant *1 | 2.8 g/m$^2$ |
| Guanidine piclinate | 2.6 g/m$^2$ |
| Support (polyethylene-laminated paper) | |

TABLE 3-continued

*1: 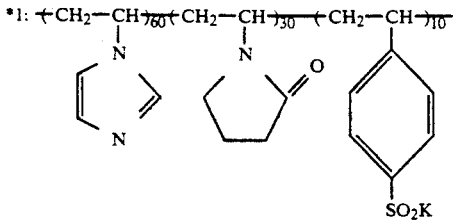

The color light-sensitive material having the above multilayer structure was exposed to light of 2,000 lux from a tungsten lamp through a separation filter (B, G and R) having a continuous density gradation for 1 second.

Water was supplied to the emulsion side of the light-sensitive material thus exposed in an amount of 15 ml/m$^2$. The above mentioned dye fixing material was then superposed on the light-sensitive material in such a manner that the coated sides thereof faced each other.

The lamination was heated for 25 seconds by means of a heat roller whose temperature had been adjusted so that the temperature of the film which had absorbed water was maintained at 90° C. The light-sensitive material was then peeled off the dye fixing material. As a result, sharp yellow, magenta and cyan images corresponding to the separation filter (B, G and R) were obtained on the dye fixing material.

Furthermore, after being stored at a temperature of 40 ° C. and a relative humidity of 80% for 1 week, the light-sensitive material was subjected to the same processing.

The results of the maximum density ($D_{max}$) and the minimum density ($D_{min}$) of the cyan image are shown in Table 4.

The light-sensitive material was further subjected to a discoloration test by Xe light in the same manner as in Example 1. The results are shown in Table 4.

TABLE 4

| Light-sensitive material No. | Immediately after Preparation | | After storage at 80° C. and 80% RH | | Density after 2 weeks of Xe light irradiation |
|---|---|---|---|---|---|
| | Maximum density | Minimum density | Maximum density | Minimum density | |
| 201 (comparison) | 2.42 | 0.17 | 2.40 | 0.24 | 0.35 |
| 202 (present invention) | 2.45 | 0.17 | 2.44 | 0.24 | 0.68 |

Table 4 shows that the cyan dye forming compound of the present invention shows an excellent stability in the light-sensitive material and provides an excellent fastness of image to light.

EXAMPLE 3

The following layer compositions were coated on a transparent polyethylene terephthalate support in sequence to prepare Light-sensitive material 301.

(I) A dye receiving layer containing:
- a) poly(styrene-co-N-vinylbenzyl-N,N,N-trihexylammoniumchloride) (4.0 g/m$^2$); and
- b) gelatin (4.0 g/m$^2$)

(II) A white reflecting layer containing:
- a) titanium dioxide (22 g/m$^2$); and
- b) gelatin (2.2 g/m$^2$)

(III) An opaque layer containing:
- a) carbon black (2.7 g/m$^2$); and
- b) gelatin (2.7 g/m$^2$)

(IV) A cyan dye providing layer containing:
- a) gelatin dispersion of a cyan dye forming compound of the formula shown hereinafter (0.33 mmol/m$^2$) and Compound C (0.4 mmol/m$^2$); and
- b) gelatin (1.1 g/m$^2$, gelatin in a) included)

(V) A red-sensitive emulsion layer containing:
- a) red-sensitive silver iodobromide emulsion (0.5 g/Ag/m$^2$; and
- b) gelatin (1.1 g/m$^2$, gelatin in a) included)

(VI) An intermediate layer containing:
- a) 2,5-di(t-pentadecyl)hydroquinone (0.82 g Ag/m$^2$);
- b) vinyl acetate (0.8 g/m$^2$); and
- c) gelatin (VII) A magenta dye providing layer containing:
- a) gelatin dispersion of a magenta dye forming compound of the formula shown hereinafter (0.3 mmol g/m$^2$) and Compound C (0.4 mmol/m$^2$); and
- b) gelatin (1.1 g/m$^2$, gelatin in a) included)

(VIII) A green-sensitive layer containing:
- a) green-sensitive silver iodobromide emulsion (0.5 mmol g Ag/m$^2$); and
- b) gelatin (1.1 g/m$^2$, gelatin in a) included)

(IX) Same as (VI)

(X) A yellow dye providing layer containing:
- a) gelatin dispersion of a yellow dye forming compound of the general formula shown hereinafter (0.5 mmol g/m$^2$) and Compound C (0.6 mmol/m$^2$); and
- b) gelatin (1.1 g/m$^2$, gelatin in a) included)

(XI) a blue-sensitive layer containing:
- a) blue-sensitive silver iodobromide emulsion (0.5 g/m$^2$); and
- b) gelatin (1.1 g/m$^2$, gelatin in a) included)

(XII) A protective layer containing:
- a) latex of polyethylene acrylate (0.9 g/m$^2$);
- b) Chinubin (UV absorbent made by Ciba-Geigy Co., Ltd.) (0.5 g/m$^2$);
- c) triacryloyl perhydrotriazine as film hardener (0.026 g/m$^2$); and
- d) gelatin (1.3 g/m$^2$)

Compound C

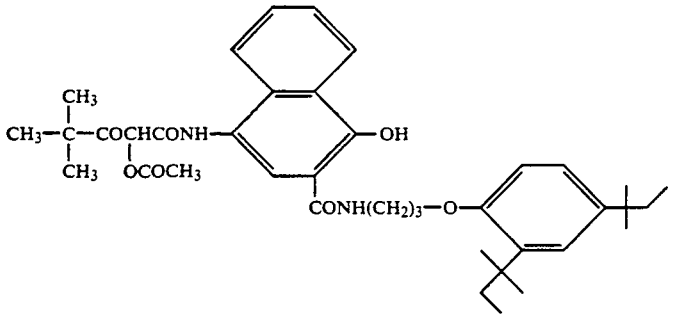

Cyan dye forming compound (comparative)

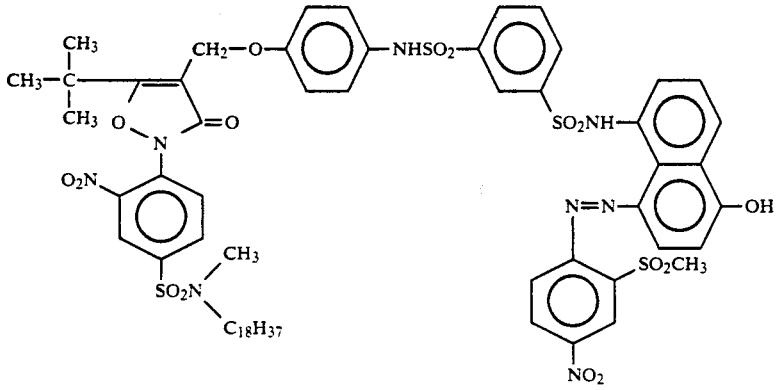

Magenta dye forming compound

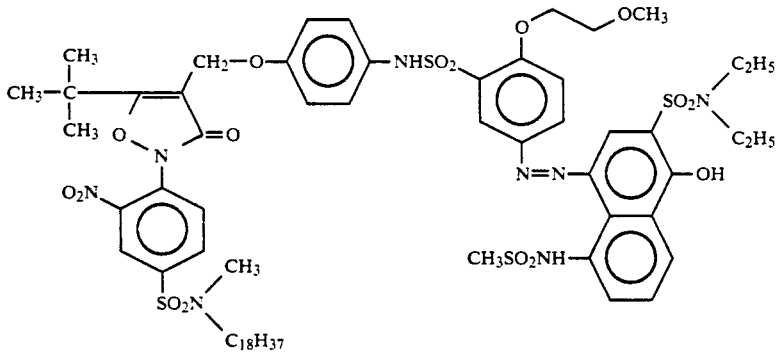

Yellow dye forming compound

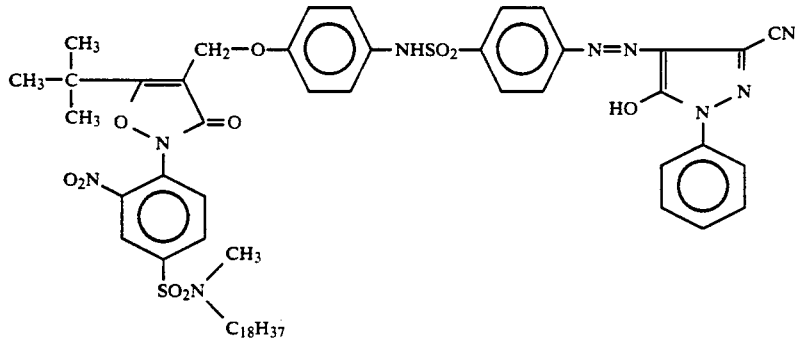

Light-sensitive material 302 was prepared in the same manner as in Light-sensitive material 302, except that the cyan dye forming compound used in Light-sensitive material 301 was replaced by Compound (50) of the present invention.

The following layer compositions were coated onto a transparent polyethylene terephthalate film in sequence to prepare a cover sheet.

(I) An acid neutralizing layer containing:

a) polyacrylic acid (17 g/m$^2$);

b) N-hydroxysuccinimidebenzenesulfonate gelatin (0.06 g/m$^2$); and c) ethylene glycol (0.5 g/m$^2$)

(II) A timing layer comprising a 2 μm thick coat of cellulose acetate (acetylation degree: 54%)

(III) A timing layer comprising a 4 μm thick coat of a copolymer latex of vinylidene chloride and acrylic acid A processing solution of the following components was prepared.

| | |
|---|---|
| Potassium hydroxide | 48 g |
| 4-Hydroxymethyl-4-methyl-1-p-tolyl-3-pyrazolidinone | 10 g |
| 5-Methylbenzotriazole | 2.5 g |
| Sodium sulfite | 1.5 g |
| Potassium bromide | 1 g |
| Benzyl alcohol | 1.5 ml |
| Carboxymethyl cellulose | 6.1 g |
| Carbon black | 150 g |
| Water to make | 1 l |

The light-sensitive material was exposed to light through a color separation wedge. The cover sheet was superposed on the light-sensitive material thus exposed. The processing solution was uniformly spread over between the light-sensitive material and the cover sheet in a 80 μm thick film by means of a pair of parallel rollers.

After one hour, the density of the cyan image portion was measured.

Furthermore, after the light-sensitive material was exposed to light of 17,000 lux from a fluorescent lamp, the image stability at a density of 1.0 was measured. The results are shown in Table 5.

TABLE 5

| Light-sensitive material No. | Maximum density | Minimum density | Density after 2 weeks of fluorescent ray irradiation |
|---|---|---|---|
| 301 (comparative) | 2.20 | 0.36 | 0.59 |
| 302 (present invention) | 2.24 | 0.34 | 0.81 |

Table 5 shows that the cyan dye forming compound of the present invention provides an excellent positive image and an excellent fastness of dye to light.

The compounds (42), (49) and (53) of the present invention also give similar results.

Thus, the cyan dye forming compounds of the present invention can be relatively easily synthesized. The cyan dye forming compounds of the present invention also can produce a cyan having a hue in a long wavelength range. The cyan dye forming compounds of the present invention can further provide a beautiful color image having an excellent fastness to light. Furthermore, the cyan dye forming compounds of the present invention can render the color light-sensitive material stable.

While the invention has been described in detail and with reference to specific embodiments thereof, it will be apparent to one skilled in the art that various changes and modifications can be made therein without departing from the spirit and scope thereof.

What is claimed is:

1. A color light sensitive material, comprising: a support having provided thereon at least one light-sensitive silver salt layer combined with an image forming compound represented by formula (I)

$$(\text{Dye}-X)_q-y \qquad (I)$$

wherein

Dye is a group represented by formula (II):

X is selected from the group consisting of a chemical bond and a linking group;

Y is selected such that the compound of formula (I) is a non-diffusible image forming compound (1) producing a diffusible dye which undergoes self-cleavage upon oxidation during development, or (2) which undergoes self-cleavage to release a diffusible dye in the presence of a base, but does not substantially release a dye upon reaction with an oxide form of a development agent; and Y has an imagewise latent image and makes a difference in diffusibility between the dye that is released and the compound represented by formula (I), provided that Dye and X are linked to each other by A or E in formula (II); and q represents an integer of 1 or 2, provided that when q is 2, the two groups (Dye—X) are the same or different

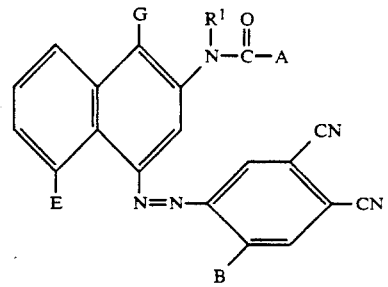

(II)

wherein

A is selected from the group consisting of a chemical bond, hydrogen, alkyl, substituted alkyl, cycloalkyl, substituted cycloalkyl, aryl, substituted aryl, heterocyclic, substituted heterocyclic,

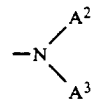

in which $A^2$ and $A^3$ each have the same meaning as A, or $A^2$ or $A^3$ are linked to each other to form a heterocyclic group;

$R^1$ is selected from the group consisting of hydrogen, alkyl, and substituted alkyl;

B is a halogen atom;

E is selected from the group consisting of a chemical bond, hydrogen, alkyl, substituted alkyl, halogen,

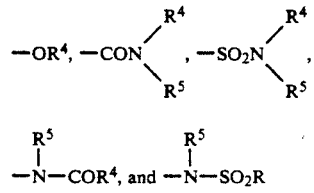

in which $R^4$ and $R^5$ are each selected from the group consisting of hydrogen, alkyl, substituted alkyl, aryl and substituted aryl, or, $R^4$ and $R^5$ form a 5- or 6-membered ring; and G is selected from the group consisting of hydroxyl, salt of a hydroxyl, a group represented by formula (T), a group represented by formula (U), and a group represented by formula (V)

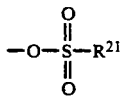
(T)

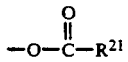
(U)

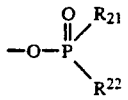
(V)

wherein $R^{21}$ and $R^{22}$ are the same or different and each are selected from the group consisting of alkyl, substituted alkyl, cycloalkyl, substituted cycloalkyl, alkenyl, substituted alkenyl, aralkyl, substituted aralkyl, aryl, substituted aryl, heterocyclic, substituted heterocyclic, alkoxy, substituted alkoxy, aryloxy, substituted aryloxy, alkylthio, substituted alkylthio, arylthio, substituted arylthio, amino, and substituted amino, or $R^{21}$ and $R^{22}$ are linked to each other to form a 5- or 6-membered ring.

2. A color light-sensitive material according to claim 1, wherein X represents a linking group selected from the groups consisting of $—NR^6—SO_2—$, $—NR^6—CO—$, $—R^7—(L)_k—(R^8)l—$ and a combination thereof, in which $R^6$ is selected from the group consisting of hydrogen, alkyl and substituted alkyl; $R^7$ and $R^8$ are each selected from the group consisting of alkylene, substituted alkylene, phenylene, substituted phenylene, naphthylene, and substituted naphthylene; L is selected from the group consisting of —O—, —CO—, —SO—, $—SO_2—$, $—SO_2NH—$, $—NHSO_2—$, —CONH—, and —NHCO—; k represents 0 or 1; and when k is 1, P represents 1, and when k is 0, P represents 1 or 0.

3. A color light-sensitive material according to claim 1, wherein E and X are linked to each other, and A is selected from the group consisting of alkyl, substituted alkyl, cycloalkyl, substituted cycloalkyl, aryl, substituted aryl, heterocyclic and a substituted heterocyclic.

4. A color light-sensitive material according to claim 3, wherein E and X are linked to each other, and A is selected from the group consisting of ethyl, isopropyl, t-butyl, cyclohexyl, 3-heptyl, methoxyethyl, phenyl, p-methylsulfonylphenyl, p-methylsulfonylaminophenyl, and p-sulfamoylphenyl.

5. A color light-sensitive material according to claim 1, wherein A and X are linked to each other, and E is selected from the group consisting of $—NHCO—R^4$ and $—NHSO_2R^4$, in which $R^4$ is selected from the group consisting of hydrogen, alkyl, substituted alkyl, aryl and substituted aryl.

6. A color light-sensitive material according to claim 5, wherein A and X are linked to each other, and e is selected from the group consisting of $—NHCOCH_3$, $—NHSO_2CH_3$, $—NHCOC_3H_7$, -continued

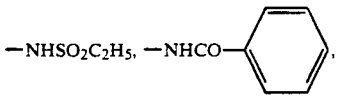

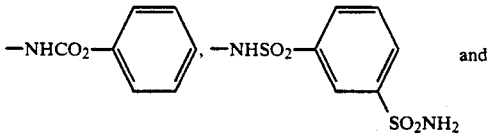

and

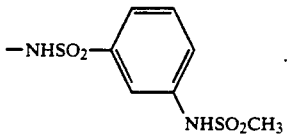

7. A color light-sensitive material according to claim 1, wherein $R^1$ represents hydrogen and G represents hydroxyl.

8. A color light-sensitive material according to claim 7, wherein Dye is selected from the group consisting of formula (IA) and formula (IB):

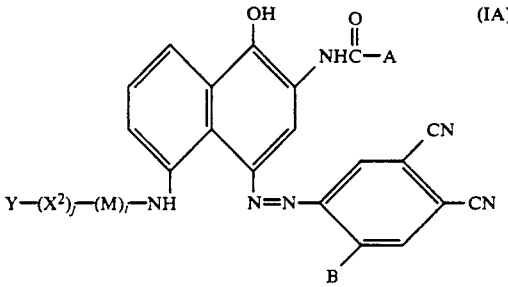
(IA)

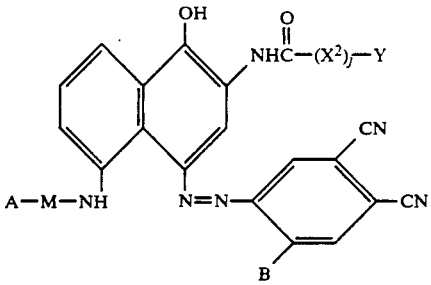
(IB)

wherein M is selected from the group consisting of $—SO_2—$ and $—\overset{O}{\overset{\|}{C}}—$;

$X^2$ is selected from the group consisting of $R^7—(L)_k—(R^8)_l—$ wherein $R^7$, L, k, $R^8$ and l have the same meaning as in claim 2 and A, Y and B have the same meaning as in claim 1; and i and j each represent 0 or 1.

9. A color-light sensitive material according to claim 8, wherein A is selected from the group consisting of alkyl, substituted alkyl, cycloalkyl, substituted cycloalkyl, aryl, substituted aryl, heterocyclic, and substituted heterocyclic; $R^7$ and $R^8$ are each selected from the group consisting of alkylene, substituted alkylene, phenylene and substituted phenylene; and L is selected from the group consisting of —$SO_2NH$—, —$NHSO_2$—, —CONH—, and —NHCO—.

10. A color light-sensitive material according to claim 1, wherein said image forming compound is contained in an amount of from about 0.01 to about 4 mol per mol of silver.

11. A color light-sensitive material according to claim 10, wherein said image forming compound is contained in an amount of from 0.05 to 2 mol per mol of silver.

12. A color light-sensitive material according to claim 1, wherein A is selected from the group consisting of $C_{1-8}$ alkyl, substituted $C_{1-8}$ alkyl, $C_{5-8}$ 5- or 6-membered cycloalkyl, substituted $C_{5-8}$ 5- or 6-membered cycloalkyl, $C_{6-10}$ aryl, substituted $C_{6-10}$ aryl, 5- or 6-membered heterocyclic containing oxygen, nitrogen or sulfur as hetero atoms, substituted 5- or 6-membered heterocyclic containing oxygen, nitrogen or sulfur a hetero atoms, and

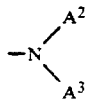

in which $A^2$ and $A^3$ each represent hydrogen, $C_{1-8}$ alkyl or $C_{6-10}$ aryl, or $A^2$ and $A^3$ are linked to each other to form a 6-membered ring;

$R_1$ is selected from the group consisting of $C_{1-4}$ alkyl and $C_{1-4}$ alkyl substituted with halogen, hydroxyl, alkoxy or cyano;

E represents a member selected from the group consisting of $C_{1-8}$ alkyl and substituted $C_{1-8}$ alkyl;

$R^4$ and $R^5$ each represent a member selected from the group consisting of $C_{1-8}$ alkyl, substituted $C_{1-8}$ alkyl, $C_{6-10}$ aryl and substituted $C_{6-10}$ aryl;

$R^{21}$ and $R^{22}$ are the same or different and each represent a member selected from the group consisting of $C_{1-18}$ alkyl, substituted $C_{1-18}$ alkyl, 5–10 monocyclic cycloalkyl, polycyclic 5- or 6-membered cycloalkyl, $C_{6-18}$ aryl, substituted $C_{6-18}$ aryl, 5- or 6-membered heterocyclic, and substituted 5- or 6-membered heterocyclic.

13. A color light-sensitive material according to claim 2, wherein $R^6$ represents a member selected from the group consisting of $C_{1-4}$ alkyl and substituted $C_{1-4}$ alkyl;

$R^7$ and $R^8$ each represent a member selected from the group consisting of $C_{1-6}$ alkylene, $C_{1-8}$ substituted alkylene, $C_{6-10}$ substituted phenylene, and $C_{10-14}$ substituted naphthylene.

14. A color light-sensitive material according to claim 3, wherein A is selected from the group consisting of $C_{1-8}$ alkyl, substituted $C_{1-8}$ alkyl, $C_{6-10}$ aryl, and substituted $C_{6-10}$ aryl.

15. A color light-sensitive material according to claim 5, wherein $R^4$ represents a member selected from the group consisting of $C_{1-8}$ alkyl, substituted $C_{1-8}$ alkyl, $C_{6-10}$ aryl, and substituted $C_{6-10}$ aryl.

16. A color light-sensitive material according to claim 9 wherein A represents a member selected from the group consisting of $C_{1-8}$ alkyl, substituted $C_{1-8}$ alkyl, $C_{6-10}$ aryl, and substituted $C_{6-10}$ aryl;

$R^7$ and $R^8$ each represent $C_{1-6}$ alkylene, $C_{1-8}$ substituted alkylene, and $C_{6-10}$ substituted phenylene.

17. A color light-sensitive material according to claim 12, wherein said substituted alkyl and substituted cycloalkyl represented by A are substituted with a member selected from the group consisting of halogen; —$OR^2$ in which $R^2$ represents $C_{1-8}$ alkyl, substituted $C_{1-8}$ alkyl, $C_{6-10}$ aryl or substituted $C_{6-10}$ aryl; cyano;

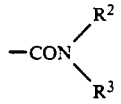

in which $R^2$ and $R^3$ each represent hydrogen, $C_{1-4}$ alkyl or $C_{6-10}$ aryl; —$SO_2R^2$ in which $R^2$ represents $C_{1-8}$ alkyl or $C_{6-10}$ aryl; carboxy; sulfo; $C_{2-8}$ acylamino; and $C_{1-8}$ acylamino; and $C_{1-8}$ sulfonyl amino; and wherein said substituted aryl and substituted heterocyclic represented by A are each substituted with $C_{1-8}$ alkyl; substituted $C_{1-8}$ alkyl; —$OR^2$ in which $R^2$ represents $C_{1-8}$ alkyl or $C_{1-8}$ alkyl substituted with $C_{1-5}$ alkyl, halogen, and cyano; halogen; $C_{2-8}$ acylamino, $C_{1-8}$ sulfonylamino; cyano; —$SO_2R^2$ in which $R^2$ represents $C_{1-8}$ alkyl; hydroxyl; alkyl; hydroxyl;

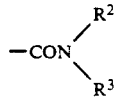

in which $R^2$ and $R^3$ represent hydrogen, or $C_{1-8}$ alkyl; carboxy; sulfo; $C_{1-8}$ alkylcarbonyl or $C_{2-8}$ 2-substituted amino;

said substituted $C_{1-4}$ alkyl represented by B is substituted with halogen; —$OR^2$ in which $R^2$ represents $C_{1-6}$ alkyl; cyano; —$SO_2R^2$ in which $R^2$ represents $C_{1-6}$ alkyl; $C_{2-6}$ acylamino; $C_{1-6}$ sulfonylamino;

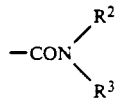

in which $R^2$ and $R^3$ each represent hydrogen, $C_{1-6}$ alkyl, or $C_{6-10}$ aryl or

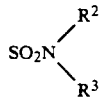

in which $R^2$ and $R^3$ each represent hydrogen, $C_{1-6}$ alkyl, or $C_{6-10}$ aryl; $R^2$ represents $C_{1-4}$ alkyl;

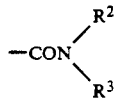

which $R^2$ and $R^3$ each represent hydrogen or $C_{1-4}$ alkyl;

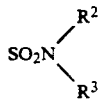

in which $R^2$ and $R^3$ each represent hydrogen or $C_{1-4}$ alkyl; 2-substituted amino substituted with $C_{1-4}$ alkyl; carboxy; sulfo; and $C_{1-4}$ alkyloxy carbonyl;

said substituted $C_{1-8}$ alkyl represented by E is substituted with halogen, cyano, $C_{1-5}$ alkoxy, sulfonylamino, acylamino, carbamoyl, sulfamoyl, $—SO_2R^2$ in which $R^2$ represents $C_{1-8}$ alkyl, or $C_{2-6}$ 2-substituted amino;

said substituted $C_{1-8}$ alkyl represented by $R^4$ and $R^5$ is substituted with the above recited substituents for $C_{1-8}$ alkyl represented by $E^5$;

said substituted $C_{6-10}$ aryl represented by $R^4$ and $R^5$, is substituted with $C_{1-8}$ alkyl, halogen, cyano, $C_{1-5}$ alkoxy, substituted $C_{1-5}$ alkoxy, sulfonylamino, acylamino, carbamoyl, substituted carbamoyl, sulfamoyl, substituted sulfamoyl, $—SO_2R^2$ in which $R^2$ represents $C_{1-8}$ alkyl, or $C_{2-6}$ 2-substituted amino; and said substituted $C_{1-18}$ alkyl represented by $R^{21}$ and $R^{22}$ is substituted with halogen, $C_{1-18}$ alkoxy, $C_{6-18}$ aryloxy, cyano, $C_{1-18}$ alkylthio, $C_{6-8}$ arylthio, carbamoyl, $C_{2-18}$ disubstituted carbamoyl, $C_{1-18}$ alkylsulfonyl, $C_{6-18}$ arylsulfonyl, disubstituted amino substituted with $C_{1-18}$ alkyl or $C_{6-18}$ aryl, carboxy, sulfo, $C_{1-18}$ acylamino, and sulfonylamino.

* * * * *